US008958566B2

(12) United States Patent
Hellmuth et al.

(10) Patent No.: US 8,958,566 B2
(45) Date of Patent: Feb. 17, 2015

(54) AUDIO SIGNAL DECODER, METHOD FOR DECODING AN AUDIO SIGNAL AND COMPUTER PROGRAM USING CASCADED AUDIO OBJECT PROCESSING STAGES

(75) Inventors: Oliver Hellmuth, Erlangen (DE); Cornelia Falch, Rum (AT); Juergen Herre, Buckenhof (DE); Johannes Hilpert, Nuremberg (DE); Leon Terentiv, Erlangen (DE); Falko Ridderbusch, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 295 days.

(21) Appl. No.: 13/335,047

(22) Filed: Dec. 22, 2011

(65) Prior Publication Data

US 2012/0177204 A1 Jul. 12, 2012

Related U.S. Application Data

(63) Continuation of application No. PCT/EP2010/058906, filed on Jun. 23, 2010.

(60) Provisional application No. 61/220,042, filed on Jun. 24, 2009.

(51) Int. Cl.
*H04R 5/00* (2006.01)
*G10L 19/20* (2013.01)
(Continued)

(52) U.S. Cl.
CPC ..... *G10L 19/20* (2013.01); *G10L 19/008* (2013.01); *H04S 7/30* (2013.01);
(Continued)

(58) Field of Classification Search
CPC ..... G10L 19/0017; G10L 19/0018; G10L 19/002; G10L 19/005; G10L 19/008; G10L 19/0204; G10L 19/0216; G10L 19/028; G10L 19/03; G10L 19/097; G10L 19/13; G10L 19/167; G10L 19/173; G10L 19/18; G10L 21/0308; G10L 21/0364; G10L 21/057; H04S 2420/03; G11B 2020/00021; G11B 2020/00028; G11B 2020/00036; G11B 2020/00043; G11B 2020/0005; G11B 2020/00057; G11B 2020/00065
USPC ..... 381/22, 23, 20, 21, 10, 61, 1, 2, 15, 16, 381/17, 18, 19, 309, 310, 311, 26, 86, 91, 381/92, 94.2, 94.3, 94.4, 97, 98, 103, 119, 381/122; 704/501, 504, E19.042, E19.044, 704/E19.048, 200, 203, 205, 500, E19.01; 700/94
See application file for complete search history.

(56) References Cited

U.S. PATENT DOCUMENTS

2003/0236583 A1 12/2003 Baumgarte et al.
2007/0236858 A1* 10/2007 Disch et al. ..... 361/272
(Continued)

FOREIGN PATENT DOCUMENTS

CN 1647144 7/2005
TW 200813981 3/2008
(Continued)

OTHER PUBLICATIONS

Engdegord et al "Spatial Audio Object Codig (SAOC)—The Upcoming MPEG Standard on Parametric Object Based Audio Coding" 124th AES Convention, Audio Engineering Society, Paper 7377, May 17, 2008, pp. 1-15.*
(Continued)

*Primary Examiner* — Leshui Zhang
(74) *Attorney, Agent, or Firm* — Michael A. Glenn; Perkins Coie LLP

(57) ABSTRACT

An audio signal decoder for providing an upmix signal representation in dependence on a downmix signal representation and an object-related parametric information includes an object separator configured to decompose the downmix signal representation, to provide a first audio information describing a first set of one or more audio objects of a first audio object type and a second audio information describing a second set of one or more audio objects of a second audio object type, in dependence on the downmix signal representation and using at least a part of the object-related parametric information.

36 Claims, 20 Drawing Sheets

OVERALL STRUCTURE OF THE SAOC TRANSCODER/DECODER ARCHITECTURE

(51) Int. Cl.

| | |
|---|---|
| ***G10L 19/008*** | (2013.01) |
| ***H04S 7/00*** | (2006.01) |
| *G10H 1/36* | (2006.01) |

(52) U.S. Cl.

CPC ..... *G10H 1/361* (2013.01); *G10H 2210/301* (2013.01); *H04S 2400/11* (2013.01); *H04S 2420/07* (2013.01)

USPC ..... 381/22; 381/23; 381/61; 381/86; 704/E19.01; 704/E19.042; 704/E19.048

(56) References Cited

U.S. PATENT DOCUMENTS

| | | | |
|---|---|---|---|
| 2008/0170711 | A1 | 7/2008 | Breebaart et al. |
| 2008/0269929 | A1 | 10/2008 | Oh et al. |
| 2009/0051637 | A1 | 2/2009 | Chen et al. |
| 2009/0125313 | A1 | 5/2009 | Hellmuth et al. |
| 2009/0125314 | A1 | 5/2009 | Hellmuth et al. |
| 2009/0287495 | A1 | 11/2009 | Breebaart et al. |
| 2010/0017195 | A1 | 1/2010 | Villemoes |
| 2010/0094631 | A1 | 4/2010 | Engdegard et al. |

FOREIGN PATENT DOCUMENTS

| | | |
|---|---|---|
| TW | 200910325 | 3/2009 |
| TW | 200910328 | 3/2009 |
| WO | WO-2006016735 | 2/2006 |
| WO | 2008/060111 | 5/2008 |

OTHER PUBLICATIONS

ISO, "Study on ISO/IEC FCD 23003-2:200x, Spatial Audio Object Coding (SAOC)", Apr. 2009, Hawaii, USA, p. 1-45.*

ISO/IEC JTC1/SC29/WG11 (MPEG), Document N8853, "Call for Proposals on Spatial Audio Object Coding", 79th MPEG Meeting, Marrakech, Jan. 2007.

ISO/IEC JTC1/SC29/WG11 (MPEG), Document N9099, "Final Spatial Audio Object Coding Evaluation Procedures and Criterion", 80th MPEG Meeting, San Jose, Apr. 2007.

ISO/IEC JTC1/SC29/WG11 (MPEG), Document N9250, "Report on Spatial Audio Object Coding RM0 Selection", 81st MPEG Meeting, Lausanne, Jul. 2007.

ISO/IEC JTC1/SC29/WG11 (MPEG), Document M15123, "Information and Verification Results for CE on Karaoke/Solo system improving the performance of MPEG SAOC RM0", 83rd MPEG Meeting, Antalya, Turkey, Jan. 2008.

ISO/IEC JTC1/SC29/WG11 (MPEG), Document N10659, "Study on ISO/IEC 23003-2:200x Spatial Audio Object Coding (SAOC)", 88th MPEG Meeting, Maui, USA, Apr. 2009.

ISO/IEC JTC1/SC29/WG11 (MPEG), Document M10660, "Status and Workplan on SAOC Core Experiments", 88th MPEG Meeting Maui, USA, Apr. 2009.

EBU Technical recommendation: "MUSHRA-EBU Method for Subjective Listening Tests of Intermediate Audio Quality", Doc. B/AIM022, Oct. 1999.

ISO/IEC 23003-1:2007, Information technology—MPEG audio technologies—Part 1: MPEG Surround.

Engdegard J. et al: "Spatial Audio Object Coding (SAOC)—The Upcoming MPEG Standard on Parametric Object Based Audio Coding", 124th AES Convention, Audio Engineering Society, Paper 7377, May 17, 2008, pp. 1-15.

* cited by examiner

OVERALL STRUCTURE OF THE SAOC TRANSCODER/DECODER ARCHITECTURE

ARCHITECTURE OF THE RESIDUAL PROCESSOR

ARCHITECTURE OF THE RESIDUAL PROCESSOR

BASIC STRUCTURE OF THE COMBINED EKS SAOC SYSTEM

GENERALIZED STRUCTURE OF THE COMBINED EKS SAOC SYSTEM

| Coder name | Description |
|---|---|
| hidden reference | ideally rendered audio scene (hidden reference) |
| lower anchor | lower anchor @ 3.5kHz |
| regular SAOC | regular SAOC decoding mode |
| current EKS | current SAOC EKS mode |
| combined system | combined (EKS+SAOC) system (proposed system) |

FIG 6A

| System | Bitstream | Karaoke rendering | Classic rendering |
|---|---|---|---|
| combined system | SAOC A + res. A data | X | X |
| regular SAOC | SAOC A data | (X) | X |
| current EKS | SAOC B + res. B data | X | - |

FIG 6B

| Item | Type | Rendering matrix | Downmix matrix |
|---|---|---|---|
| k-pop 1 | Karaoke | [0.6 0.4 0.0 1.0 0.0 0.6 0.0 1.0 0.038<br>0.0 0.0 0.4 0.0 1.0 0.0 0.6 1.2 0.038] | [0.0 0.4 0.0 1.0 0.0 0.6 0.0 1.0 0.6<br>0.6 0.0 0.4 0.0 1.0 0.0 0.6 1.2 0.6] |
| | Classic | [0.6 0.4 0.0 1.0 0.0 0.6 0.0 1.0 0.6<br>0.0 0.0 0.4 0.0 1.0 0.0 0.6 1.2 0.6] | |
| rock | Karaoke | [1.0 0.0 0.707 0.707 0.000 0.038<br>0.0 1.0 0.707 0.000 0.707 0.038] | [1.0 0.0 0.707 0.707 0.000 0.707<br>0.0 1.0 0.707 0.000 0.707 0.707] |
| | Classic | [1.0 0.0 0.6 0.0 0.707 0.000 0.4<br>0.0 1.0 0.4 0.0 0.000 0.707 0.6] | |

FIG 6C

MPEG SAOC SYSTEM OVERVIEW

SEPARATE DECODER AND MIXER

AUDIO SIGNAL DECODER, METHOD FOR DECODING AN AUDIO SIGNAL AND COMPUTER PROGRAM USING CASCADED AUDIO OBJECT PROCESSING STAGES

CROSS-REFERENCE TO RELATED APPLICATIONS

This application is a continuation of copending International Application No. PCT/EP2010/058906, filed Jun. 23, 2010, which is incorporated herein by reference in its entirety, and additionally claims priority from U.S. Application No. 61/220,042, filed Jun. 24, 2009, which is also incorporated herein by reference in its entirety.

BACKGROUND OF THE INVENTION

Embodiments according to the invention are related to an audio signal decoder for providing an upmix signal representation in dependence on a downmix signal representation and an object-related parametric information.

Further embodiments according to the invention are related to a method for providing an upmix signal representation in dependence on a downmix signal representation and an object-related parametric information.

Further embodiments according to the invention are related to a computer program.

Some embodiments according to the invention are related to an enhanced Karaoke/Solo SAOC system.

In modern audio systems, it is desired to transfer and store audio information in a bitrate-efficient way. In addition, it is often desired to reproduce an audio content using a plurality of two or even more speakers, which are spatially distributed in a room. In such cases, it is desired to exploit the capabilities of such a multi-speaker arrangement to allow for a user to spatially identify different audio contents or different items of a single audio content. This may be achieved by individually distributing the different audio contents to the different speakers.

In other words, in the art of audio processing, audio transmission and audio storage, there is an increasing desire to handle multi-channel contents in order to improve the hearing impression. Usage of multi-channel audio content brings along significant improvements for the user. For example, a 3-dimensional hearing impression can be obtained, which brings along an improved user satisfaction in entertainment applications. However, multi-channel audio contents are also useful in professional environments, for example in telephone conferencing applications, because the speaker intelligibility can be improved by using a multi-channel audio playback.

However, it is also desirable to have a good tradeoff between audio quality and bitrate requirements in order to avoid an excessive resource load caused by multi-channel applications.

Recently, parametric techniques for the bitrate-efficient transmission and/or storage of audio scenes containing multiple audio objects has been proposed, for example, Binaural Cue Coding (Type I) (see, for example reference [BCC]), Joint Source Coding (see, for example, reference [JSC]), and MPEG Spatial Audio Object Coding (SAOC) (see, for example, references [SAOC1], [SAOC2]).

These techniques aim at perceptually reconstructing the desired output audio scene rather than by a waveform match.

FIG. 8 shows a system overview of such a system (here: MPEG SAOC). The MPEG SAOC system 800 shown in FIG. 8 comprises an SAOC encoder 810 and an SAOC decoder 820. The SAOC encoder 810 receives a plurality of object signals $x_1$ to $x_N$, which may be represented, for example, as time-domain signals or as time-frequency-domain signals (for example, in the form of a set of transform coefficients of a Fourier-type transform, or in the form of QMF subband signals). The SAOC encoder 810 typically also receives downmix coefficients $d_1$ to $d_N$, which are associated with the object signals $x_1$ to $x_N$. Separate sets of downmix coefficients may be available for each channel of the downmix signal. The SAOC encoder 810 is typically configured to obtain a channel of the downmix signal by combining the object signals $x_1$ to $x_N$ in accordance with the associated downmix coefficients $d_1$ to $d_N$. Typically, there are less downmix channels than object signals $x_1$ to $x_N$. In order to allow (at least approximately) for a separation (or separate treatment) of the object signals at the side of the SAOC decoder 820, the SAOC encoder 810 provides both the one or more downmix signals (designated as downmix channels) 812 and a side information 814. The side information 814 describes characteristics of the object signals $x_1$ to $x_N$, in order to allow for a decoder-sided object-specific processing.

The SAOC decoder 820 is configured to receive both the one or more downmix signals 812 and the side information 814. Also, the SAOC decoder 820 is typically configured to receive a user interaction information and/or a user control information 822, which describes a desired rendering setup. For example, the user interaction information/user control information 822 may describe a speaker setup and the desired spatial placement of the objects provided by the object signals $x_1$ to $x_N$.

The SAOC decoder 820 is configured to provide, for example, a plurality of decoded upmix channel signals $\hat{y}_1$ to $\hat{y}_M$. The upmix channel signals may for example be associated with individual speakers of a multi-speaker rendering arrangement. The SAOC decoder 820 may, for example, comprise an object separator 820*a*, which is configured to reconstruct, at least approximately, the object signals $x_1$ to $x_N$ on the basis of the one or more downmix signals 812 and the side information 814, thereby obtaining reconstructed object signals 820*b*. However, the reconstructed object signals 820*b* may deviate somewhat from the original object signals $x_1$ to $x_N$, for example, because the side information 814 is not quite sufficient for a perfect reconstruction due to the bitrate constraints. The SAOC decoder 820 may further comprise a mixer 820*c*, which may be configured to receive the reconstructed object signals 820*b* and the user interaction information/user control information 822, and to provide, on the basis thereof, the upmix channel signals $\hat{y}_1$ to $\hat{y}_M$. The mixer 820*c* may be configured to use the user interaction information/user control information 822 to determine the contribution of the individual reconstructed object signals 820*b* to the upmix channel signals $\hat{y}_1$ to $\hat{y}_M$. The user interaction information/user control information 822 may, for example, comprise rendering parameters (also designated as rendering coefficients), which determine the contribution of the individual reconstructed object signals 820*b* to the upmix channel signals $\hat{y}_1$ to $\hat{y}_M$.

However, it should be noted that in many embodiments, the object separation, which is indicated by the object separator 820*a* in FIG. 8, and the mixing, which is indicated by the mixer 820*c* in FIG. 8, are performed in one single step. For this purpose, overall parameters may be computed which describe a direct mapping of the one or more downmix signals 812 onto the upmix channel signals $\hat{y}_1$ to $\hat{y}_M$. These parameters may be computed on the basis of the side information 814 and the user interaction information/user control information 822.

Taking reference now to FIGS. 9*a*, 9*b* and 9*c*, different apparatus for obtaining an upmix signal representation on the basis of a downmix signal representation and object-related side information will be described. FIG. 9*a* shows a block schematic diagram of an MPEG SAOC system 900 comprising an SAOC decoder 920. The SAOC decoder 920 comprises, as separate functional blocks, an object decoder 922 and a mixer/renderer 926. The object decoder 922 provides a plurality of reconstructed object signals 924 in dependence on the downmix signal representation (for example, in the form of one or more downmix signals represented in the time domain or in the time-frequency-domain) and object-related side information (for example, in the form of object meta data). The mixer/renderer 926 receives the reconstructed object signals 924 associated with a plurality of N objects and provides, on the basis thereof, one or more upmix channel signals 928. In the SAOC decoder 920, the extraction of the object signals 924 is performed separately from the mixing/rendering which allows for a separation of the object decoding functionality from the mixing/rendering functionality but brings along a relatively high computational complexity.

Taking reference now to FIG. 9*b*, another MPEG SAOC system 930 will be briefly discussed, which comprises an SAOC decoder 950. The SAOC decoder 950 provides a plurality of upmix channel signals 958 in dependence on a downmix signal representation (for example, in the form of one or more downmix signals) and an object-related side information (for example, in the form of object meta data). The SAOC decoder 950 comprises a combined object decoder and mixer/renderer, which is configured to obtain the upmix channel signals 958 in a joint mixing process without a separation of the object decoding and the mixing/rendering, wherein the parameters for said joint upmix process are dependent on both, the object-related side information and the rendering information. The joint upmix process also depends on the downmix information, which is considered to be part of the object-related side information.

To summarize the above, the provision of the upmix channel signals 928, 958 can be performed in a one step process or a two-step process.

Taking reference now to FIG. 9*c*, an MPEG SAOC system 960 will be described. The SAOC system 960 comprises an SAOC to MPEG Surround transcoder 980, rather than an SAOC decoder.

The SAOC to MPEG Surround transcoder comprises a side information transcoder 982, which is configured to receive the object-related side information (for example, in the form of object meta data) and, optionally, information on the one or more downmix signals and the rendering information. The side information transcoder is also configured to provide an MPEG Surround side information 984 (for example, in the form of an MPEG Surround bitstream) on the basis of a received data. Accordingly, the side information transcoder 982 is configured to transform an object-related (parametric) side information, which is relieved from the object encoder, into a channel-related (parametric) side information 984, taking into consideration the rendering information and, optionally, the information about the content of the one or more downmix signals.

Optionally, the SAOC to MPEG Surround transcoder 980 may be configured to manipulate the one or more downmix signals, described, for example, by the downmix signal representation, to obtain a manipulated downmix signal representation 988. However, the downmix signal manipulator 986 may be omitted, such that the output downmix signal representation 988 of the SAOC to MPEG Surround transcoder 980 is identical to the input downmix signal representation of the SAOC to MPEG Surround transcoder. The downmix signal manipulator 986 may, for example, be used if the channel-related MPEG Surround side information 984 would not allow to provide a desired hearing impression on the basis of the input downmix signal representation of the SAOC to MPEG Surround transcoder 980, which may be the case in some rendering constellations.

Accordingly, the SAOC to MPEG Surround transcoder 980 provides the downmix signal representation 988 and the MPEG Surround bitstream 984 such that a plurality of upmix channel signals, which represent the audio objects in accordance with the rendering information input to the SAOC to MPEG Surround transcoder 980 can be generated using an MPEG Surround decoder which receives the MPEG Surround bitstream 984 and the downmix signal representation 988.

To summarize the above, different concepts for decoding SAOC-encoded audio signals can be used. In some cases, an SAOC decoder is used, which provides upmix channel signals (for example, upmix channel signals 928, 958) in dependence on the downmix signal representation and the object-related parametric side information. Examples for this concept can be seen in FIGS. 9*a* and 9*b*. Alternatively, the SAOC-encoded audio information may be transcoded to obtain a downmix signal representation (for example, a downmix signal representation 988) and a channel-related side information (for example, the channel-related MPEG Surround bitstream 984), which can be used by an MPEG Surround decoder to provide the desired upmix channel signals.

In the MPEG SAOC system 800, a system overview of which is given in FIG. 8, the general processing is carried out in a frequency selective way and can be described as follows within each frequency band:

- N input audio object signals $x_1$ to $x_N$ are downmixed as part of the SAOC encoder processing. For a mono downmix, the downmix coefficients are denoted by $d_1$ to $d_N$. In addition, the SAOC encoder 810 extracts side information 814 describing the characteristics of the input audio objects. For MPEG SAOC, the relations of the object powers with respect to each other are the most basic form of such a side information.
- Downmix signal (or signals) 812 and side information 814 are transmitted and/or stored. To this end, the downmix audio signal may be compressed using well-known perceptual audio coders such as MPEG-1 Layer II or III (also known as ".mp3"), MPEG Advanced Audio Coding (AAC), or any other audio coder.
- On the receiving end, the SAOC decoder 820 conceptually tries to restore the original object signal ("object separation") using the transmitted side information 814 (and, naturally, the one or more downmix signals 812). These approximated object signals (also designated as reconstructed object signals 820*b*) are then mixed into a target scene represented by M audio output channels (which may, for example, be represented by the upmix channel signals $\hat{y}_1$ to $\hat{y}_M$) using a rendering matrix. For a mono output, the rendering matrix coefficients are given by $r_1$ to $r_N$.
- Effectively, the separation of the object signals is rarely executed (or even never executed), since both the separation step (indicated by the object separator 820*a*) and the mixing step (indicated by the mixer 820*c*) are combined into a single transcoding step, which often results in an enormous reduction in computational complexity.

It has been found that such a scheme is tremendously efficient, both in terms of transmission bitrate (it is only necessitated to transmit a few downmix channels plus some side information instead of N discrete object audio signals or a discrete system) and computational complexity (the processing complexity relates mainly to the number of output channels rather than the number of audio objects). Further advantages for the user on the receiving end include the freedom of choosing a rendering setup of his/her choice (mono, stereo, surround, virtualized headphone playback, and so on) and the feature of user interactivity: the rendering matrix, and thus the output scene, can be set and changed interactively by the user according to will, personal preference or other criteria. For example, it is possible to locate the talkers from one group together in one spatial area to maximize discrimination from other remaining talkers. This interactivity is achieved by providing a decoder user interface.

For each transmitted sound object, its relative level and (for non-mono rendering) spatial position of rendering can be adjusted. This may happen in real-time as the user changes the position of the associated graphical user interface (GUI) sliders (for example: object level=+5 dB, object position=−30 deg).

However, it has been found that it is difficult to handle audio objects of different audio object types in such a system. In particular, it has been found that it is difficult to process audio objects of different audio object types, for example, audio objects to which different side information is associated, if the total number of audio objects to be processed is not predetermined.

SUMMARY

According to an embodiment, an audio signal decoder for providing an upmix signal representation in dependence on a downmix signal representation, an object-related parametric information, may have: an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information, wherein the second audio information is an audio information describing the audio objects of the second audio object type in a combined manner; an audio signal processor configured to receive the second audio information and to process the second audio information in dependence on the object-related parametric information, to obtain a processed version of the second audio information; and an audio signal combiner configured to combine the first audio information with the processed version of the second audio information, to obtain the upmix signal representation; wherein the audio signal decoder is configured to provide the upmix signal representation in dependence on a residual information associated to a subset of audio objects represented by the downmix signal representation, wherein the object separator is configured to decompose the downmix signal representation to provide the first audio information describing a first set of one or more audio objects of a first audio object type to which residual information is associated, and the second audio information describing a second set of one or more audio objects of a second audio object type, to which no residual information is associated, in dependence on the downmix signal representation and using the residual information; and wherein the audio signal processor is configured to process the second audio information, to perform an object-individual processing of the audio objects of the second audio object type, taking into consideration object-related parametric information associated with more than two audio objects of the second audio object type; and wherein the residual information describes a residual distortion, which is expected to remain if an audio object of the first audio object type is isolated merely using the object-related parametric information.

According to another embodiment, a method for providing an upmix signal representation in dependence on a downmix signal representation and an object-related parametric information may have the steps of: decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information, wherein the second audio information is an audio information describing the audio objects of the second audio object type in a combined manner; and processing the second audio information in dependence on the object-related parametric information, to obtain a processed version of the second audio information; and combining the first audio information with the processed version of the second audio information, to obtain the upmix signal representation; wherein the upmix signal representation is provided in dependence on a residual information associated to a subset of audio objects represented by the downmix signal representation, wherein the downmix signal representation is decomposed, to provide the first audio information describing a first set of one or more audio objects of a first audio object type to which residual information is associated, and the second audio information describing a second set of one or more audio objects of a second audio object type, to which no residual information is associated, in dependence on the downmix signal representation and using the residual information; wherein an object-individual processing of the audio objects of the second audio object type is performed, taking into consideration object-related parametric information associated with more than two audio objects of the second audio object type; and wherein the residual information describes a residual distortion, which is expected to remain if an audio object of the first audio object type is isolated merely using the object-related parametric information.

According to another embodiment, an audio signal decoder for providing an upmix signal representation in dependence on a downmix signal representation, an object-related parametric information, may have: an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; an audio signal processor configured to receive the second audio information and to process the second audio information in dependence on the object-related parametric information, to obtain a processed version of the second audio information; and an audio signal combiner configured to combine the first audio information with the processed version of the second audio information, to obtain the upmix signal representation; wherein the object separator is configured to obtain the first audio information and the second audio information according to $$X_{OBJ} = M_{OBJ}^{Prediction}\begin{pmatrix} l_0 \\ r_0 \\ \hline res_0 \\ \vdots \\ res_{N_{EAO}-1} \end{pmatrix}$$

$$X_{EAO} = A^{EAO} M_{EAO}^{Prediction}\begin{pmatrix} l_0 \\ r_0 \\ \hline res_0 \\ \vdots \\ res_{N_{EAO}-1} \end{pmatrix}$$

wherein $M_{Prediction}=\tilde{D}^{-1}C$, wherein $$M^{Prediction} = \begin{pmatrix} M_{OBJ}^{Prediction} \\ \hline M_{EAO}^{Prediction} \end{pmatrix}$$

wherein $X_{OBJ}$ represent channels of the second audio information; wherein $X_{EAO}$ represent object signals of the first audio information; wherein $\tilde{D}^{-1}$ represents a matrix which is an inverse of an extended downmix matrix; wherein C describes a matrix representing a plurality of channel prediction coefficients, $\tilde{c}_{j,0}$, $\tilde{c}_{j,1}$; wherein $l_0$ and $r_0$ represent channels of the downmix signal representation; wherein $res_0$ to $res_{N_{EAO}-1}$ represent residual channels; and wherein $A^{EAO}$ is a EAO pre-rendering matrix, entries of which describe a mapping of enhanced audio objects to channels of an enhanced audio object signal $X_{EAO}$; wherein the object separator is configured to obtain the inverse downmix matrix $\tilde{D}^{-1}$ as an inverse of an extended downmix matrix $\tilde{D}$ which is defined as $$\tilde{D} = \left(\begin{array}{cc|ccc} 1 & 0 & m_0 & \dots & m_{N_{EAO}-1} \\ 0 & 1 & n_0 & \dots & n_{N_{EAO}-1} \\ \hline m_0 & n_0 & -1 & \dots & 0 \\ \vdots & \vdots & 0 & \ddots & \vdots \\ m_{N_{EAO}-1} & n_{N_{EAO}-1} & 0 & \dots & -1 \end{array}\right)$$

wherein the object separator is configured to obtain the matrix C as $$C = \left(\begin{array}{cc|ccc} 1 & 0 & 0 & \dots & 0 \\ 0 & 1 & 0 & \dots & 0 \\ \hline c_{0,0} & c_{0,1} & 1 & \dots & 0 \\ \vdots & \vdots & \vdots & \ddots & \vdots \\ c_{N_{EAO}-1,0} & c_{N_{EAO}-1,1} & 0 & \dots & 1 \end{array}\right)$$

wherein $m_0$ to $m_{N_{EAO}-1}$ are downmix values associated with the audio objects of the first audio object type; wherein $n_0$ to $n_{N_{EAO}-1}$ are downmix values associated with the audio objects of the first audio object type; wherein the object separator is configured to compute the prediction coefficients $\tilde{c}_{j,0}$ and $\tilde{c}_{j,1}$ as $$\tilde{c}_{j,0} = \frac{P_{LoCo,j}P_{Ro} - P_{RoCo,j}P_{LoRo}}{P_{Lo}P_{Ro} - P_{LoRo}^2}$$

-continued $$\tilde{c}_{j,1} = \frac{P_{RoCo,j}P_{Lo} - P_{LoCo,j}P_{LoRo}}{P_{Lo}P_{Ro} - P_{LoRo}^2}; \text{ and}$$

wherein the object separator is configured to derive constrained prediction coefficients $c_{j,0}$ and $c_{j,1}$ from the prediction coefficients $\tilde{c}_{j,0}$ and $\tilde{c}_{j,1}$ using a constraining algorithm, or to use the prediction coefficients $\tilde{c}_{j,0}$ and $\tilde{c}_{j,1}$ as the prediction coefficients $c_{j,0}$ and $c_{j,1}$; wherein energy quantities $P_{Lo}$, $P_{Ro}$, $P_{LoRo}$, $P_{LoCo,j}$ and $P_{RoCo,j}$ are defined as $$P_{Lo} = OLD_L + \sum_{j=0}^{N_{EAO}-1}\sum_{k=0}^{N_{EAO}-1} m_j m_k e_{j,k}$$

$$P_{Ro} = OLD_R + \sum_{j=0}^{N_{EAO}-1}\sum_{k=0}^{N_{EAO}-1} n_j n_k e_{j,k}$$

$$P_{LoRo} = e_{L,R} + \sum_{j=0}^{N_{EAO}-1}\sum_{k=0}^{N_{EAO}-1} m_j n_k e_{j,k}$$

$$P_{LoCo,j} = m_j OLD_L + n_j e_{L,R} - m_j OLD_j - \sum_{\substack{i=0 \\ i\neq j}}^{N_{EAO}-1} m_i e_{i,j}$$

$$P_{RoCo,j} = n_j OLD_R + m_j e_{L,R} - n_j OLD_j - \sum_{\substack{i=0 \\ i\neq j}}^{N_{EAO}-1} n_i e_{i,j}$$

wherein parameters $OLD_L$, $OLD_R$ and $IOC_{L,R}$ correspond to audio objects of the second audio object type and are defined according to $$OLD_L = \sum_{i=0}^{N-N_{EAO}-1} d_{0,i}^2 OLD_i,$$

$$OLD_R = \sum_{i=0}^{N-N_{EAO}-1} d_{1,i}^2 OLD_i,$$

$$IOC_{L,R} = \begin{cases} IOC_{0,1}, & N - N_{EAO} = 2, \\ 0, & \text{otherwise.} \end{cases}$$

wherein $d_{0,i}$ and $d_{1,i}$ are downmix values associated with the audio objects of the second audio object type; wherein $OLD_i$ are object level difference values associated with the audio objects of the second audio object type; wherein N is a total number of audio objects; wherein $N_{EAO}$ is a number of audio objects of the first audio object type; wherein $IOC_{0,1}$ is an inter-object-correlation value associated with a pair of audio objects of the second audio object type; wherein $e_{i,j}$ and $e_{L,R}$ are covariance values derived from object-level-difference parameters and inter-object-correlation parameters; and wherein $e_{i,j}$ are associated with a pair of audio objects of the 1st audio object type and $e_{L,R}$ is associated with a pair of audio objects of the second audio object type.

According to another embodiment, an audio signal decoder for providing an upmix signal representation in dependence on a downmix signal representation, an object-related parametric information, may have: an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; an audio signal processor configured to receive the second audio information and to process the second audio information in dependence on the object-related parametric information, to obtain a processed version of the second audio information; and an audio signal combiner configured to combine the first audio information with the processed version of the second audio information, to obtain the upmix signal representation; wherein the object separator is configured to obtain the first audio information and the second audio information according to $$X_{OBJ} = M_{OBJ}^{Energy}\begin{pmatrix} l_0 \\ r_0 \end{pmatrix}$$

$$X_{EAO} = A^{EAO} M_{EAO}^{Energy}\begin{pmatrix} l_0 \\ r_0 \end{pmatrix}$$

wherein $X_{OBJ}$ represent channels of the second audio information; wherein $X_{EAO}$ represent object signals of the first audio information; wherein $$M_{OBJ}^{Energy} = \begin{pmatrix} \sqrt{\dfrac{OLD_L}{OLD_L + \sum_{i=0}^{N_{EAO}-1} m_i^2 OLD_i}} & 0 \\ 0 & \sqrt{\dfrac{OLD_R}{OLD_R + \sum_{i=0}^{N_{EAO}-1} n_i^2 OLD_i}} \end{pmatrix}$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} & \sqrt{\dfrac{n_0^2 OLD_0}{OLD_R + \sum_{i=0}^{N_{EAO}-1} n_i^2 OLD_i}} \\ \vdots & \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} & \sqrt{\dfrac{n_{N_{EAO}-1}^2 OLD_{N_{EAO}-1}}{OLD_R + \sum_{i=0}^{N_{EAO}-1} n_i^2 OLD_i}} \end{pmatrix}$$

wherein $m_0$ to $m_{NEAO-1}$ are downmix values associated with the audio objects of the first audio object type; wherein $n_0$ to $n_{N_{EAO}-1}$ are downmix values associated with the audio objects of the first audio object type; wherein $OLD_i$ are object level difference values associated with the audio objects of the first audio object type; wherein $OLD_L$ and $OLD_R$ are common object level difference values associated with the audio objects of the second audio object type; and wherein $A^{EAO}$ is a EAO pre-rendering matrix.

According to another embodiment, an audio signal decoder for providing an upmix signal representation in dependence on a downmix signal representation, an object-related parametric information, may have: an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; an audio signal processor configured to receive the second audio information and to process the second audio information in dependence on the object-related parametric information, to obtain a processed version of the second audio information; and an audio signal combiner configured to combine the first audio information with the processed version of the second audio information, to obtain the upmix signal representation; wherein the object separator is configured to obtain the first audio information and the second audio information according to $$X_{OBJ} = M_{OBJ}^{Energy}(d_0)$$

$$X_{EAO} = A^{EAO} M_{EAO}^{Energy}(d_0)$$

wherein $X_{OBJ}$ represents a channel of the second audio information; wherein $X_{EAO}$ represent object signals of the first audio information; wherein $$M_{OBJ}^{Energy} = \left(\sqrt{\frac{OLD_L}{OLD_L + \sum_{i=0}^{N_{EAO}-1} m_i^2 OLD_i}}\right)$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} \\ \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} \end{pmatrix}$$

wherein $m_0$ to $m_{NEAO-1}$ are downmix values associated with the audio objects of the first audio object type; wherein $OLD_i$ are object level difference values associated with the audio objects of the first audio object type; wherein $OLD_L$ is a common object level difference value associated with the audio objects of the second audio object type; and wherein $A^{EAO}$ is a EAO pre-rendering matrix; wherein the matrices $M_{OBJ}^{Energy}$ and $M_{EAO}^{Energy}$ are applied to a representation $d_0$ of a single SAOC downmix signal.

According to another embodiment, a method for providing an upmix signal representation in dependence on a downmix signal representation and an object-related parametric information, may have the steps of decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; and processing the second audio information in dependence on the object-related parametric information, to obtain a processed version of the second audio information; and combining the first audio information with the processed version of the second audio information, to obtain the upmix signal representation; wherein the first audio information and the second audio information are obtained according to $$X_{OBJ} = M_{OBJ}^{Prediction}\begin{pmatrix} l_0 \\ r_0 \\ res_0 \\ \vdots \\ res_{N_{EAO}-1} \end{pmatrix}$$

-continued $$X_{EAO} = A^{EAO} M_{EAO}^{Prediction} \begin{pmatrix} l_0 \\ r_0 \\ \hline res_0 \\ \vdots \\ res_{N_{EAO}-1} \end{pmatrix}$$

wherein $M_{Prediction} = \tilde{D}^{-1}C$, wherein $$M^{Prediction} = \begin{pmatrix} M_{OBJ}^{Prediction} \\ \hline M_{EAO}^{Prediction} \end{pmatrix}$$

wherein $X_{OBJ}$ represent channels of the second audio information; wherein $X_{EAO}$ represent object signals of the first audio information; wherein $\tilde{D}^{-1}$ represents a matrix which is an inverse of an extended downmix matrix; wherein C describes a matrix representing a plurality of channel prediction coefficients, $\tilde{c}_{j,0}$, $\tilde{c}_{j,1}$; wherein $l_0$ and $r_0$ represent channels of the downmix signal representation; wherein $res_0$ to $res_{N_{EAO}-1}$ represent residual channels; and wherein $A^{EAO}$ is a EAO pre-rendering matrix, entries of which describe a mapping of enhanced audio objects to channels of an enhanced audio object signal $X_{EAO}$; wherein the inverse downmix matrix $\tilde{D}^{-1}$ is obtained as an inverse of an extended downmix matrix $\tilde{D}$ which is defined as $$\tilde{D} = \left(\begin{array}{cc|ccc} 1 & 0 & m_0 & \dots & m_{N_{EAO}-1} \\ 0 & 1 & n_0 & \dots & n_{N_{EAO}-1} \\ \hline m_0 & n_0 & -1 & \dots & 0 \\ \vdots & \vdots & 0 & \ddots & \vdots \\ m_{N_{EAO}-1} & n_{N_{EAO}-1} & 0 & \dots & -1 \end{array}\right)$$

wherein the matrix C is obtained as $$C = \left(\begin{array}{cc|ccc} 1 & 0 & 0 & \dots & 0 \\ 0 & 1 & 0 & \dots & 0 \\ \hline c_{0,0} & c_{0,1} & 1 & \dots & 0 \\ \vdots & \vdots & \vdots & \ddots & \vdots \\ c_{N_{EAO}-1,0} & c_{N_{EAO}-1,1} & 0 & \dots & 1 \end{array}\right)$$

wherein $m_0$ to $m_{N_{EAO}-1}$ are downmix values associated with the audio objects of the first audio object type; wherein $n_0$ to $n_{N_{EAO}-1}$ are downmix values associated with the audio objects of the first audio object type; wherein the prediction coefficients $\tilde{c}_{j,0}$ and $\tilde{c}_{j,1}$ are computed as $$\tilde{c}_{j,0} = \frac{P_{LoCo,j}P_{Ro} - P_{RoCo,j}P_{LoRo}}{P_{Lo}P_{Ro} - P_{LoRo}^2}$$

$$\tilde{c}_{j,1} = \frac{P_{RoCo,j}P_{Lo} - P_{LoCo,j}P_{LoRo}}{P_{Lo}P_{Ro} - P_{LoRo}^2}; \text{ and}$$

wherein constrained prediction coefficients $c_{j,0}$ and $c_{j,1}$ are derived from the prediction coefficients $\tilde{c}_{j,0}$ and $\tilde{c}_{j,1}$ using a constraining algorithm, or wherein the prediction coefficients $\tilde{c}_{j,0}$ and $\tilde{c}_{j,1}$ are used as the prediction coefficients $c_{j,0}$ and $c_{j,1}$; wherein energy quantities $P_{Lo}$, $P_{Ro}$, $P_{LoRo}$, $P_{LoCo,j}$ and $P_{RoCo,j}$ are defined as $$P_{Lo} = OLD_L + \sum_{j=0}^{N_{EAO}-1} \sum_{k=0}^{N_{EAO}-1} m_j m_k e_{j,k}$$

$$P_{Ro} = OLD_R + \sum_{j=0}^{N_{EAO}-1} \sum_{k=0}^{N_{EAO}-1} n_j n_k e_{j,k}$$

$$P_{LoRo} = e_{L,R} + \sum_{j=0}^{N_{EAO}-1} \sum_{k=0}^{N_{EAO}-1} m_j n_k e_{j,k}$$

$$P_{LoCo,j} = m_j OLD_L + n_j e_{L,R} - m_j OLD_j - \sum_{\substack{i=0 \\ i \neq j}}^{N_{EAO}-1} m_i e_{i,j}$$

$$P_{RoCo,j} = n_j OLD_R + m_j e_{L,R} - n_j OLD_j - \sum_{\substack{i=0 \\ i \neq j}}^{N_{EAO}-1} n_i e_{i,j}$$

wherein parameters $OLD_L$, $OLD_R$ and $IOC_{L,R}$ correspond to audio objects of the second audio object type and are defined according to $$OLD_L = \sum_{i=0}^{N-N_{EAO}-1} d_{0,i}^2 OLD_i,$$

$$OLD_R = \sum_{i=0}^{N-N_{EAO}-1} d_{1,i}^2 OLD_i,$$

$$IOC_{L,R} = \begin{cases} IOC_{0,1}, & N - N_{EAO} = 2, \\ 0, & \text{otherwise.} \end{cases}$$

wherein $d_{0,i}$ and $d_{1,i}$ are downmix values associated with the audio objects of the second audio object type; wherein $OLD_i$ are object level difference values associated with the audio objects of the second audio object type; wherein N is a total number of audio objects; wherein $N_{EAO}$ is a number of audio objects of the first audio object type; wherein $IOC_{0,1}$ is an inter-object-correlation value associated with a pair of audio objects of the second audio object type; wherein $e_{i,j}$ and $e_{L,R}$ are covariance values derived from object-level-difference parameters and inter-object-correlation parameters; and wherein $e_{i,j}$ are associated with a pair of audio objects of the 1st audio object type and $e_{L,R}$ is associated with a pair of audio objects of the second audio object type.

According to another embodiment, a method for providing an upmix signal representation in dependence on a downmix signal representation and an object-related parametric information may have the steps of decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; and processing the second audio information in dependence on the object-related parametric information, to obtain a processed version of the second audio information; and combining the first audio information with the processed version of the second audio information, to obtain the upmix signal representation; wherein the first audio information and the second audio information are obtained according to $$X_{OBJ} = M_{OBJ}^{Energy}\begin{pmatrix} l_0 \\ r_0 \end{pmatrix}$$

$$X_{EAO} = A^{EAO} M_{EAO}^{Energy}\begin{pmatrix} l_0 \\ r_0 \end{pmatrix}$$

wherein $X_{OBJ}$ represent channels of the second audio information; wherein $X_{EAO}$ represent object signals of the first audio information; wherein $$M_{OBJ}^{Energy} = \begin{pmatrix} \sqrt{\dfrac{OLD_L}{OLD_L + \sum_{i=0}^{N_{EAO}-1} m_i^2 OLD_i}} & 0 \\ 0 & \sqrt{\dfrac{OLD_R}{OLD_R + \sum_{i=0}^{N_{EAO}-1} n_i^2 OLD_i}} \end{pmatrix}$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} & \sqrt{\dfrac{n_0^2 OLD_0}{OLD_R + \sum_{i=0}^{N_{EAO}-1} n_i^2 OLD_i}} \\ \vdots & \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} & \sqrt{\dfrac{n_{N_{EAO}-1}^2 OLD_{N_{EAO}-1}}{OLD_R + \sum_{i=0}^{N_{EAO}-1} n_i^2 OLD_i}} \end{pmatrix}$$

wherein $m_0$ to $m_{NEAO-1}$ are downmix values associated with the audio objects of the first audio object type; wherein $n_0$ to $n_{N_{EAO}-1}$ are downmix values associated with the audio objects of the first audio object type; wherein $OLD_i$ are object level difference values associated with the audio objects of the first audio object type; wherein $OLD_L$ and $OLD_R$ are common object level difference values associated with the audio objects of the second audio object type; and wherein $A^{EAO}$ is a EAO pre-rendering matrix.

According to another embodiment, a method for providing an upmix signal representation in dependence on a downmix signal representation and an object-related parametric information may have the steps of: decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; and processing the second audio information in dependence on the object-related parametric information, to obtain a processed version of the second audio information; and combining the first audio information with the processed version of the second audio information, to obtain the upmix signal representation; wherein the first audio information and the second audio information are obtained according to $$X_{OBJ}=M_{OBJ}^{Energy}(d_0)$$

$$X_{EAO}=A^{EAO}M_{EAO}^{Energy}(d_0)$$

wherein $X_{OBJ}$ represents a channel of the second audio information; wherein $X_{EAO}$ represent object signals of the first audio information; wherein $$M_{OBJ}^{Energy} = \left(\sqrt{\frac{OLD_L}{OLD_L + \sum_{i=0}^{N_{EAO}-1} m_i^2 OLD_i}}\right)$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} \\ \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} \end{pmatrix}$$

wherein $m_0$ to $m_{NEAO-1}$ are downmix values associated with the audio objects of the first audio object type; wherein $OLD_i$ are object level difference values associated with the audio objects of the first audio object type; wherein $OLD_L$ is a common object level difference value associated with the audio objects of the second audio object type; and wherein $A^{EAO}$ is a EAO pre-rendering matrix; wherein the matrices $M_{OBJ}^{Energy}$ and $M_{EAO}^{Energy}$ are applied to a representation $d_0$ of a single SAOC downmix signal.

Another embodiment may have a computer program for performing the inventive methods when the computer program runs on a computer.

An embodiment according to the invention creates an audio signal decoder for providing an upmix signal representation in dependence on a downmix signal representation and an object-related parametric information. The audio signal decoder comprises an object separator configured to decompose the downmix signal representation, to provide a first audio information describing a first set of one or more audio objects of a first audio object type and a second audio information describing a second set of one or more audio objects of a second audio object type in dependence on the downmix signal representation and using at least a part of the object-related parametric information. The audio signal decoder also comprises an audio signal processor configured to receive the second audio information and to process the second audio information in dependence on the object-related parametric information, to obtain a processed version of the second audio information. The audio signal decoder also comprises an audio signal combiner configured to combine the first audio information with the processed version of the second audio information to obtain the upmix signal representation.

It is a key idea of the present invention that an efficient processing of different types of audio objects can be obtained in a cascaded structure, which allows for a separation of the different types of audio objects using at least a part of the object-related parametric information in a first processing step performed by the object separator, and which allows for an additional spatial processing in a second processing step performed in dependence on at least a part of the object-related parametric information by the audio signal processor. It has been found that extracting a second audio information, which comprises audio objects of the second audio object type, from a downmix signal representation can be performed with a moderate complexity even if there is a larger number of audio objects of the second audio object type. In addition, it has been found that a spatial processing of the audio objects of the second audio type can be performed efficiently once the second audio information is separated from the first audio information describing the audio objects of the first audio object type.

Additionally, it has been found that the processing algorithm performed by the object separator for separating the first audio information and the second audio information can be performed with comparatively small complexity if the object-individual processing of the audio objects of the second audio object type is postponed to the audio signal processor and not performed at the same time as the separation of the first audio information and the second audio information.

In an embodiment, the audio signal decoder is configured to provide the upmix signal representation in dependence on the downmix signal representation, the object-related parametric information and a residual information associated to a sub-set of audio objects represented by the downmix signal representation. In this case, the object separator is configured to decompose the downmix signal representation to provide the first audio information describing the first set of one or more audio objects (for example, foreground objects FGO) of the first audio object type to which residual information is associated and the second audio information describing the second set of one or more audio objects (for example, background objects BGO) of the second audio object type to which no residual information is associated in dependence on the downmix signal representation and using at least part of the object-related parametric information and the residual information.

This embodiment is based on the finding that a particularly accurate separation between the first audio information describing the first set of audio objects of the first audio object type and the second audio information describing the second set of audio objects of the second audio object type can be obtained by using a residual information in addition to the object-related parametric information. It has been found that the mere use of the object-related parametric information would result in distortions in many cases, which can be reduced significantly or even entirely eliminated by the use of residual information. The residual information describes, for example, a residual distortion, which is expected to remain if an audio object of the first audio object type is isolated merely using the object-related parametric information. The residual information is typically estimated by an audio signal encoder. By applying the residual information, the separation between the audio objects of the first audio object type and the audio objects of the second audio object type can be improved.

This allows to obtain the first audio information and the second audio information with particularly good separation between the audio objects of the first audio object type and the audio objects of the second audio object type, which, in turn, allows to achieve a high-quality spatial processing of the audio objects of the second audio object type when processing the second audio information in the audio signal processor.

In an embodiment, the object separator is therefore configured to provide the first audio information such that audio objects of the first audio object type are emphasized over audio objects of the second audio object type in the first audio information. The object separator is also configured to provide the second audio information such that audio objects of the second audio object type are emphasized over audio objects of the first audio object type in the second audio information.

In an embodiment, the audio signal decoder is configured to perform a two-step processing, such that a processing of the second audio information in the audio signal processor is performed subsequently to a separation between the first audio information describing the first set of one or more audio objects of the first audio object type and the second audio information describing the second set of one or more audio objects of the second audio object type.

In an embodiment, the audio signal processor is configured to process the second audio information in dependence on the object-related parametric information associated with the audio objects of the second audio object type and independent from the object-related parametric information associated with the audio objects of the first audio object type. Accordingly, a separate processing of the audio objects of the first audio object type and the audio objects of the second audio object type can be obtained.

In an embodiment, the object separator is configured to obtain the first audio information and the second audio information using a linear combination of one or more downmix channels and one or more residual channels. In this case, the object separator is configured to obtain combination parameters for performing the linear combination in dependence on downmix parameters associated with the audio objects of the first audio object type and in dependence on channel prediction coefficients of the audio objects of the first audio object type. The computation of the channel prediction coefficients of the audio objects of the first audio object type may, for example, take into consideration the audio objects of the second audio object type as a single, common audio object. Accordingly, a separation process can be performed with sufficiently small computational complexity, which may, for example, be almost independent from the number of audio objects of the second audio object type.

In an embodiment, the object separator is configured to apply a rendering matrix to the first audio information to map object signals of the first audio information onto audio channels of the upmix audio signal representation. This can be done, because the object separator may be capable of extracting separate audio signals individually representing the audio objects of the first audio object type. Accordingly, it is possible to map the object signals of the first audio information directly onto the audio channels of the upmix audio signal representation.

In an embodiment, the audio processor is configured to perform a stereo processing of the second audio information in dependence on a rendering information, an object-related covariance information and a downmix information, to obtain audio channels of the upmix audio signal representation.

Accordingly, the stereo processing of the audio objects of the second audio object type is separated from the separation between the audio objects of the first audio object type and the audio objects of the second audio object type. Thus, the efficient separation between audio objects of the first audio object type and audio objects of the second audio object type is not affected (or degraded) by the stereo processing, which typically leads to a distribution of audio objects over a plurality of audio channels without providing the high degree of object separation, which can be obtained in the object separator, for example, using the residual information.

In another embodiment, the audio processor is configured to perform a post-processing of the second audio information in dependence on a rendering information, an object-related covariance information and a downmix information. This form of post-processing allows for a spatial placement of the audio objects of the second audio object type within an audio scene. Nevertheless, due to the cascaded concept, the computational complexity of the audio processor can be kept sufficiently small, because the audio processor does not need to consider the object-related parametric information associated with the audio objects of the first audio object type.

In addition, different types of processing can be performed by the audio processor, like, for example, a mono-to-binaural processing, a mono-to-stereo processing, a stereo-to-binaural processing or a stereo-to-stereo processing.

In an embodiment, the object separator is configured to treat audio objects of the second audio object type, to which no residual information is associated, as a single audio object. In addition, the audio signal processor is configured to consider object-specific rendering parameters to adjust contributions of the objects of the second audio object type to the upmix signal representation. Thus, the audio objects of the second audio object type are considered as a single audio object by the object separator, which significantly reduces the complexity of the object separator and also allows to have a unique residual information, which is independent from the rendering parameters associated with the audio objects of the second audio object type.

In an embodiment, the object separator is configured to obtain a common object-level difference value for a plurality of audio objects of the second audio object type. The object separator is configured to use the common object-level difference value for a computation of channel prediction coefficients. In addition, the object separator is configured to use the channel prediction coefficients to obtain one or two audio channels representing the second audio information. For obtaining a common object-level difference value, the audio objects of the second audio object type can be handled efficiently as a single audio object by the object separator.

In an embodiment, the object separator is configured to obtain a common object level difference value for a plurality of audio objects of the second audio object type and the object separator is configured to use the common object-level difference value for a computation of entries of an energy-mode mapping matrix. The object separator is configured to use the energy-mode mapping matrix to obtain the one or more audio channels representing the second audio information. Again, the common object level difference value allows for a computationally efficient common treating of the audio objects of the second audio object type by the object separator.

In an embodiment, the object separator is configured to selectively obtain a common inter-object correlation value associated to the audio objects of the second audio object type in dependence on the object-related parametric information if it is found that there are two audio objects of the second audio object type and to set the inter-object correlation value associated to the audio objects of the second audio object type to zero if it is found that there are more or less than two audio objects of the second audio object type. The object separator is configured to use the common inter-object correlation value associated to the audio objects of the second audio object type to obtain the one or more audio channels representing the second audio information. Using this approach, the inter-object correlation value is exploited if it is obtainable with high computational efficiency, i.e. if there are two audio objects of the second audio object type. Otherwise, it would be computationally demanding to obtain inter-object correlation values. Accordingly, it has been found to be a good compromise in terms of hearing impression and computational complexity to set the inter-object correlation value associated to the audio objects of the second audio object type to zero if there are more or less than two audio objects of the second object type.

In an embodiment, the audio signal processor is configured to render the second audio information in dependence on (at least a part of) the object-related parametric information, to obtain a rendered representation of the audio objects of the second audio object type as a processed version of the second audio information. In this case, the rendering can be made independent from the audio objects of the first audio object type.

In an embodiment, the object separator is configured to provide the second audio information such that the second audio information describes more than two audio objects of the second audio object type. Embodiments according to the invention allow for a flexible adjustment of the number of audio objects of the second audio object type, which is significantly facilitated by the cascaded structure of the processing.

In an embodiment, the object separator is configured to obtain, as the second audio information, a one-channel audio signal representation or a two-channel audio signal representation representing more than two audio objects of the second audio object type. Extracting one or two audio signal channels can be performed by the object separator with low computational complexity. In particular, the complexity of the object separator can be kept significantly smaller when compared to a case in which the object separator would need to deal with more than two audio objects of the second audio object type. Nevertheless, it has been found that it is a computationally efficient representation of the audio objects of the second audio object type to use one or two channels of an audio signal.

In an embodiment, the audio signal processor is configured to receive the second audio information and to process the second audio information in dependence on (at least a part of) the object-related parametric information, taking into consideration object-related parametric information associated with more than two audio objects of the second audio object type. Accordingly, an object-individual processing is performed by the audio processor, while such an object-individual processing is not performed for audio objects of the second audio object type by the object separator.

In an embodiment, the audio decoder is configured to extract a total object number information and a foreground object number information from a configuration information related to the object-related parametric information. The audio decoder is also configured to determine a number of audio objects of the second audio object type by forming a difference between the total object number information and the foreground object number information. Accordingly, efficient signalling of the number of audio objects of the second audio object type is achieved. In addition, this concept provides for a high degree of flexibility regarding the number of audio objects of the second audio object type.

In an embodiment, the object separator is configured to use object-related parametric information associated with $N_{eao}$ audio objects of the first audio object type to obtain, as the first audio information, $N_{eao}$, audio signals representing (advantageously, individually) the $N_{eao}$ audio objects of the first audio object type, and to obtain, as the second audio information, one or two audio signals representing the $N-N_{eao}$ audio objects of the second audio object type, treating the $N-N_{eao}$ audio objects of the second audio object type as a single one-channel or two-channel audio object. The audio signal processor is configured to individually render the $N-N_{eao}$ audio objects represented by the one or two audio signals of the second audio information using the object-related parametric information associated with the $N-N_{eao}$ audio objects of the second audio object type. Accordingly, the audio object separation between the audio objects of the first audio object type and the audio objects of the second audio object type is separated from the subsequent processing of the audio objects of the second audio object type.

An embodiment according to the invention creates a method for providing an upmix signal representation in dependence on a downmix signal representation and an object-related parametric information.

Another embodiment according to the invention creates a computer program for performing said method.

BRIEF DESCRIPTION OF THE DRAWINGS

Embodiments of the present invention will be detailed subsequently referring to the appended drawings, in which:

FIG. 6*a* shows a Table representing a listening test design description;

FIG. 6*b* shows a Table representing systems under test;

FIG. 6*c* shows a Table representing the listening test items and rendering matrices;

DETAILED DESCRIPTION OF THE INVENTION

1. Audio Signal Decoder According to FIG. 1

Figure 1:
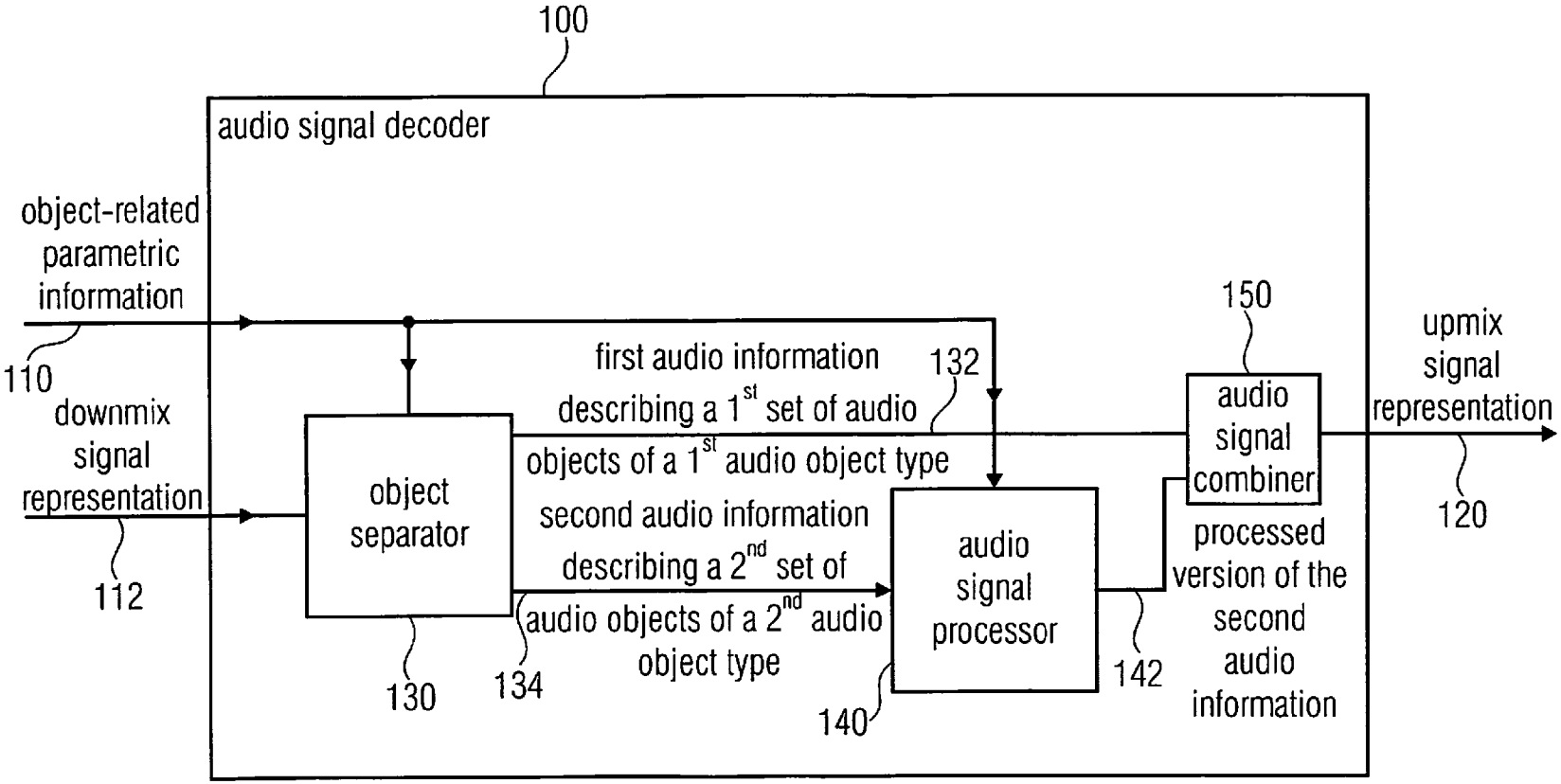
FIG. 1 shows a block schematic diagram of an audio signal decoder, according to an embodiment of the invention.

FIG. 1 shows a block schematic diagram of an audio signal decoder 100 according to an embodiment of the invention.

The audio signal decoder 100 is configured to receive an object-related parametric information 110 and a downmix signal representation 112. The audio signal decoder 100 is configured to provide an upmix signal representation 120 in dependence on the downmix signal representation and the object-related parametric information 110. The audio signal decoder 100 comprises an object separator 130, which is configured to decompose the downmix signal representation 112 to provide a first audio information 132 describing a first set of one or more audio objects of a first audio object type and a second audio information 134 describing a second set of one or more audio objects of a second audio object type in dependence on the downmix signal representation 112 and using at least a part of the object-related parametric information 110. The audio signal decoder 100 also comprises an audio signal processor 140, which is configured to receive the second audio information 134 and to process the second audio information in dependence on at least a part of the object-related parametric information 112, to obtain a processed version 142 of the second audio information 134. The audio signal decoder 100 also comprises an audio signal combiner 150 configured to combine the first audio information 132 with the processed version 142 of the second audio information 134, to obtain the upmix signal representation 120.

The audio signal decoder 100 implements a cascaded processing of the downmix signal representation, which represents audio objects of the first audio object type and audio objects of the second audio object type in a combined manner.

In a first processing step, which is performed by the object separator 130, the second audio information describing a second set of audio objects of the second audio object type is separated from the first audio information 132 describing a first set of audio objects of a first audio object type using the object-related parametric information 110. However, the second audio information 134 is typically an audio information (for example, a one-channel audio signal or a two-channel audio signal) describing the audio objects of the second audio object type in a combined manner.

In the second processing step, the audio signal processor 140 processes the second audio information 134 in dependence on the object-related parametric information. Accordingly, the audio signal processor 140 is capable of performing an object-individual processing or rendering of the audio objects of the second audio object type, which are described by the second audio information 134, and which is typically not performed by the object separator 130.

Thus, while the audio objects of the second audio object type are not processed in an object-individual manner by the object separator 130, the audio objects of the second audio object type are, indeed, processed in an object-individual manner (for example, rendered in an object-individual manner) in the second processing step, which is performed by the audio signal processor 140. Thus, the separation between the audio objects of the first audio object type and the audio objects of the second audio object type, which is performed by the object separator 130, is separated from the object-individual processing of the audio objects of the second audio object type, which is performed afterwards by the audio signal processor 140. Accordingly, the processing which is performed by the object separator 130 is substantially independent from a number of audio objects of the second audio object type. In addition, the format (for example, one-channel audio signal or the two-channel audio signal) of the second audio information 134 is typically independent from the number of audio objects of the second audio object type. Thus, the number of audio objects of the second audio object type can be varied without having the need to modify the structure of the object separator 130. In other words, the audio objects of the second audio object type are treated as a single (for example, one-channel or two-channel) audio object for which a common object-related parametric information (for example, a common object-level-difference value associated with one or two audio channels) is obtained by the object separator 140.

Accordingly, the audio signal decoder 100 according to FIG. 1 is capable to handle a variable number of audio objects of the second audio object type without a structural modification of the object separator 130. In addition, different audio object processing algorithms can be applied by the object separator 130 and the audio signal processor 140. Accordingly, for example, it is possible to perform an audio object separation using a residual information by the object separator 130, which allows for a particularly good separation of different audio objects, making use of the residual information, which constitutes a side information for improving the quality of an object separation. In contrast, the audio signal processor 140 may perform an object-individual processing without using a residual information. For example, the audio signal processor 140 may be configured to perform a conventional spatial-audio-object-coding (SAOC) type audio signal processing to render the different audio objects.

2. Audio Signal Decoder According to FIG. 2

In the following, an audio signal decoder 200 according to an embodiment of the invention will be described. A block-schematic diagram of this audio signal decoder 200 shown in FIG. 2.

The audio decoder 200 is configured to receive a downmix signal 210, a so-called SAOC bitstream 212, rendering matrix information 214 and, optionally, head-related-transfer-function (HRTF) parameters 216. The audio signal decoder 200 is also configured to provide an output/MPS downmix signal 220 and (optionally) a MPS bitstream 222.

2.1. Input Signals and Output Signals of the Audio Signal Decoder 200

In the following, various details regarding input signals and output signals of the audio decoder 200 will be described.

The downmix signal 200 may, for example, be a one-channel audio signal or a two-channel audio signal. The downmix signal 210 may, for example, be derived from an encoded representation of the downmix signal.

The spatial-audio-object-coding bitstream (SAOC bitstream) 212 may, for example, comprise object-related parametric information. For example, the SAOC bitstream 212 may comprise object-level-difference information, for example, in the form of object-level-difference parameters OLD, an inter-object-correlation information, for example, in the form of inter-object-correlation parameters IOC.

In addition, the SAOC bitstream 212 may comprise a downmix information describing how the downmix signals have been provided on the basis of a plurality of audio object signals using a downmix process. For example, the SAOC bitstream may comprise a downmix gain parameter DMG and (optionally) downmix-channel-level difference parameters DCLD.

The rendering matrix information 214 may, for example, describe how the different audio objects should be rendered by the audio decoder. For example, the rendering matrix information 214 may describe an allocation of an audio object to one or more channels of the output/MPS downmix signal 220.

The optional head-related-transfer-function (HRTF) parameter information 216 may further describe a transfer function for deriving a binaural headphone signal.

The output/MPEG-Surround downmix signal (also briefly designated with "output/MPS downmix signal") 220 represents one or more audio channels, for example, in the form of a time domain audio signal representation or a frequency-domain audio signal representation. Alone or in combination with the optional MPEG-Surround bitstream (MPS bitstream) 222, which comprises MPEG-Surround parameters describing a mapping of the output/MPS downmix signal 220 onto a plurality of audio channels, an upmix signal representation is formed.

2.2. Structure and Functionality of the Audio Signal Decoder 200

In the following, the structure of the audio signal decoder 200, which may fulfill the functionality of an SAOC transcoder or the functionality of a SAOC decoder, will be described in more detail.

The audio signal decoder 200 comprises a downmix processor 230, which is configured to receive the downmix signal 210 and to provide, on the basis thereof, the output/MPS downmix signal 220. The downmix processor 230 is also configured to receive at least a part of the SAOC bitstream information 212 and at least a part of the rendering matrix information 214. In addition, the downmix processor 230 may also receive a processed SAOC parameter information 240 from a parameter processor 250.

The parameter processor 250 is configured to receive the SAOC bitstream information 212, the rendering matrix information 214 and, optionally, the head-related-transfer-function parameter information 260, and to provide, on the basis thereof, the MPEG Surround bitstream 222 carrying the MPEG surround parameters (if the MPEG surround parameters are necessitated, which is, for example, true in the transcoding mode of operation). In addition, the parameter processor 250 provides the processed SAOC information 240 (if this processed SAOC information is necessitated).

In the following, the structure and functionality of the downmix processor 230 will be described in more detail.

The downmix processor 230 comprises a residual processor 260, which is configured to receive the downmix signal 210 and to provide, on the basis thereof, a first audio object signal 262 describing so-called enhanced audio objects (EAOs), which may be considered as audio objects of a first audio object type. The first audio object signal may comprise one or more audio channels and may be considered as a first audio information. The residual processor 260 is also configured to provide a second audio object signal 264, which describes audio objects of a second audio object type and may be considered as a second audio information. The second audio object signal 264 may comprise one or more channels and may typically comprise one or two audio channels describing a plurality of audio objects. Typically, the second audio object signal may describe even more than two audio objects of the second audio object type.

The downmix processor 230 also comprises an SAOC downmix pre-processor 270, which is configured to receive the second audio object signal 264 and to provide, on the basis thereof, a processed version 272 of the second audio object signal 264, which may be considered as a processed version of the second audio information.

The downmix processor 230 also comprises an audio signal combiner 280, which is configured to receive the first audio object signal 262 and the processed version 272 of the second audio object signal 264, and to provide, on the basis thereof, the output/MPS downmix signal 220, which may be considered, alone or together with the (optional) corresponding MPEG-Surround bitstream 222, as an upmix signal representation.

In the following, the functionality of the individual units of the downmix processor 230 will be discussed in more detail.

The residual processor 260 is configured to separately provide the first audio object signal 262 and the second audio object signal 264. For this purpose, the residual processor 260 may be configured to apply at least a part of the SAOC bitstream information 212. For example, the residual processor 260 may be configured to evaluate an object-related parametric information associated with the audio objects of the first audio object type, i.e. the so-called "enhanced audio objects" EAO. In addition, the residual processor 260 may be configured to obtain an overall information describing the audio objects of the second audio object type, for example, the so-called "non-enhanced audio objects", commonly. The residual processor 260 may also be configured to evaluate a residual information, which is provided in the SAOC bitstream information 212, for a separation between enhanced audio objects (audio objects of the first audio object type) and non-enhanced audio objects (audio objects of the second audio object type). The residual information may, for example, encode a time domain residual signal, which is applied to obtain a particularly clean separation between the enhanced audio objects and the non-enhanced audio objects. In addition, the residual processor 260 may, optionally, evaluate at least a part of the rendering matrix information 214, for example, in order to determine a distribution of the enhanced audio objects to the audio channels of the first audio object signal 262.

The SAOC downmix pre-processor 270 comprises a channel re-distributor 274, which is configured to receive the one or more audio channels of the second audio object signal 264 and to provide, on the basis thereof, one or more (typically two) audio channels of the processed second audio object signal 272. In addition, the SAOC downmix pre-processor 270 comprises a decorrelated-signal-provider 276, which is configured to receive the one or more audio channels of the second audio object signal 264 and to provide, on the basis thereof, one or more decorrelated signals 278*a*, 278*b*, which are added to the signals provided by the channel re-distributor 274 in order to obtain the processed version 272 of the second audio object signal 264.

Further details regarding the SAOC downmix processor will be discussed below.

The audio signal combiner 280 combines the first audio object signal 262 with the processed version 272 of the second audio object signal. For this purpose, a channel-wise combination may be performed. Accordingly, the output/MPS downmix signal 220 is obtained.

The parameter processor 250 is configured to obtain the (optional) MPEG-Surround parameters, which make up the MPEG-Surround bitstream 222 of the upmix signal representation, on the basis of the SAOC bitstream, taking onto consideration the rendering matrix information 214 and, optionally, the HRTF parameter information 216. In other words, the SAOC parameter processor 252 is configured to translate the object-related parameter information, which is described by the SAOC bitstream information 212, into a channel-related parametric information, which is described by the MPEG Surround bit stream 222.

In the following, a short overview of the structure of the SAOC transcoder/decoder architecture shown in FIG. 2 will be given. Spatial audio object coding (SAOC) is a parametric multiple object coding technique. It is designed to transmit a number of audio objects in an audio signal (for example the downmix audio signal 210) that comprises M channels. Together with this backward compatible downmix signal, object parameters are transmitted (for example, using the SAOC bitstream information 212) that allow for recreation and manipulation of the original object signals. An SAOC encoder (not shown here) produces a downmix of the object signals at its input and extracts these object parameters. The number of objects that can be handled is in principle not limited. The object parameters are quantized and coded efficiently into the SAOC bitstream 212. The downmix signal 210 can be compressed and transmitted without the need to update existing coders and infrastructures. The object parameters, or SAOC side information, are transmitted in a low bit rate side channel, for example, the ancillary data portion of the downmix bitstream.

On the decoder side, the input objects are reconstructed and rendered to a certain number of playback channels. The rendering information containing reproduction level and panning position for each object is user-supplied or can be extracted from the SAOC bitstream (for example, as a preset information). The rendering information can be time-variant. Output scenarios can range from mono to multi-channel (for example, 5.1) and are independent from both, the number of input objects and the number of downmix channels. Binaural rendering of objects is possible including azimuth and elevation of virtual object positions. An optional effect interface allows for advanced manipulation of object signals, besides level and panning modification.

The objects themselves can be mono signals, stereophonic signals, as well as a multi-channel signals (for example 5.1 channels). Typical downmix configurations are mono and stereo.

Figure 2:
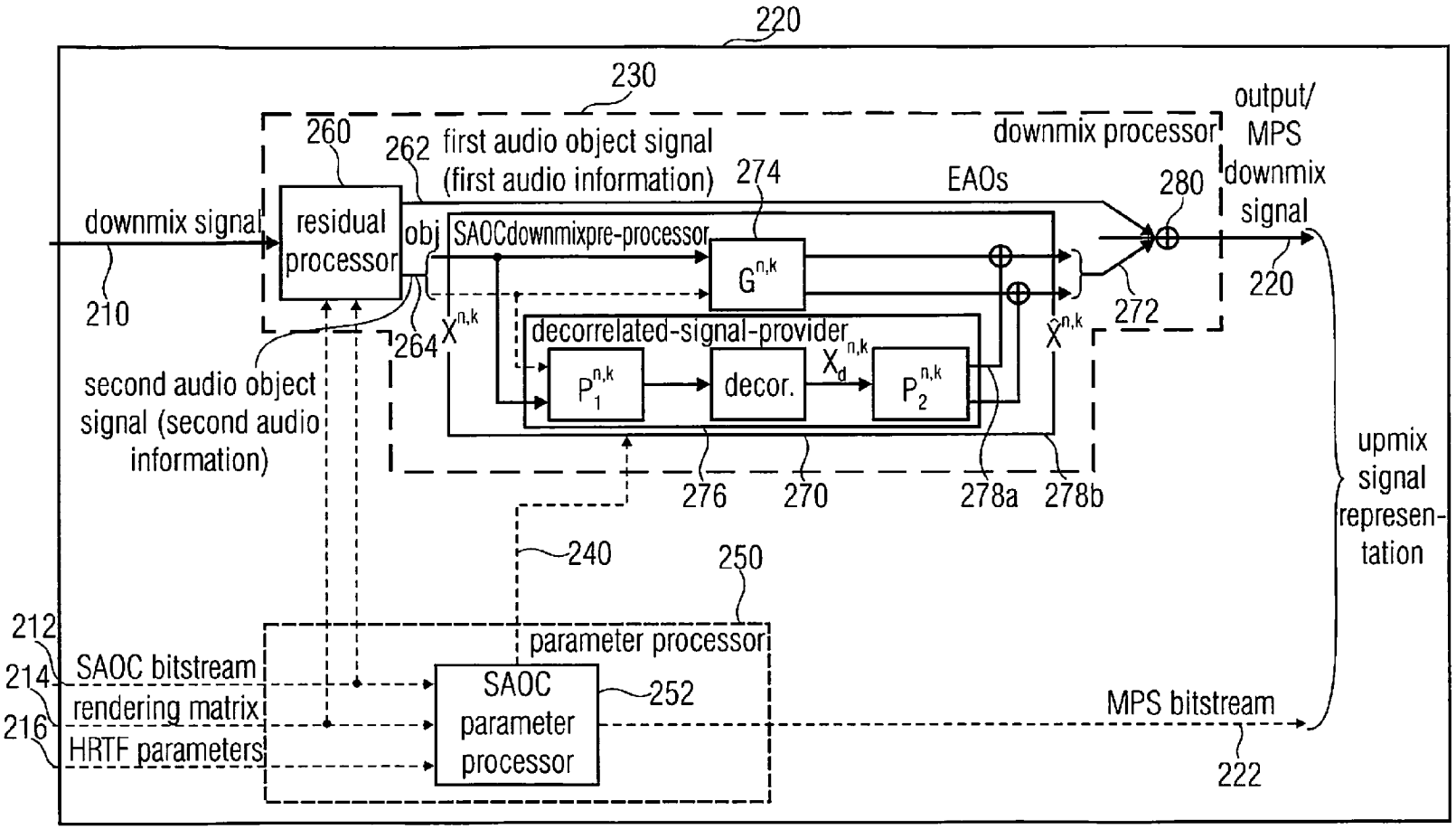
FIG. 2 shows a block schematic diagram of another audio signal decoder, according to an embodiment of the invention.

In the following, the basic structure of the SAOC transcoder/decoder, which is shown in FIG. 2, will be explained. The SAOC transcoder/decoder module described herein may act either as a stand-alone decoder or as a transcoder from an SAOC to an MPEG-surround bitstream, depending on the intended output channel configuration. In a first mode of operation, the output signal configuration is mono, stereo or binaural, and two output channels are used. In this first case, the SAOC module may operate in a decoder mode, and the SAOC module output is a pulse-code-modulated output (PCM output). In the first case, an MPEG surround decoder is not necessitated. Rather, the upmix signal representation may only comprise the output signal 220, while the provision of the MPEG surround bit stream 222 may be omitted. In a second case, the output signal configuration is a multi-channel configuration with more than two output channels. The SAOC module may be operational in a transcoder mode. The SAOC module output may comprise both a downmix signal 220 and an MPEG surround bit stream 222 in this case, as shown in FIG. 2. Accordingly, an MPEG surround decoder is necessitated in order to obtain a final audio signal representation for output by the speakers.

FIG. 2 shows the basic structure of the SAOC transcoder/decoder architecture. The residual processor 216 extracts the enhanced audio object from the incoming downmix signal 210 using the residual information contained in the SAOC bit stream 212. The downmix preprocessor 270 processes the regular audio objects (which are, for example, non-enhanced audio objects, i.e., audio objects for which no residual information is transmitted in the SAOC bit stream 212). The enhanced audio objects (represented by the first audio object signal 262) and the processed regular audio objects (represented, for example, by the processed version 272 of the second audio object signal 264) are combined to the output signal 220 for the SAOC decoder mode or to the MPEG surround downmix signal 220 for the SAOC transcoder mode. Detailed descriptions of the processing blocks are given below.

Figure 3A:
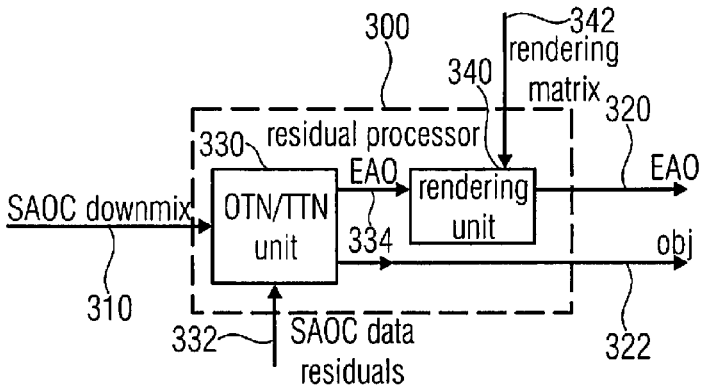
FIGS. 3*a* and 3*b* show a block schematic diagrams of a residual processor, which can be used as an object separator in an embodiment of the invention.
Figure 3B:
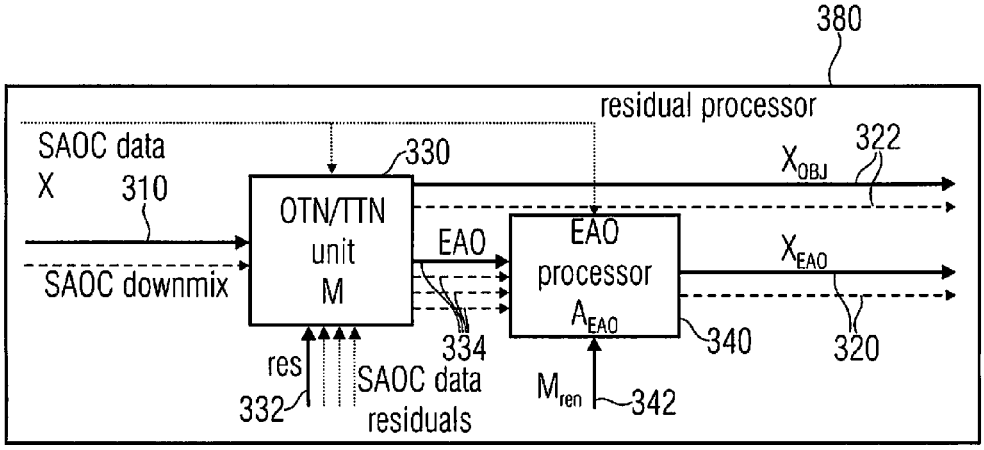

3. Architecture and Functionality of Residual Processor and Energy Mode Processor In the following, details regarding a residual processor will be described, which may, for example, take over the functionality of the object separator 130 of the audio signal decoder 100 or of the residual processor 260 of the audio signal decoder 200. For this purpose, FIGS. 3*a* and 3*b* show block schematic diagrams of such a residual processor 300, which may take the place of the object separator 130 or of the residual processor 260. FIG. 3*a* shows less details than FIG. 3*b*. However, the following description applies to the residual processor 300 according to FIG. 3*a* and also to the residual processor 380 according to FIG. 3*b*.

The residual processor 300 is configured to receive an SAOC downmix signal 310, which may be equivalent to the downmix signal representation 112 of FIG. 1 or the downmix signal representation 210 of FIG. 2. The residual processor 300 is configured to provide, on the basis thereof, a first audio information 320 describing one or more enhanced audio objects, which may, for example, be equivalent to the first audio information 132 or to the first audio object signal 262. Also, the residual processor 300 may provide a second audio information 322 describing one or more other audio objects (for example, non-enhanced audio objects, for which no residual information is available), wherein the second audio information 322 may be equivalent to the second audio information 134 or to the second audio object signal 264.

The residual processor 300 comprises a 1-to-N/2-to-N unit (OTN/TTN unit) 330, which receives the SAOC downmix signal 310 and which also receives SAOC data and residuals 332. The 1-to-N/2-to-N unit 330 also provides an enhanced-audio-object signal 334, which describes the enhanced audio objects (EAO) contained in the SAOC downmix signal 310.

Also, the 1-to-N/2-to-N unit 330 provides the second audio information 322. The residual processor 300 also comprises a rendering unit 340, which receives the enhanced-audio-object signal 334 and a rendering matrix information 342 and provides, on the basis thereof, the first audio information 320.

In the following, the enhanced audio object processing (EAO processing), which is performed by the residual processor 300, will be described in more detail.

3.1. Introduction into the Operation of the Residual Processor 300

Regarding the functionality of the residual processor 300, it should be noted that the SAOC technology allows for the individual manipulation of a number of audio objects in terms of their level amplification/attenuation without significant decrease in the resulting sound quality only in a very limited way. A special "karaoke-type" application scenario necessitates a total (or almost total) suppression of the specific objects, typically the lead vocal, keeping the perceptional quality of the background sound scene unharmed.

A typical application case contains up to four enhanced audio objects (EAO) signals, which can, for example, represent two independent stereo objects (for example, two independent stereo objects which are prepared to be removed at the side of the decoder).

It should be noted that the (one or more) quality enhanced audio objects (or, more precisely, the audio signal contributions associated with the enhanced audio objects) are included in the SAOC downmix signal 310. Typically, the audio signal contributions associated with the (one or more) enhanced audio objects are mixed, by the downmix processing performed by the audio signal encoder, with audio signal contributions of other audio objects, which are not enhanced audio objects. Also, it should be noted that audio signal contributions of a plurality of enhanced audio objects are also typically overlapped or mixed by the downmix processing performed by the audio signal encoder.

3.2 SOAC Architecture Supporting Enhanced Audio Objects

In the following, details regarding the residual processor 300 will be described. Enhanced audio object processing incorporates the 1-to-N or 2-to-N units, depending on the SAOC downmix mode. The 1-to-N processing unit is dedicated to a mono downmix signal and the 2-to-N processing unit is dedicated to a stereo downmix signal 310. Both these units represent a generalized and enhanced modification of the 2-to-2 box (TTT box) known from ISO/IEC 23003-1: 2007. In the encoder, regular and EAO signals are combined into the downmix. The $OTN^{-1}/TTN^{-1}$ processing units (which are inverse one-to-N processing units or inverse 2-to-N processing units) are employed to produce and encode the corresponding residual signals.

The EAO and regular signals are recovered from the downmix 310 by the OTN/TTN units 330 using the SAOC side information and incorporated residual signals. The recovered EAOs (which are described by the enhanced audio object signal 334) are fed into the rendering unit 340 which represents (or provides) the product of the corresponding rendering matrix (described by the rendering matrix information 342) and the resulting output of the OTN/TTN unit. The regular audio objects (which are described by the second audio information 322) are delivered to the SAOC downmix pre-processor, for example, the SAOC downmix preprocessor 270, for further processing. FIGS. 3*a* and 3*b* depict the general structure of the residual processor, i.e., the architecture of the residual processor.

The residual processor output signals 320,322 are computed as $$X_{OBJ}=M_{OBJ}X_{res},$$

$$X_{EAO}=A_{EAO}M_{EAO}X_{res},$$

where $X_{OBJ}$ represents the downmix signal of the regular audio objects (i.e. non-EAOs) and $X_{EAO}$ is the rendered EAO output signal for the SAOC decoding mode or the corresponding EAO downmix signal for the SAOC transcoding mode.

The residual processor can operate in prediction (using residual information) mode or energy (without residual information) mode. The extended input signal $X_{res}$ is defined accordingly:

$$X_{res} = \begin{cases} \left(\frac{X}{res}\right), & \text{for pediction mode,} \\ X, & \text{for energy mode.} \end{cases}$$

Here, X may, for example, represent the one or more channels of the downmix signal representation 310, which may be transported in the bitstream representing the multi-channel audio content. res may designate one or more residual signals, which may be described by the bitstream representing the multi-channel audio content.

The OTN/TTN processing is represented by matrix M and EAO processor by matrix $A_{EAO}$.

The OTN/TTN processing matrix M is defined according to the EAO operation mode (i.e. prediction or energy) as $$M = \begin{cases} M_{Prediction}, & \text{for pediction mode,} \\ M_{Energy}, & \text{for energy mode.} \end{cases}$$

The OTN/TTN processing matrix M is represented as $$M = \left(\frac{M_{OBJ}}{M_{EAO}}\right),$$

where the matrix $M_{OBJ}$ relates to the regular audio objects (i.e. non-EAOs) and $M_{EAO}$ to the enhanced audio objects (EAOs).

In some embodiments, one or more multichannel background objects (MBO) may be treated the same way by the residual processor 300.

A Multi-channel Background Object (MBO) is an MPS mono or stereo downmix that is part of the SAOC downmix. As opposed to using individual SAOC objects for each channel in a multi-channel signal, an MBO can be used enabling SAOC to more efficiently handle a multi-channel object. In the MBO case, the SAOC overhead gets lower as the MBO's SAOC parameters only are related to the downmix channels rather than all the upmix channels.

3.3 Further Definitions 3.3.1 Dimensionality of Signals and Parameters

In the following, the dimensionality of the signals and parameters will be briefly discussed in order to provide an understanding how often the different calculations are performed.

The audio signals are defined for every time slot n and every hybrid subband (which may be a frequency subband) k. The corresponding SAOC parameters are defined for each parameter time slot 1 and processing band m. A Subsequent mapping between the hybrid and parameter domain is specified by table A.31 ISO/IEC 23003-1:2007. Hence, all calculations are performed with respect to the certain time/band indices and the corresponding dimensionalities are implied for each introduced variable.

However, in the following, the time and frequency band indices will be omitted sometimes to keep the notation concise.

3.3.2 Calculation of the Matrix $A_{EAO}$

The EAO pre-rendering matrix $A_{EAO}$ is defined according to the number of output channels (i.e. mono, stereo or binaural) as $$A_{EAO} = \begin{cases} A_1^{EAO}, & \text{for mono case,} \\ A_2^{EAO}, & \text{for other cases.} \end{cases}$$

The matrices $A_1^{EAO}$ of size $1\times N_{EAO}$ and $A_2^{EAO}$ of size $2\times N_{EAO}$ are defined as $$A_1^{EAO} = D_{16}^{EAO} M_{ren}^{EAO},$$

$$D_{16}^{EAO} = (\, w_1^{EAO} \quad w_2^{EAO} \quad w_3^{EAO} \quad w_3^{EAO} \quad w_1^{EAO} \quad w_2^{EAO} \,),$$

$$A_2^{EAO} = D_{26}^{EAO} M_{ren}^{EAO},$$

$$D_{26}^{EAO} = \begin{pmatrix} w_1^{EAO} & 0 & \frac{w_3^{EAO}}{\sqrt{2}} & \frac{w_3^{EAO}}{\sqrt{2}} & w_1^{EAO} & 0 \\ 0 & w_2^{EAO} & \frac{w_3^{EAO}}{\sqrt{2}} & \frac{w_3^{EAO}}{\sqrt{2}} & 0 & w_2^{EAO} \end{pmatrix},$$

where the rendering sub-matrix $M_{ren}^{EAO}$ corresponds to the EAO rendering (and describes a desired mapping of enhanced audio objects onto channels of the upmix signal representation).

The values $w_i^{EAO}$ are computed in dependence on rendering information associated with the enhanced audio objects using the corresponding EAO elements and using the equations of section 4.2.2.1.

In case of binaural rendering the matrix $A_2^{EAO}$ is defined by equations given in section 4.1.2, for which the corresponding target binaural rendering matrix contains only EAO related elements.

3.4 Calculation of the OTN/TTN Elements in the Residual Mode

In the following, it will be discussed how the SAOC downmix signal 310, which typically comprises one or two audio channels, is mapped onto the enhanced audio object signal 334, which typically comprises one or more enhanced audio object channels, and the second audio information 322, which typically comprises one or two regular audio object channels.

The functionality of the 1-to-N unit or 2-to-N unit 330 may, for example, be implemented using a matrix vector multiplication, such that a vector describing both the channels of the enhanced audio object signal 334 and the channels of the second audio information 322 is obtained by multiplying a vector describing the channels of the SAOC downmix signal 310 and (optionally) one or more residual signals with a matrix $M_{Prediction}$ or $M_{Energy}$. Accordingly, the determination of the matrix $M_{Prediction}$ or $M_{Energy}$ is an important step in the derivation of the first audio information 320 and the second audio information 322 from the SAOC downmix 310.

To summarize, the OTN/TTN upmix process is presented by either a matrix $M_{Prediction}$ for a prediction mode or $M_{Energy}$ for an energy mode.

The energy based encoding/decoding procedure is designed for non-waveform preserving coding of the downmix signal. Thus the OTN/TTN upmix matrix for the corresponding energy mode does not rely on specific waveforms, but only describe the relative energy distribution of the input audio objects, as will be discussed in more detail below.

3.4.1 Prediction Mode

For the prediction mode the matrix $M_{Prediction}$ is defined exploiting the downmix information contained in the matrix $\tilde{D}^{-1}$ and the CPC data from matrix C:

$$M_{Prediction} = \tilde{D}^{-1} C.$$

With respect to the several SAOC modes, the extended downmix matrix $\tilde{D}$ and CPC matrix C exhibit the following dimensions and structures:

3.4.1.1 Stereo Downmix Modes (TTN):

For stereo downmix modes (TTN) (for example, for the case of a stereo downmix on the basis of two regular-audio-object channels and $N_{EAO}$ enhanced-audio-object-channels), the (extended) downmix matrix $\tilde{D}$ and the CPC matrix C can be obtained as follows:

$$\tilde{D} = \left(\begin{array}{cc|ccc} 1 & 0 & m_0 & \dots & m_{N_{EAO}-1} \\ 0 & 1 & n_0 & \dots & n_{N_{EAO}-1} \\ \hline m_0 & n_0 & -1 & \dots & 0 \\ \vdots & \vdots & 0 & \ddots & \vdots \\ m_{N_{EAO}-1} & n_{N_{EAO}-1} & 0 & \dots & -1 \end{array}\right),$$

$$C = \left(\begin{array}{cc|ccc} 1 & 0 & 0 & \dots & 0 \\ 0 & 1 & 0 & \dots & 0 \\ \hline c_{0,0} & c_{0,1} & 1 & \dots & 0 \\ \vdots & \vdots & \vdots & \ddots & \vdots \\ c_{N_{EAO}-1,0} & c_{N_{EAO}-1,1} & 0 & \dots & 1 \end{array}\right).$$

With a stereo downmix, each EAO j holds two CPCs $c_{j,0}$ and $c_{j,1}$ yielding matrix C.

The residual processor output signals are computed as $$X_{OBJ} = M_{OBJ}^{Prediction}\begin{pmatrix} l_0 \\ r_0 \\ \hline res_0 \\ \vdots \\ res_{N_{EAO}-1} \end{pmatrix},$$

$$X_{EAO} = A^{EAO} M_{EAO}^{Prediction}\begin{pmatrix} l_0 \\ r_0 \\ \hline res_0 \\ \vdots \\ res_{N_{EAO}-1} \end{pmatrix}.$$

Accordingly, two signals $y_L$, $y_R$ (which are represented by $X_{OBJ}$) are obtained, which represent one or two or even more than two regular audio objects (also designated as non-extended audio objects). Also, $N_{EAO}$ signals (represented by $X_{EAO}$) representing $N_{EAO}$ enhanced audio objects are obtained. These signals are obtained on the basis of two SAOC downmix signals $l_0$, $r_0$ and $N_{EAO}$ residual signals $res_0$ to $res_{NEAO-1}$, which will be encoded in the SAOC side information, for example, as a part as the object-related parametric information.

It should be noted that the signals $y_L$ and $y_R$ may be equivalent to the signal 322, and that the signals $y_{0,EAO}$ to $y_{NEAO-1,EAO}$ (which are represented by $X_{EAO}$) may equivalent to the signals 320.

The matrix $A^{EAO}$ is a rendering matrix. Entries of the matrix $A^{EAO}$ may describe, for example, a mapping of enhanced audio objects to the channels of the enhanced audio object signal 334 ($X_{EAO}$).

Accordingly, an appropriate choice of the matrix $A^{EAO}$ may allow for an optional integration of the functionality of the rendering unit 340, such that the multiplication of the vector describing the channels ($l_0$,$r_0$) of the SAOC downmix signal 310 and one or more residual signals ($res_0$, . . . , $res_{NEAO-1}$) with the matrix $A^{EAO}M_{EAO}^{Prediction}$ may directly result in a representation $X_{EAO}$ of the first audio information 320.

3.4.1.2 Mono Downmix Modes (OTN):

In the following, the derivation of the enhanced audio object signals 320 (or, alternatively, of the enhanced audio object signals 334) and of the regular audio object signal 322 will be described for the case in which the SAOC downmix signal 310 comprises a signal channel only.

For mono downmix modes (OTN) (e.g., a mono downmix on the basis of one regular-audio-object channel and $N_{EAO}$ enhanced-audio-object channels), the (extended) downmix matrix 15 and the CPC matrix C can be obtained as follows:

$$\tilde{D} = \left(\begin{array}{c|ccc} 1 & m_0 & \dots & m_{N_{EAO}-1} \\ \hline m_0 & -1 & \dots & 0 \\ \vdots & 0 & \ddots & \vdots \\ m_{N_{EAO}-1} & 0 & \dots & -1 \end{array}\right),$$

$$C = \left(\begin{array}{c|ccc} 1 & 0 & \dots & 0 \\ \hline c_{0,0} & 1 & \dots & 0 \\ \vdots & 0 & \ddots & \vdots \\ c_{N_{EAO}-1,0} & 0 & \dots & 1 \end{array}\right).$$

With a mono downmix, one EAO j is predicted by only one coefficient $c_j$ yielding the matrix C. All matrix elements $c_j$ are obtained, for example, from the SAOC parameters (for example, from the SAOC data 322) according to the relationships provided below (section 3.4.1.4).

The residual processor output signals are computed as $$X_{OBJ} = M_{OBJ}^{Prediction}\begin{pmatrix} d_0 \\ \hline res_0 \\ \vdots \\ res_{N_{EAO}-1} \end{pmatrix},$$

$$X_{EAO} = A^{EAO} M_{EAO}^{Prediction}\begin{pmatrix} d_0 \\ \hline res_0 \\ \vdots \\ res_{N_{EAO}-1} \end{pmatrix}.$$

The output signal $X_{OBJ}$ comprises, for example, one channel describing the regular audio objects (non-enhanced audio objects). The output signal $X_{EAO}$ comprises, for example, one, two, or even more channels describing the enhanced audio objects (advantageously $N_{EAO}$ channels describing the enhanced audio objects). Again, said signals are equivalent to the signals 320, 322.

3.4.1.3 Calculation of the Inverse Extended Downmix Matrix

The matrix $\tilde{D}^{-1}$ is the inverse of the extended downmix matrix $\tilde{D}$ and C implies the CPCs.

The matrix $\tilde{D}^{-1}$ is the inverse of the extended downmix matrix $\tilde{D}$ and can be calculated as $$\tilde{D}^{-1} = \frac{\tilde{d}_{i,j}}{den}.$$

The elements $\tilde{d}_{i,j}$ (for example, of the inverse $\tilde{D}^{-1}$ of the extended downmix matrix $\tilde{D}$ of size 6×6) are derived using the following values:

$$\tilde{d}_{1,1} = 1 + \sum_{j=1}^{4} n_j^2,$$

$$\tilde{d}_{1,2} = -\left(\sum_{j=1}^{4} m_j n_j\right),$$

$$\tilde{d}_{1,3} = m_1 + m_1 n_2^2 + m_1 n_3^2 + m_1 n_4^2 - m_2 n_1 n_2 - m_3 n_1 n_3 - m_4 n_1 n_4,$$

$$\tilde{d}_{1,4} = m_2 + m_2 n_1^2 + m_2 n_3^2 + m_2 n_4^2 - m_1 n_2 n_1 - m_3 n_2 n_3 - m_4 n_2 n_4,$$

$$\tilde{d}_{1,5} = m_3 + m_3 n_1^2 + m_3 n_2^2 + m_3 n_4^2 - m_1 n_3 n_1 - m_2 n_3 n_2 - m_4 n_3 n_4,$$

$$\tilde{d}_{1,6} = m_4 + m_4 n_1^2 + m_4 n_2^2 + m_4 n_3^2 - m_1 n_4 n_1 - m_2 n_4 n_2 - m_3 n_4 n_3,$$

$$\tilde{d}_{2,2} = 1 + \sum_{j=1}^{4} m_j^2,$$

$$\tilde{d}_{2,3} = n_1 + n_1 m_2^2 + n_1 m_3^2 + n_1 m_4^2 - m_1 m_2 n_2 - m_1 m_3 n_3 - m_1 m_4 n_4,$$

$$\tilde{d}_{2,4} = n_2 + n_2 m_1^2 + n_2 m_3^2 + n_2 m_4^2 - m_2 m_1 n_1 - m_2 m_3 n_3 - m_2 m_4 n_4,$$

$$\tilde{d}_{2,5} = n_3 + n_3 m_1^2 + n_3 m_2^2 + n_3 m_4^2 - m_3 m_1 n_1 - m_3 m_2 n_2 - m_3 m_4 n_4,$$

$$\tilde{d}_{2,6} = n_4 + n_4 m_1^2 + n_4 m_2^2 + n_4 m_3^2 - m_4 m_1 n_1 - m_4 m_2 n_2 - m_4 m_3 n_3,$$

$$\tilde{d}_{3,3} = -1 - \sum_{j=2}^{4} m_j^2 - \sum_{j=2}^{4} n_j^2 - m_3^2 n_2^2 - m_4^2 n_2^2 - m_2^2 n_3^2 - m_4^2 n_3^2 - m_2^2 n_4^2 - m_3^2 n_4^2 + 2 m_2 m_3 n_2 n_3 + 2 m_2 m_4 n_2 n_4 + 2 m_3 m_4 n_3 n_4,$$

-continued $$\tilde{d}_{3,4} = m_1m_2 + n_1n_2 + m_3^2n_1n_2 + m_4^2n_1n_2 + m_1m_2n_3^2 + m_1m_2n_4^2 - m_2m_3n_1n_3 - m_1m_3n_2n_3 - m_2m_4n_1n_4 - m_1m_4n_2n_4,$$

$$\tilde{d}_{3,5} = m_1m_3 + n_1n_3 + m_2^2n_1n_3 + m_4^2n_1n_3 + m_1m_3n_2^2 + m_1m_3n_4^2 - m_2m_3n_1n_2 - m_1m_2n_2n_3 - m_3m_4n_1n_4 - m_1m_4n_3n_4,$$

$$\tilde{d}_{3,6} = m_1m_4 + n_1n_4 + m_2^2n_1n_4 + m_3^2n_1n_4 + m_1m_4n_2^2 + m_1m_4n_3^2 - m_2m_4n_1n_2 - m_3m_4n_1n_3 - m_1m_2n_2n_4 - m_1m_3n_4n_3,$$

$$\tilde{d}_{4,4} = -1 - \sum_{\substack{j=1\\j\neq 2}}^{4} m_j^2 - \sum_{\substack{j=1\\j\neq 2}}^{4} n_j^2 - m_3^2n_1^2 - m_4^2n_1^2 - m_1^2n_3^2 - m_4^2n_3^2 - m_1^2n_4^2 - m_3^2n_4^2 + 2m_1m_3n_1n_3 + 2m_1m_4n_1n_4 + 2m_3m_4n_3n_4,$$

$$\tilde{d}_{4,5} = m_2m_3 + n_2n_3 + m_1^2n_2n_3 + m_4^2n_2n_3 + m_2m_3n_1^2 + m_2m_3n_4^2 - m_1m_3n_1n_2 - m_1m_2n_1n_3 - m_3m_4n_2n_4 - m_2m_4n_3n_4,$$

$$\tilde{d}_{4,6} = m_2m_4 + n_2n_4 + m_1^2n_2n_4 + m_3^2n_2n_4 + m_2m_4n_1^2 + m_2m_4n_3^2 - m_1m_4n_1n_2 - m_3m_4n_2n_3 - m_1m_2n_1n_4 - m_2m_3n_3n_4,$$

$$\tilde{d}_{5,5} = -1 - \sum_{\substack{j=1\\j\neq 3}}^{4} m_j^2 - \sum_{\substack{j=1\\j\neq 3}}^{4} n_j^2 - m_2^2n_1^2 - m_4^2n_1^2 - m_1^2n_2^2 - m_4^2n_2^2 - m_1^2n_4^2 - m_2^2n_4^2 + 2m_1m_2n_1n_2 + 2m_1m_4n_1n_4 + 2m_2m_4n_2n_4,$$

$$\tilde{d}_{5,6} = m_3m_4 + n_3n_4 + m_1^2n_3n_4 + m_2^2n_3n_4 + m_3m_4n_1^2 + m_3m_4n_2^2 - m_1m_4n_1n_3 - m_2m_4n_2n_3 - m_1m_3n_1n_4 - m_2m_3n_2n_4,$$

$$\tilde{d}_{6,6} = -1 - \sum_{j=1}^{3} m_j^2 - \sum_{j=1}^{3} n_j^2 - m_2^2n_1^2 - m_3^2n_1^2 - m_1^2n_2^2 - m_3^2n_2^2 - m_1^2n_3^2 - m_2^2n_3^2 + 2m_1m_2n_1n_2 + 2m_1m_3n_1n_3 + 2m_2m_3n_2n_3,$$

$$den = 1 + \sum_{j=1}^{4} m_j^2 + \sum_{j=1}^{4} n_j^2 + m_2^2n_1^2 + m_3^2n_1^2 + m_4^2n_1^2 + m_1^2n_2^2 + m_3^2n_2^2 + m_4^2n_2^2 + m_1^2n_3^2 + m_2^2n_3^2 + m_4^2n_3^2 + m_1^2n_4^2 + m_2^2n_4^2 + m_3^2n_4^2 - 2m_1m_2n_1n_2 - 2m_1m_3n_1n_3 - 2m_2m_3n_2n_3 - 2m_1m_4n_1n_4 - 2m_2m_4n_2n_4 - 2m_3m_4n_3n_4.$$

The coefficients $m_j$ and $n_j$ of the extended downmix matrix $\tilde{D}$ denote the downmix values for every EAO j for the right and left downmix channel as $$m_j = d_{0,EAO(j)},\ n_j = d_{1,EAO(j)}.$$

The elements $d_{i,j}$ of the downmix matrix D are obtained using the downmix gain information DMG and the (optional) downmix channel level different information DCLD, which is included in the SAOC information 332, which is represented, for example, by the object-related parametric information 110 or the SAOC bitstream information 212.

For the stereo downmix case the downmix matrix D of size 2×N with elements (i=0, 1; j=0, . . . , N−1) is obtained from the DMG and DCLD parameters as $$d_{0,j} = 10^{0.05DMG_j}\sqrt{\frac{10^{0.1DCLD_j}}{1+10^{0.1DCLD_j}}},$$

$$d_{1,j} = 10^{0.05DMG_j}\sqrt{\frac{1}{1+10^{0.1DCLD_j}}}.$$

For the mono downmix case the downmix matrix D of size 1×N with elements $d_{i,j}$ (i=0; j=0, . . . , N−1) is obtained from the DMG parameters as $$d_{0,j} = 10^{0.05DMG_j}.$$

Here, the dequantized downmix parameters $DMG_j$ and $DCLD_j$ are obtained, for example, from the parametric side information 110 or from the SAOC bitstream 212.

The function EAO(j) determines mapping between indices of input audio object channels and EAO signals:

$$EAO(j) = N-1-j,\ j=0, \ldots, N_{EAO}-1.$$

3.4.1.4 Calculation of the Matrix C

The matrix C implies the CPCs and is derived from the transmitted SAOC parameters (i.e. the OLDs, IOCs, DMGs and DCLDs) as $$c_{j,0} = (1-\lambda)\tilde{c}_{j,0} + \lambda\gamma_{j,0},\ c_{j,1} = (1-\lambda)\tilde{c}_{j,1} + \lambda\gamma_{j,1}.$$

In other words, the constrained CPCs are obtained in accordance with the above equations, which may be considered as a constraining algorithm. However, the constrained CPCs may also be derived from the values $\tilde{c}_{j,0}$, $\tilde{c}_{j,1}$ using a different limitation approach (constraining algorithm), or can be set to be equal to the values $\tilde{c}_{j,0}$, $\tilde{c}_{j,1}$.

It should be noted, that matrix entries $c_{j,1}$ (and the intermediate quantities on the basis of which the matrix entries $c_{j,1}$ are computed) are typically only necessitated if the downmix signal is a stereo downmix signal.

The CPCs are constrained by the subsequent limiting functions:

$$\gamma_{j,1} = \frac{m_j OLD_L + n_j e_{L,R} - \sum_{i=0}^{N_{EAO}-1} m_i e_{i,j}}{2\left(OLD_L + \sum_{i=0}^{N_{EAO}-1}\sum_{k=0}^{N_{EAO}-1} m_i m_k e_{i,k}\right)},$$

$$\gamma_{j,2} = \frac{n_j OLD_R + m_j e_{L,R} - \sum_{i=0}^{N_{EAO}-1} n_i e_{i,j}}{2\left(OLD_R + \sum_{i=0}^{N_{EAO}-1}\sum_{k=0}^{N_{EAO}-1} n_i n_k e_{i,k}\right)},$$

with the weighting factor λ determined as $$\lambda = \left(\frac{P_{LoRo}^2}{P_{Lo}P_{Ro}}\right)^8.$$

For one specific EAO channel j=0 . . . $N_{EAO}-1$ the unconstrained CPCs are estimated by $$\tilde{c}_{j,0} = \frac{P_{LoCo,j}P_{Ro} - P_{RoCo,j}P_{LoRo}}{P_{Lo}P_{Ro} - P_{LoRo}^2},$$

$$\tilde{c}_{j,1} = \frac{P_{RoCo,j}P_{Lo} - P_{LoCo,j}P_{LoRo}}{P_{Lo}P_{Ro} - P_{LoRo}^2}.$$

The energy quantities $P_{Lo}$, $P_{Ro}$, $P_{LoRo}$, $P_{LoCo,j}$ and $P_{RoCo,j}$ are computed as $$P_{Lo} = OLD_L + \sum_{j=0}^{N_{EAO}-1}\sum_{k=0}^{N_{EAO}-1} m_j m_k e_{j,k},$$

$$P_{Ro} = OLD_R + \sum_{j=0}^{N_{EAO}-1}\sum_{k=0}^{N_{EAO}-1} n_j n_k e_{j,k},$$

-continued $$P_{LoRo} = e_{L,R} + \sum_{j=0}^{N_{EAO}-1} \sum_{k=0}^{N_{EAO}-1} m_j n_k e_{j,k},$$

$$P_{LoCo,j} = m_j OLD_L + n_j e_{L,R} - m_j OLD_j - \sum_{\substack{i=0 \\ i \neq j}}^{N_{EAO}-1} m_i e_{i,j},$$

$$P_{RoCo,j} = n_j OLD_R + m_j e_{L,R} - n_j OLD_j - \sum_{\substack{i=0 \\ i \neq j}}^{N_{EAO}-1} n_i e_{i,j}.$$

The covariance matrix $e_{i,j}$ is defined in the following way: The covariance matrix E of size N×N with elements $e_{i,j}$ represents an approximation of the original signal covariance matrix E≈SS* and is obtained from the OLD and IOC parameters as $$e_{i,j} = \sqrt{OLD_i OLD_j} IOC_{i,j}.$$

Here, the dequantized object parameters $OLD_i$, $IOC_{i,j}$ are obtained, for example, from the parametric side information 110 or from the SAOC bitstream 212.

In addition, $e_{L,R}$ may, for example, be obtained as $$e_{L,R} = \sqrt{OLD_L OLD_R} IOC_{L,R}.$$

The parameters $OLD_L$, $OLD_R$ and $IOC_{L,R}$ correspond to the regular (audio) objects and can be derived using the downmix information:

$$OLD_L = \sum_{i=0}^{N-N_{EAO}-1} d_{0,i}^2 OLD_i,$$

$$OLD_R = \sum_{i=0}^{N-N_{EAO}-1} d_{1,i}^2 OLD_i,$$

$$IOC_{L,R} = \begin{cases} IOC_{0,1}, & N - N_{EAO} = 2, \\ 0, & \text{otherwise.} \end{cases}$$

As can be seen, two common object-level-different values $OLD_L$ and $OLD_R$ are computed for the regular audio objects in the case of a stereo downmix signal (which implies a two-channel regular audio object signal). In contrast, only one common object-level-different value $OLD_L$ is computed for the regular audio objects in the case of a one-channel (mono) downmix signal (which implies a one-channel regular audio object signal).

As can be seen, the first (in the case of a two-channel downmix signal) or sole (in the case of a one-channel downmix signal) common object-level-difference value $OLD_L$ is obtained by summing contributions of the regular audio objects having audio object index (or indices) i to the left channel (or sole channel) of the SAOC downmix signal 310.

The second common object-level-difference value $OLD_R$ (which is used in the case of a two-channel downmix signal) is obtained by summing the contributions of the regular audio objects having the audio object index (or indices) i to the right channel of the SAOC downmix signal 310.

The contribution $OLD_L$ of the regular audio objects (having audio objects indices i=0 to i=N−$N_{EAO}$−1) onto the left channel signal (or sole channel signal) of the SAOC downmix signal 710 is computed, for example, taking into consideration the downmix gain $d_{0,i}$, describing the downmix gain applied to the regular audio object having audio object index when obtaining the left channel signal of the SAOC downmix signal 310, and also the object level of the regular audio object having the audio object i, which is represented by the value $OLD_i$.

Similarly, the common object level difference value $OLD_R$ is obtained using the downmix coefficients $d_{1,i}$, describing the downmix gain which is applied to the regular audio object having the audio object index i when forming the right channel signal of the SAOC downmix signal 310, and the level information $OLD_i$ associated with the regular audio object having the audio object index i.

As can be seen, the equations for the calculation of the quantities $P_{Lo}$, $P_{Ro}$, $P_{LoRo}$, $P_{LoCo,j}$ and $P_{RoCo,j}$ do not distinguish between the individual regular audio objects, but merely make use of the common object level difference values $OLD_L$, $OLD_R$, thereby considering the regular audio objects (having audio object indices i) as a single audio object.

Also, the inter-object-correlation value $IOC_{L,R}$, which is associated with the regular audio objects, is set to 0 unless there are two regular audio objects.

The covariance matrix $e_{i,j}$ (and $e_{L,R}$) is defined as follows:

The covariance matrix E of size N×N with elements $e_{i,j}$ represents an approximation of the original signal covariance matrix E≈SS* and is obtained from the OLD and IOC parameters as $$e_{i,j} = \sqrt{OLD_i OLD_j} IOC_{i,j}.$$

For example, $$e_{L,R} = \sqrt{OLD_L OLD_R} IOC_{L,R},$$

wherein $OLD_L$ and $OLD_R$ and $IOC_{L,R}$ are computed as described above.

Here, the dequantized object parameters are obtained as $$OLD_i = D_{OLD}(i,l,m), IOC_{i,j} = D_{IOC}(i,j,l,m),$$

wherein $D_{OLD}$ and $D_{IOC}$ are matrices comprising objects-level-difference parameters and inter-object-correlation parameters.

3.4.2. Energy Mode

In the following, another concept will be described, which can be used to separate the extended-audio-object signals 320 and the regular-audio-object (non-extended audio object) signals 322, and which can be used in combination with a non-waveform-preserving audio coding of the SAOC downmix channels 310.

In other words, the energy based encoding/decoding procedure is designed for non-waveform preserving coding of the downmix signal. Thus the OTN/TTN upmix matrix for the corresponding energy mode does not rely on specific waveforms, but only describe the relative energy distribution of the input audio objects.

Also, the concept discussed here, which is designated as an "energy mode" concept, can be used without transmitting a residual signal information. Again, the regular audio objects (non-enhanced audio objects) are treated as a single one-channel or two-channel audio object having one or two common object-level-difference values $OLD_L$, $OLD_R$.

For the energy mode the matrix $M_{Energy}$ is defined exploiting the downmix information and the OLDs, as will be described in the following.

3.4.2.1. Energy Mode for Stereo Downmix Modes (TTN)

In case of a stereo (for example, a stereo downmix on the basis of two regular-audio-object channels and $N_{EAO}$ enhanced-audio-object channels), the matrices $M_{OBJ}^{Energy}$ and $M_{EAO}^{Energy}$ are obtained from the corresponding OLDs according to $$M_{OBJ}^{Energy} = \begin{pmatrix} \sqrt{\frac{OLD_L}{OLD_L + \sum_{i=0}^{N_{EAO}-1} m_i^2 OLD_i}} & 0 \\ 0 & \sqrt{\frac{OLD_R}{OLD_R + \sum_{i=0}^{N_{EAO}-1} n_i^2 OLD_i}} \end{pmatrix}$$

$$M_{EAO}^{Energy} = \begin{pmatrix} \sqrt{\frac{m_0^2 OLD_0}{OLD_L + \sum_{i=0}^{N_{EAO}-1} m_i^2 OLD_i}} & \sqrt{\frac{n_0^2 OLD_0}{OLD_R + \sum_{i=0}^{N_{EAO}-1} n_i^2 OLD_i}} \\ \vdots & \vdots \\ \sqrt{\frac{m_{N_{EAO}-1}^2 OLD_{N_{EAO}-1}}{OLD_L + \sum_{i=0}^{N_{EAO}-1} m_i^2 OLD_i}} & \sqrt{\frac{n_{N_{EAO}-1}^2 OLD_{N_{EAO}-1}}{OLD_R + \sum_{i=0}^{N_{EAO}-1} n_i^2 OLD_i}} \end{pmatrix}.$$

The residual processor output signals are computed as $$X_{OBJ} = M_{OBJ}^{Energy} \begin{pmatrix} l_0 \\ r_0 \end{pmatrix},$$

$$X_{EAO} = A^{EAO} M_{EAO}^{Energy} \begin{pmatrix} l_0 \\ r_0 \end{pmatrix}.$$

The signals $y_L$, $y_R$, which are represented by the signal $X_{OBJ}$, describe the regular audio objects (and may be equivalent to the signal 322), and the signals $y_{0,EAO}$ to $y_{NEAO-1,EAO}$, which are described by the signal $X_{EAO}$, describe the enhanced audio objects (and may be equivalent to the signal 334 or to the signal 320).

If a mono upmix signal is desired for the case of a stereo downmix signal, a 2-to-1 processing may be performed, for example, by the pre-processor 270 on the basis of the two-channel signal $X_{OBJ}$.

3.4.2.2. Energy Mode for Mono Downmix Modes (OTN)

For the mono case (for example, a mono downmix on the basis of one regular-audio-object channel and $N_{EAO}$ enhanced-audio-object channels), the matrices $M_{OBJ}^{Energy}$ and $M_{EAO}^{Energy}$ are obtained from the corresponding OLDs according to $$M_{OBJ}^{Energy} = \begin{pmatrix} \sqrt{\frac{OLD_L}{OLD_L + \sum_{i=0}^{N_{EAO}-1} m_i^2 OLD_i}} \end{pmatrix},$$

$$M_{EAO}^{Energy} = \begin{pmatrix} \sqrt{\frac{m_0^2 OLD_0}{OLD_L + \sum_{i=0}^{N_{EAO}-1} m_i^2 OLD_i}} \\ \vdots \\ \sqrt{\frac{m_{N_{EAO}-1}^2 OLD_{N_{EAO}-1}}{OLD_L + \sum_{i=0}^{N_{EAO}-1} m_i^2 OLD_i}} \end{pmatrix}.$$

The residual processor output signals are computed as $$X_{OBJ} = M_{OBJ}^{Energy}(d_0),$$

$$X_{EAO} = A^{EAO} M_{EAO}^{Energy}(d_0).$$

A single regular-audio-object channel 322 (represented by $X_{OBJ}$) and $N_{EAO}$ enhanced-audio-object channels 320 (represented by $X_{EAO}$) can be obtained by applying the matrices $M_{OBJ}^{Energy}$ and $M_{EAO}^{Energy}$ to a representation of a single channel SAOC downmix signal 310 (represented here by $d_0$).

If a two-channel (stereo) upmix signal is desired for the case of a one-channel (mono) downmix signal, a 1-to-2 processing may be performed, for example, by the pre-processor 270 on the basis of the one-channel signal $X_{OBJ}$.

4. Architecture and Operation of the SAOC Downmix Pre-Processor

In the following, the operation of the SAOC downmix pre-processor 270 will be described both for some decoding modes of operation and for some transcoding modes of operation.

4.1 Operation in the Decoding Modes

4.1.1 Introduction

In the following, a method for obtaining an output signal using SAOC parameters and panning information (or rendering information) associated with each audio object is described. The SAOC decoder 495 is depicted in FIG. 4*g* and consists of the SAOC parameter processor 496 and the downmix processor 497.

It should be noted that the SAOC decoder 494 may be used to process the regular audio objects, and may therefore receive, as the downmix signal 497*a*, the second audio object signal 264 or the regular-audio-object signal 322 or the second audio information 134. Accordingly, the downmix processor 497 may provide, as its output signals 497*b*, the processed version 272 of the second audio object signal 264 or the processed version 142 of the second audio information 134. Accordingly, the downmix processor 497 may take the role of the SAOC downmix pre-processor 270, or the role of the audio signal processor 140.

The SAOC parameter processor 496 may take the role of the SAOC parameter processor 252 and consequently provides downmix information 496*a*.

4.1.2 Downmix Processor

In the following, the downmix processor, which is part of the audio signal processor 140, and which is designated as a "SAOC downmix pre-processor" 270 in the embodiment of FIG. 2, and which is designated with 497 in the SAOC decoder 495, will be described in more detail.

For the decoder mode of the SAOC system, the output signal 142, 272, 497*b* of the downmix processor (represented in the hybrid QMF domain) is fed into the corresponding synthesis filterbank (not shown in FIGS. 1 and 2) as described in ISO/IEC 23003-1: 2007 yielding the final output PCM signal. Nevertheless, the output signal 142, 272, 497*b* of the downmix processor is typically combined with one or more audio signals 132, 262 representing the enhanced audio objects. This combination may be performed before the corresponding synthesis filterbank (such that a combined signal combining the output of the downmix processor and the one or more signals representing the enhanced audio objects is input to the synthesis filterbank). Alternatively, the output signal of the downmix processor may be combined with one or more audio signals representing the enhanced audio objects only after the synthesis filterbank processing. Accordingly, the upmix signal representation 120, 220 may be either a QMF domain representation or a PCM domain representation (or any other appropriate representation). The downmix processing incorporates, for example, the mono processing, the stereo processing and, if necessitated, the subsequent binaural processing.

The output signal $\hat{X}$ of the downmix processor 270, 497 (also designated with 142, 272, 497*b*) is computed from the mono downmix signal X (also designated with 134, 264, 497*a*) and the decorrelated mono downmix signal $X_d$ as $$\hat{X}=GX+P_2X_d.$$

The decorrelated mono downmix signal $X_d$ is computed as $$X_d=\text{decorrFunc}(X).$$

The decorrelated signals $X_d$ are created from the decorrelator described in ISO/IEC 23003-1:2007, subclause 6.6.2. Following this scheme, the bsDecorrConfig==0 configuration should be used with a decorrelator index, X=8, according to Table A.26 to Table A.29 in ISO/IEC 23003-1:2007. Hence, the decorrFunc( ) denotes the decorrelation process:

$$X_d=\begin{pmatrix} x_{1d} \\ x_{2d} \end{pmatrix}=\begin{pmatrix} decorrFunc((1\ 0)P_1X) \\ decorrFunc((0\ 1)P_1X) \end{pmatrix}.$$

In case of binaural output the upmix parameters G and $P_2$ derived from the SAOC data, rendering information $M_{ren}^{l,m}$ and HRTF parameters are applied to the downmix signal X (and $X_d$) yielding the binaural output $\hat{X}$, see FIG. 2, reference numeral 270, where the basic structure of the downmix processor is shown.

The target binaural rendering matrix $A^{l,m}$ of size 2×N consists of the elements $a_{x,y}^{l,m}$. Each element $a_{x,y}^{l,m}$ is derived from HRTF parameters and rendering matrix $M_{ren}^{l,m}$ with elements $m_{y,i}^{l,m}$, for example, by the SAOC parameter processor. The target binaural rendering matrix $A^{l,m}$ represents the relation between all audio input objects y and the desired binaural output.

$$a_{y,1}^{l,m}=\sum_{i=0}^{N_{HRTF}-1} m_{y,i}^{l,m}H_{i,L}^{m}\exp\left(j\frac{\phi_i^m}{2}\right),$$

$$a_{y,2}^{l,m}=\sum_{i=0}^{N_{HRTF}-1} m_{y,i}^{l,m}H_{i,R}^{m}\exp\left(-j\frac{\phi_i^m}{2}\right).$$

The HRTF parameters are given by $H_{i,L}^{m}$, $H_{i,R}^{m}$ and $\phi_i^m$ for each processing band m. The spatial positions for which HRTF parameters are available are characterized by the index i. These parameters are described in ISO/IEC 23003-1:2007.

4.1.2.1 Overview

In the following, an overview over the downmix processing will be given taking reference to FIGS. 4*a* and 4*b*, which show a block representation of the downmix processing, which may be performed by the audio signal processor 140 or by the combination of the SAOC parameter processor 252 and the SAOC downmix pre-processor 270, or by the combination of the SAOC parameter processor 496 and the downmix processor 497.

Figure 4A:
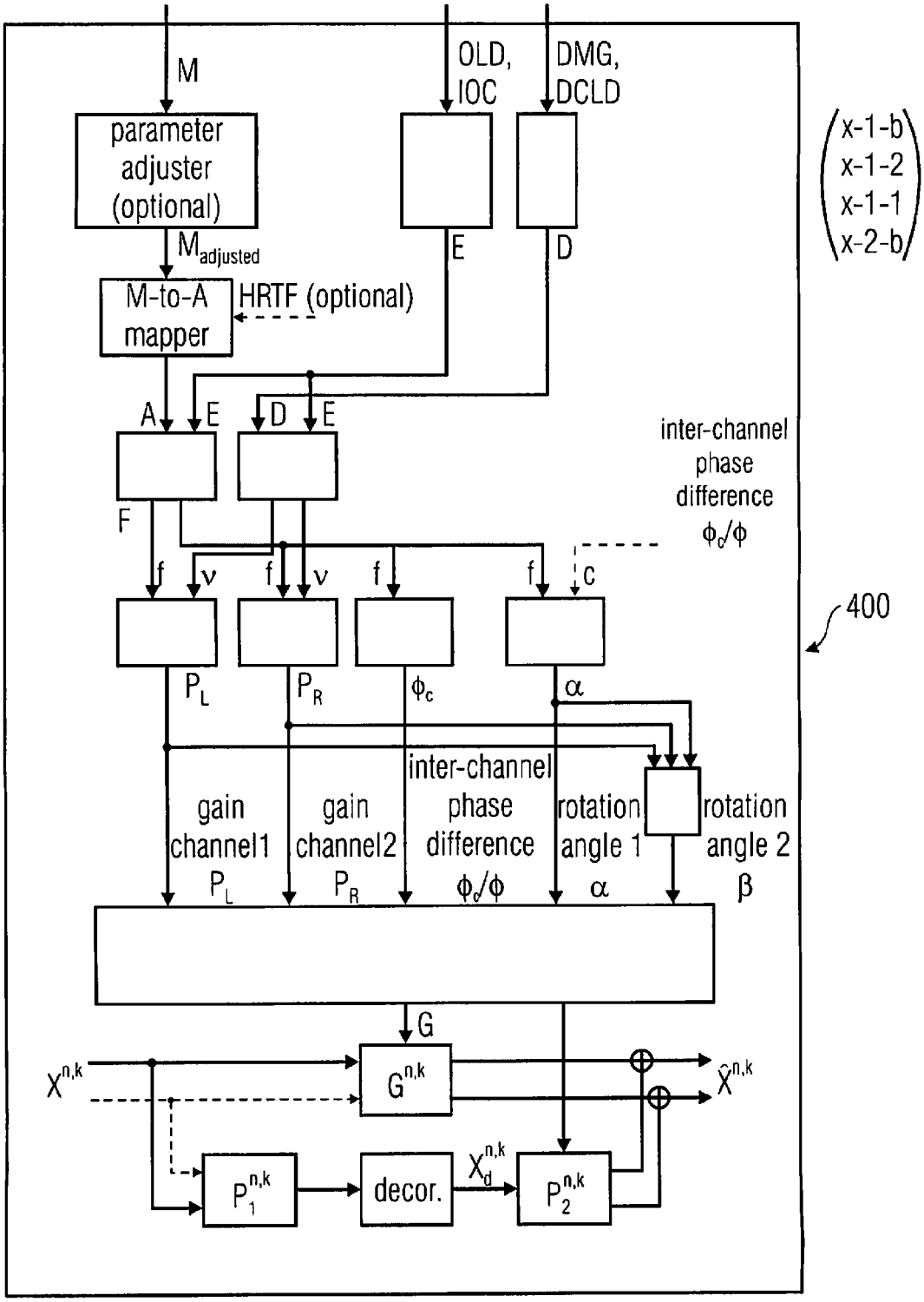
FIGS. 4*a* to 4*e* show block schematic diagrams of audio signal processors, which can be used in an audio signal decoder according to an embodiment of the invention.
Figure 4B:
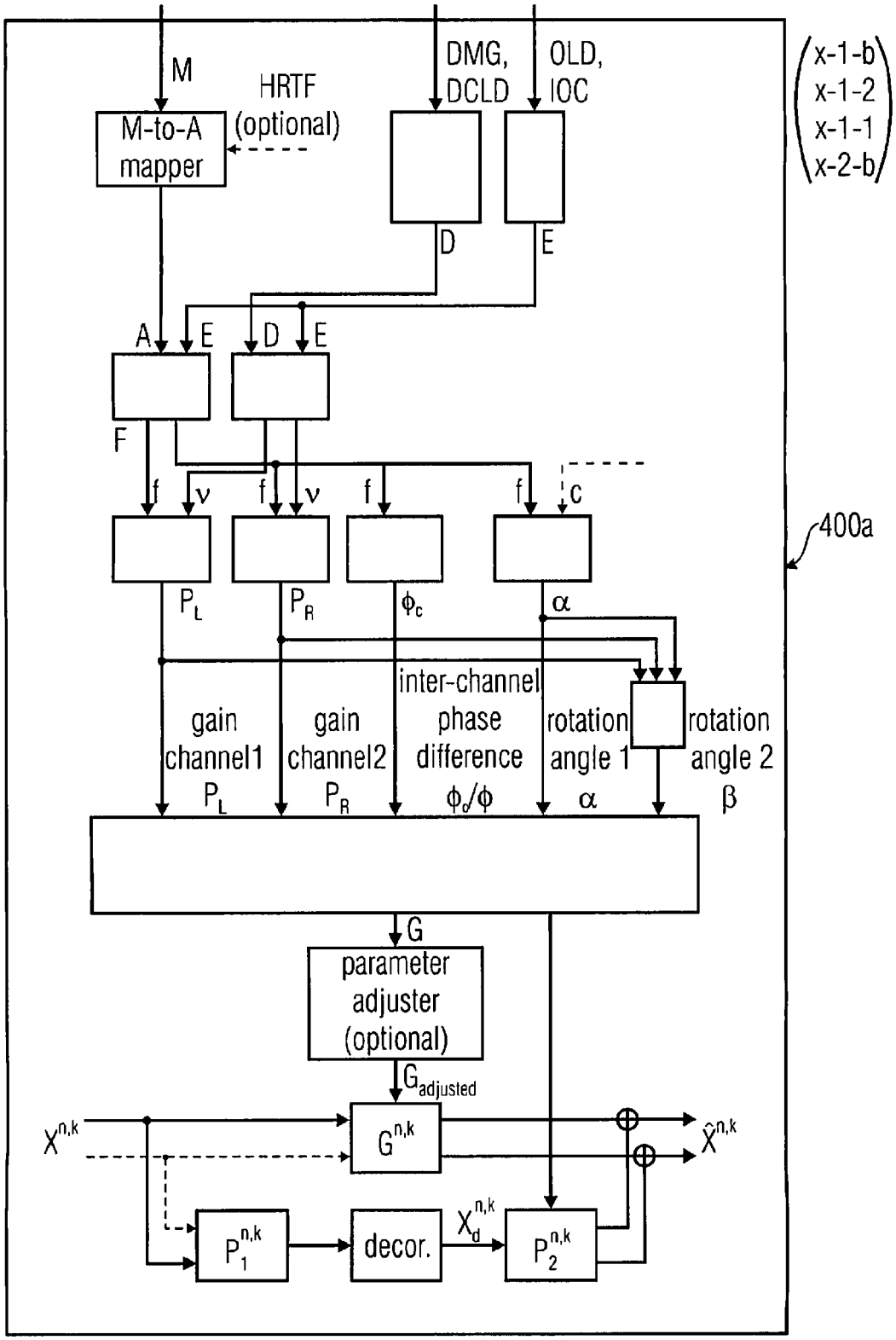
Figure 4C:
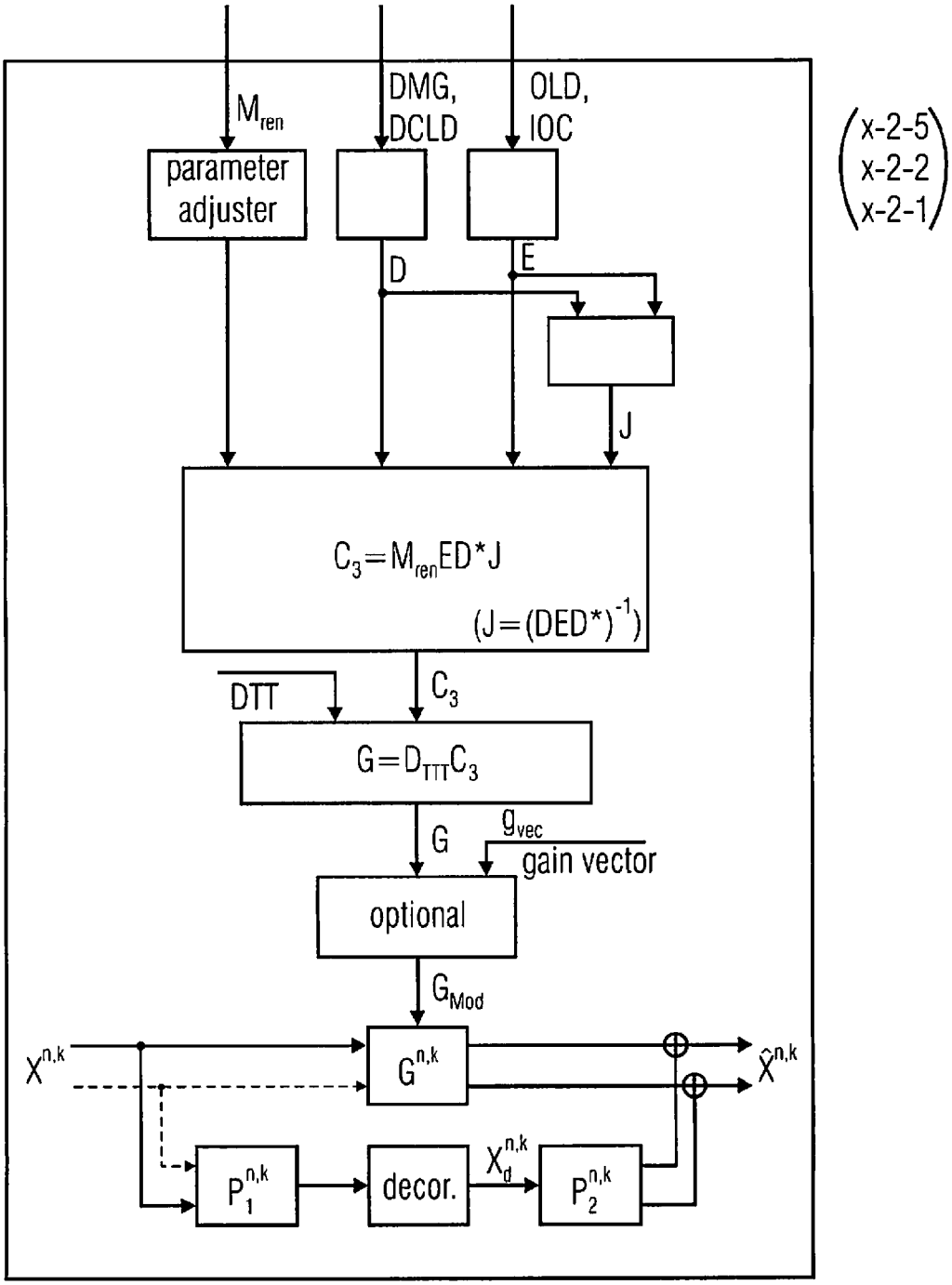
Figure 4D:
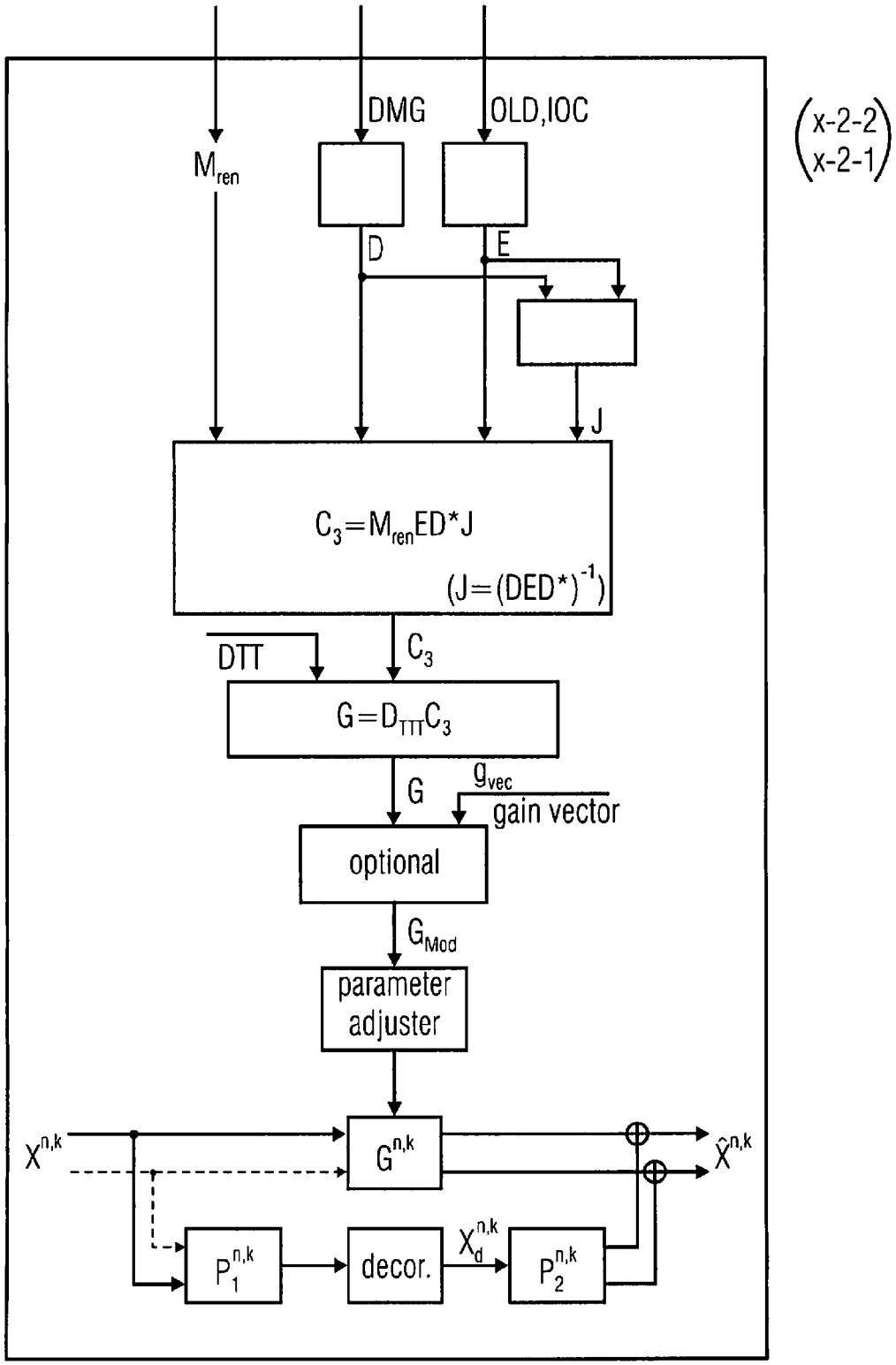
Figure 4E:
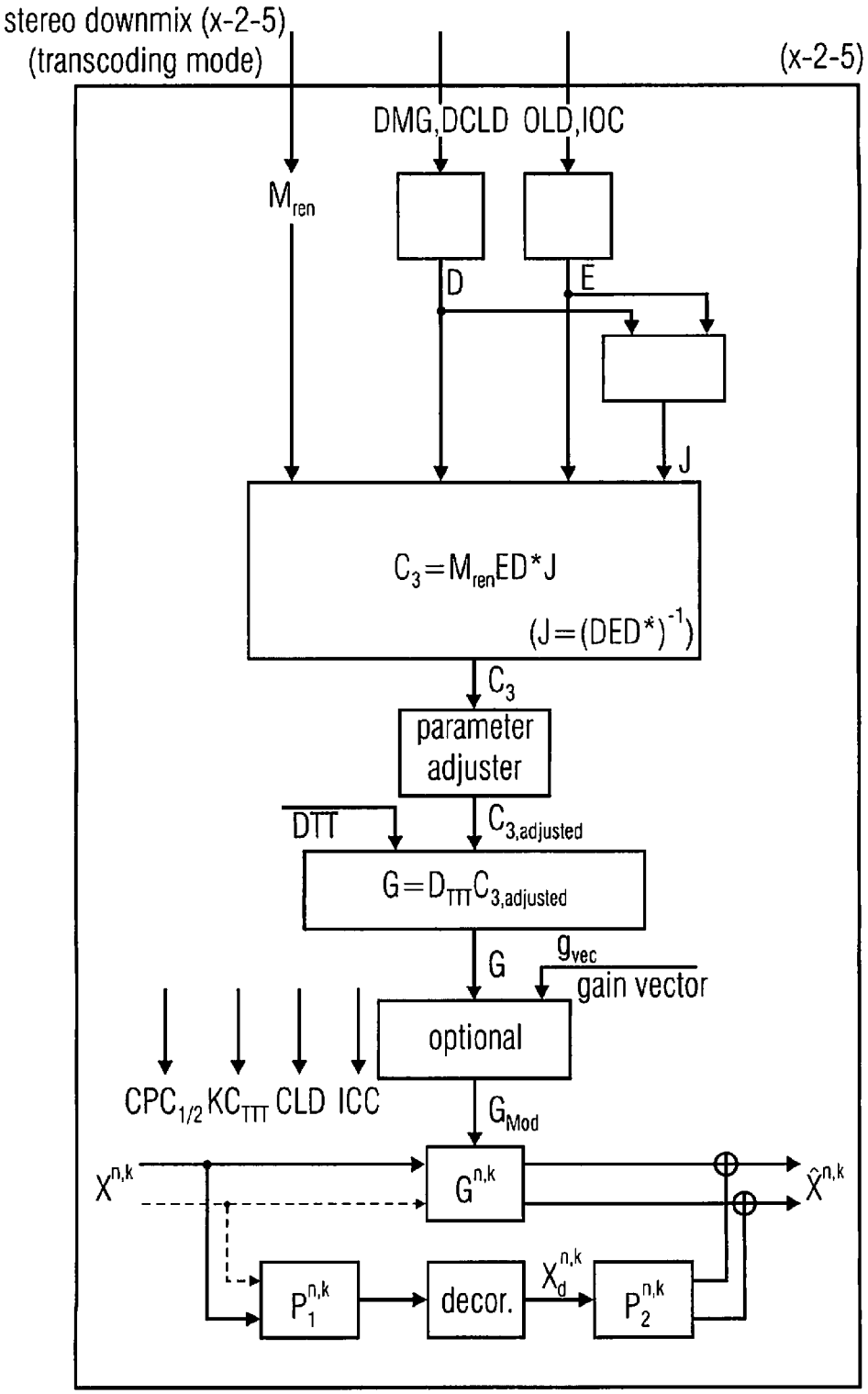

Taking reference now to FIG. 4*a*, the downmix processing receives a rendering matrix M, an object level difference information OLD, an inter-object-correlation information IOC, a downmix gain information DMG and (optionally) a downmix channel level difference information DCLD. The downmix processing 400 according to FIG. 4*a* obtains a rendering matrix A on the basis of the rendering matrix M, for example, using a parameter adjuster and a M-to-A mapping. Also, entries of a covariance matrix E are obtained in dependence on the object level difference information OLD and the inter-object correlation information IOC, for example, as discussed above. Similarly, entries of a downmix matrix D are obtained in dependence on the downmix gain information DMG and the downmix channel level difference information DCLD.

Entries f of a desired covariance matrix F are obtained in dependence on the rendering matrix A and the covariance matrix E. Also, a scalar value v is obtained in dependence on the covariance matrix E and the downmix matrix D (or in dependence on the entries thereof).

Gain values $P_L$, $P_R$ for two channels are obtained in dependence on entries of the desired covariance matrix F and the scalar value v. Also, an inter-channel phase difference value $\phi_C$ is obtained in dependence entries f of the desired covariance matrix F. A rotation angle α is also obtained in dependence on entries f of the desired covariance matrix F, taking into consideration, for example, a constant c. In addition, a second rotation angle β is obtained, for example, in dependence on the channel gains $P_L$, $P_R$ and the first rotation angle α. Entries of a matrix G are obtained, for example, in dependence on the two channel gain values $P_L$,$P_R$ and also in dependence on the inter-channel phase difference $\phi_C$ and, optionally, the rotation angles α, β. Similarly, entries of a matrix $P_2$ are determined in dependence on some or all of said values $P_L$, $P_R$, $\phi_c$, α, β.

In the following, it will be described how the matrix G and/or $P_2$ (or the entries thereof), which may be applied by the downmix processor as discussed above, can be obtained for different processing modes.

4.1.2.2 Mono to Binaural "x-1-b" Processing Mode

In the following, a processing mode will be discussed in which the regular audio objects are represented by a single channel downmix signal 134, 264, 322, 497*a* and in which a binaural rendering is desired.

The upmix parameters $G^{l,m}$ and $P_2^{l,m}$ are computed as $$G^{l,m}=\begin{pmatrix} P_L^{l,m}\exp\left(j\frac{\phi_C^{l,m}}{2}\right)\cos(\beta^{l,m}+\alpha^{l,m}) \\ P_R^{l,m}\exp\left(-j\frac{\phi_C^{l,m}}{2}\right)\cos(\beta^{l,m}-\alpha^{l,m}) \end{pmatrix},$$

$$P_2^{l,m}=\begin{pmatrix} P_L^{l,m}\exp\left(j\frac{\phi_C^{l,m}}{2}\right)\sin(\beta^{l,m}+\alpha^{l,m}) \\ P_R^{l,m}\exp\left(-j\frac{\phi_C^{l,m}}{2}\right)\sin(\beta^{l,m}-\alpha^{l,m}) \end{pmatrix}.$$

The gains $P_L^{l,m}$ and $P_R^{l,m}$ for the left and right output channels are $$P_L^{l,m}=\sqrt{\max\left(\frac{f_{1,1}^{l,m}}{v^{l,m}},\varepsilon^2\right)},$$

$$P_R^{l,m}=\sqrt{\max\left(\frac{f_{2,2}^{l,m}}{v^{l,m}},\varepsilon^2\right)}.$$

The desired covariance matrix $F^{l,m}$ of size 2×2 with elements $f_{i,j}^{l,m}$ is given as $$F^{l,m}=A^{l,m}E^{l,m}(A^{l,m})^*.$$

The scalar $v^{l,m}$ is computed as $$v^{l,m}=D^lE^{l,m}(D^l)^*+\epsilon^2.$$

The inter channel phase difference $\phi_C^{l,m}$ is given as $$\phi_C^{l,m} = \begin{cases} \arg(f_{1,2}^{l,m}), & 0 \le m \le 11, \quad \rho_C^{l,m} \ge 0.6, \\ 0, & \text{otherwise.} \end{cases}$$

The inter channel coherence $\rho_C^{l,m}$ is computed as $$\rho_C^{l,m} = \min\left(\frac{|f_{1,2}^{l,m}|}{\sqrt{\max(f_{1,1}^{l,m} f_{2,2}^{l,m}, \varepsilon^2)}}, 1\right).$$

The rotation angles $\alpha^{l,m}$ and $\beta^{l,m}$ are given as $$\alpha^{l,m} = \begin{cases} \frac{1}{2}\arccos\left(\rho_C^{l,m}\cos\left(\arg\left(f_{1,2}^{l,m}\right)\right)\right), & 0 \le m \le 11, \quad \rho_C^{l,m} < 0.6, \\ \frac{1}{2}\arccos\left(\rho_C^{l,m}\right), & \text{otherwise,} \end{cases}$$

$$\beta^{l,m} = \arctan\left(\tan(\alpha^{l,m})\frac{P_R^{l,m} - P_L^{l,m}}{P_L^{l,m} + P_R^{l,m} + \varepsilon}\right).$$

4.1.2.3 Mono-to-Stereo "x-1-2" Processing Mode

In the following, a processing mode will be described in which the regular audio objects are represented by a single-channel signal 134, 264, 222, and in which a stereo rendering is desired.

In case of stereo output the "x-1-b" processing mode can be applied without using HRTF information. This can be done by deriving all elements $\alpha_{x,y}^{l,m}$ of the rendering matrix A, yielding:

$$a_{1,y}^{l,m} = m_{Lf,y}^{l,m},\ a_{2,y}^{l,m} = m_{Rf,y}^{l,m}.$$

4.1.2.4 Mono-to-Mono "x-1-1" Processing Mode

In the following, a processing mode will be described in which the regular audio objects are represented by a signal channel 134, 264, 322, 497*a* and in which a two-channel rendering of the regular audio objects is desired.

In case of mono output the "x-1-2" processing mode can be applied with the following entries:

$$a_{1,y}^{l,m} = m_{C,y}^{l,m},\ a_{2,y}^{l,m} = 0$$

4.1.2.5 Stereo-to-Binaural "x-2-b" Processing Mode

In the following, a processing mode will be described in which regular audio objects are represented by a two-channel signal 134, 264, 322, 497*a*, and in which a binaural rendering of the regular audio objects is desired.

The upmix parameters $G^{l,m}$ and $P_2^{l,m}$ are computed as $$G^{l,m} = \begin{pmatrix} P_L^{l,m,1}\exp\left(j\frac{\phi^{l,m,1}}{2}\right)\cos(\beta^{l,m} + \alpha^{l,m}) & P_L^{l,m,2}\exp\left(j\frac{\phi^{l,m,2}}{2}\right)\cos(\beta^{l,m} + \alpha^{l,m}) \\ P_R^{l,m,1}\exp\left(-j\frac{\phi^{l,m,1}}{2}\right)\cos(\beta^{l,m} - \alpha^{l,m}) & P_R^{l,m,2}\exp\left(-j\frac{\phi^{l,m,2}}{2}\right)\cos(\beta^{l,m} - \alpha^{l,m}) \end{pmatrix},$$

$$P_2^{l,m} = \begin{pmatrix} P_L^{l,m}\exp\left(j\frac{\arg(c_{1,2}^{l,m})}{2}\right)\sin(\beta^{l,m} + \alpha^{l,m}) \\ P_R^{l,m}\exp\left(-j\frac{\arg(c_{1,2}^{l,m})}{2}\right)\sin(\beta^{l,m} - \alpha^{l,m}) \end{pmatrix}.$$

The corresponding gains, $P_L^{l,m,x}$, $P_R^{l,m,x}$ and $P_L^{l,m}$, $P_R^{l,m}$ for the left and right output channels are $$P_L^{l,m,x} = \sqrt{\max\left(\frac{f_{1,1}^{l,m,x}}{v^{l,m,x}}, \varepsilon^2\right)},\quad P_R^{l,m,x} = \sqrt{\max\left(\frac{f_{2,2}^{l,m,x}}{v^{l,m,x}}, \varepsilon^2\right)},$$

$$P_L^{l,m} = \sqrt{\max\left(\frac{c_{1,1}^{l,m}}{v^{l,m}}, \varepsilon^2\right)},\quad P_R^{l,m} = \sqrt{\max\left(\frac{f_{2,2}^{l,m}}{v^{l,m}}, \varepsilon^2\right)}.$$

The desired covariance matrix $F^{l,m,x}$ of size 2×2 with elements $f_{u,v}^{l,m,x}$ is given as $$F_{l,m,x} = A^{l,m}E^{l,m,x}(A^{l,m})^*.$$

The covariance matrix $C^{l,m}$ of size 2×2 with elements $c_{u,v}^{l,m}$ of the "dry" binaural signal is estimated as $$C_{l,m} = \tilde{G}^{l,m}D^lE^{l,m}(D^l)^*(\tilde{G}^{l,m})^*,$$

where $$\tilde{G}^{l,m} = \begin{pmatrix} P_L^{l,m,1}\exp\left(j\frac{\phi^{l,m,1}}{2}\right) & P_L^{l,m,2}\exp\left(j\frac{\phi^{l,m,2}}{2}\right) \\ P_R^{l,m,1}\exp\left(-j\frac{\phi^{l,m,1}}{2}\right) & P_R^{l,m,2}\exp\left(-j\frac{\phi^{l,m,2}}{2}\right) \end{pmatrix}.$$

The corresponding scalars $v^{l,m,x}$ and $v^{l,m}$ are computed as $$v^{l,m,x} = D^{l,x}E^{l,m}(D^{l,x})^* + \epsilon^2,\ v^{l,m} = (D^{l,1} + D^{l,2})E^{l,m}(D^{l,1} + D^{l,2})^* + \epsilon^2.$$

The downmix matrix $D^{l,x}$ of size 1×N with elements $d_i^{l,x}$ can be found as $$d_i^{l,1} = 10^{0.05DMG_i^l}\sqrt{\frac{10^{0.1DCLD_i^l}}{1 + 10^{0.1DCLD_i^l}}},$$

$$d_i^{l,2} = 10^{0.05DMG_i^l}\sqrt{\frac{1}{1 + 10^{0.1DCLD_i^l}}}.$$

The stereo downmix matrix $D^l$ of size 2×N with elements $d_{x,i}^l$ can be found as $$d_{x,i}^l = d_i^{l,x}.$$

The matrix $E^{l,m,x}$ with elements $e_{i,j}^{l,m,x}$ are derived from the following relationship $$e_{i,j}^{l,m,x} = e_{i,j}^{l,m}\left(\frac{d_i^{l,x}}{d_i^{l,1}+d_i^{l,2}}\right)\left(\frac{d_j^{l,x}}{d_j^{l,1}+d_j^{l,2}}\right).$$

The inter channel phase differences $\phi_C^{l,m}$ are given as $$\phi^{l,m,x} = \begin{cases} \arg(f_{1,2}^{l,m,x}), & 0 \le m \le 11, \quad \rho_C^{l,m} > 0.6, \\ 0, & \text{otherwise.} \end{cases}$$

The ICCs $\rho_C^{l,m}$ and $\rho_T^{l,m}$ are computed as $$\rho_T^{l,m} = \min\left(\frac{|f_{1,2}^{l,m}|}{\sqrt{\max(f_{1,1}^{l,m} f_{2,2}^{l,m}, \varepsilon^2)}}, 1\right),$$

$$\rho_C^{l,m} = \min\left(\frac{|c_{1,2}^{l,m}|}{\sqrt{\max(c_{1,1}^{l,m} c_{2,2}^{l,m}, \varepsilon^2)}}, 1\right).$$

The rotation angles $\alpha^{l,m}$ and $\beta^{l,m}$ are given as $$\alpha^{l,m} = \frac{1}{2}(\arccos(\rho_T^{l,m}) - \arccos(\rho_C^{l,m})),$$

$$\beta^{l,m} = \arctan\left(\tan(\alpha^{l,m})\frac{P_R^{l,m} - P_L^{l,m}}{P_L^{l,m} + P_R^{l,m}}\right).$$

4.1.2.6 Stereo-to-Stereo "x-2-2" Processing Mode

In the following, a processing mode will be described in which the regular audio objects are described by a two-channel (stereo) signal 134, 264, 322, 497*a* and in which a 2-channel (stereo) rendering is desired.

In case of stereo output, the stereo preprocessing is directly applied, which will be described below in Section 4.2.2.3.

4.1.2.7 Stereo-to-Mono "x-2-1" Processing Mode

In the following, a processing mode will be described in which the regular audio objects are represented by a two-channel (stereo) signal 134, 264, 322, 497*a*, and in which a one-channel (mono) rendering is desired.

In case of mono output, the stereo preprocessing is applied with a single active rendering matrix entry, as described below in Section 4.2.2.3.

4.1.2.8 Conclusion

Taking reference again to FIGS. 4*a* and 4*b*, a processing has been described which can be applied to a 1-channel or a two-channel signal 134, 264, 322, 497*a* representing the regular audio objects subsequent to a separation between the extended audio objects and the regular audio objects. FIGS. 4*a* and 4*b* illustrate the processing, wherein the processing of FIGS. 4*a* and 4*b* differs in that an optional parameter adjustment is introduced in different stages of the processing.

4.2. Operation in the Transcoding Modes 4.2.1 Introduction

In the following, a method for combining SAOC parameters and panning information (or rendering information) associated with each audio object (or with each regular audio object) in a standard compliant MPEG surround bitstream (MPS bitstream) is explained.

Figure 4F:
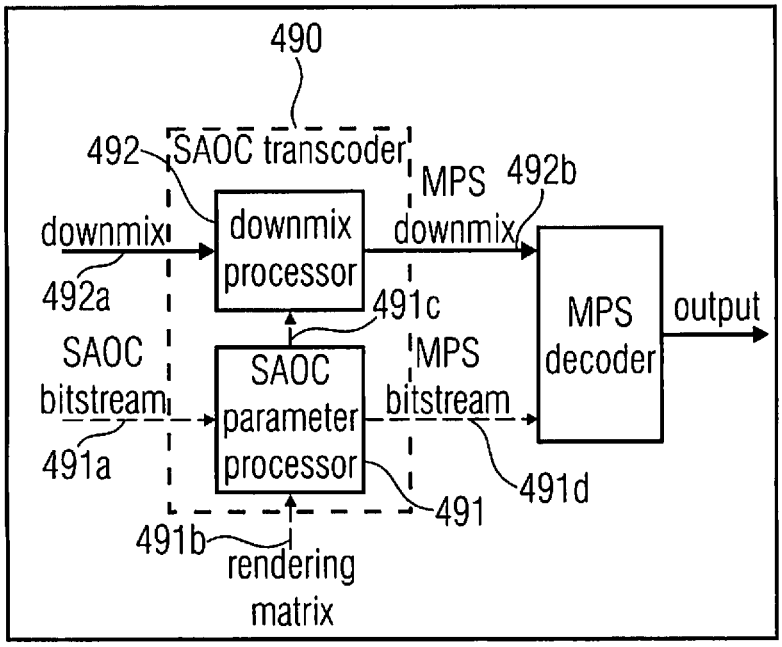
FIG. 4*f* shows a block diagram of an SAOC transcoder processing mode.
Figure 4G:
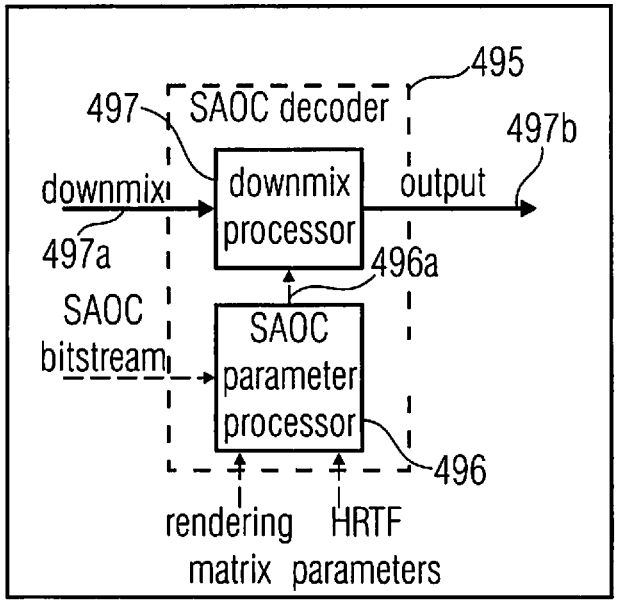
FIG. 4*g* shows a block diagram of an SAOC decoder processing mode.

The SAOC transcoder 490 is depicted in FIG. 4*f* and consists of an SAOC parameter processor 491 and a downmix processor 492 applied for a stereo downmix.

The SAOC transcoder 490 may, for example, take over the functionality of the audio signal processor 140. Alternatively, the SAOC transcoder 490 may take over the functionality of the SAOC downmix pre-processor 270 when taken in combination with the SAOC parameter processor 252.

For example, the SAOC parameter processor 491 may receive an SAOC bitstream 491*a*, which is equivalent to the object-related parametric information 110 or the SAOC bitstream 212. Also, the SAOC parameter processor 491 may receive a rendering matrix information 491*b*, which may be included in the object-related parametric information 110, or which may be equivalent to the rendering matrix information 214. The SAOC parameter processor 491 may also provide downmix processing information 491*c* to the downmix processor 492, which may be equivalent to the information 240. Moreover, the SAOC parameter processor 491 may provide an MPEG surround bitstream (or MPEG surround parameter bitstream) 491*d*, which comprises a parametric surround information which is compatible with the MPEG surround standard. The MPEG surround bitstream 491*d* may, for example, be part of the processed version 142 of the second audio information, or may, for example be part of or take the place of the MPS bitstream 222.

The downmix processor 492 is configured to receive a downmix signal 492*a*, which is a one-channel downmix signal or a two-channel downmix signal, and which is equivalent to the second audio information 134, or to the second audio object signal 264, 322. The downmix processor 492 may also provide an MPEG surround downmix signal 492*b*, which is equivalent to (or part of) the processed version 142 of the second audio information 134, or equivalent to (or part of) the processed version 272 of the second audio object signal 264.

However, there are different ways of combining the MPEG surround downmix signal 492*b* with the enhanced audio object signal 132, 262. The combination may be performed in the MPEG surround domain.

Alternatively, however, the MPEG surround representation, comprising the MPEG surround parameter bitstream 491*d* and the MPEG surround downmix signal 492*b*, of the regular audio objects may be converted back to a multi-channel time domain representation or a multi-channel frequency domain representation (individually representing different audio channels) by an MPEG surround decoder and may be subsequently combined with the enhanced audio object signals.

It should be noted that the transcoding modes comprise both one or more mono downmix processing modes and one or more stereo downmix processing modes. However, in the following only the stereo downmix processing mode will be described, because the processing of the regular audio object signals is more elaborate in the stereo downmix processing mode.

4.2.2 Downmix Processing in the Stereo Downmix ("x-2-5") Processing Mode 4.2.2.1 Introduction In the following section, a description of the SAOC transcoding mode for the stereo downmix case will be given.

The object parameters (object level difference OLD, inter-object correlation IOC, downmix gain DMG and downmix channel level difference DCMD) from the SAOC bitstream are transcoded into spatial (advantageously channel-related) parameters (channel level difference CLD, inter-channel-correlation ICC, channel prediction coefficient CPC) for the MPEG surround bitstream according to the rendering information. The downmix is modified according to object parameters and a rendering matrix.

Taking reference now to FIGS. 4*c*, 4*d* and 4*e*, an overview of the processing, and in particular of the downmix modification, will be given.

FIG. 4*c* shows a block representation of a processing which is performed for modifying the downmix signal, for example the downmix signal 134, 264, 322, 492*a* describing the one or more regular audio objects. As can be seen from FIGS. 4*c*, 4*d* and 4*e*, the processing receives a rendering matrix $M_{ren}$, a downmix gain information DMG, a downmix channel level difference information DCLD, an object level difference information OLD, and an inter-object-correlation information IOC. The rendering matrix may optionally be modified by a parameter adjustment, as it is shown in FIG. 4*c*. Entries of a downmix matrix D are obtained in dependence on the downmix gain information DMG and the downmix channel level difference information DCLD. Entries of a coherence matrix E are obtained in dependence on the object level difference information OLD and the inter-object correlation information IOC. In addition, a matrix J may be obtained in dependence on the downmix matrix D and the coherence matrix E, or in dependence on the entries thereof. Subsequently, a matrix $C_3$ may be obtained in dependence on the rendering matrix $M_{ren}$, the downmix matrix D, the coherence matrix E and the matrix J. A matrix G may be obtained in dependence on a matrix $D_{TTT}$, which may be a matrix having predetermined entries, and also in dependence on the matrix $C_3$. The matrix G may, optionally, be modified, to obtain a modified matrix $G_{mod}$. The matrix G or the modified version $G_{mod}$ thereof may be used to derive the processed version 142, 272,492*b* of the second audio information 134, 264 from the second audio information 134, 264,492*a* (wherein the second audio information 134, 264 is designed with X, and wherein the processed version 142, 272 thereof is designated with $\hat{X}$.

In the following, the rendering of the object energy, which is performed in order to obtain the MPEG surround parameters, will be discussed. Also, the stereo preprocessing, which is performed in order to obtain the processed version 142, 272,492*b* of the second audio information 134, 264,492*a* representing the regular audio objects will be described.

4.2.2.2 Rendering of Object Energies

The transcoder determines the parameters for the MPS decoder according to the target rendering as described by the rendering matrix $M_{ren}$. The six channel target covariance is denoted with F and given by $$F=YY^*=M_{ren}S(M_{ren}S)^*=M_{ren}(SS^*)$$
$$M^*_{ren}=M_{ren}EM^*_{ren}.$$

The transcoding process can conceptually be divided into two parts. In one part a three channel rendering is performed to a left, right and center channel. In this stage the parameters for the downmix modification as well as the prediction parameters for the TTT box for the MPS decoder are obtained. In the other part the CLD and ICC parameters for the rendering between the front and surround channels (OTT parameters, left front—left surround, right front—right surround) are determined.

4.2.2.2.1 Rendering to Left, Right and Center Channel

In this stage the spatial parameters are determined that control the rendering to a left and right channel, consisting of front and surround signals. These parameters describe the prediction matrix of the TTT box for the MPS decoding $C_{TTT}$ (CPC parameters for the MPS decoder) and the downmix converter matrix G.

$C_{TTT}$ is the prediction matrix to obtain the target rendering from the modified downmix $\hat{X}=GX$:

$$C_{TTT}\hat{X}=C_{TTT}GX\approx A_3S.$$

$A_3$ is a reduced rendering matrix of size 3×N, describing the rendering to the left, right and center channel respectively. It is obtained as $A_3=D_{36}M_{ren}$ with the 6 to 3 partial downmix matrix $D_{36}$ defined by $$D_{36}=\begin{pmatrix} w_1 & 0 & 0 & 0 & w_1 & 0 \\ 0 & w_2 & 0 & 0 & 0 & w_2 \\ 0 & 0 & w_3 & w_3 & 0 & 0 \end{pmatrix}.$$

The partial downmix weights $w_p$, p=1, 2, 3 are adjusted such that the energy of $w_p(y_{2p-1}+y_{2p})$ is equal to the sum of energies $\|y_{2p-1}\|^2+\|y_{2p}\|^2$ to a limit factor.

$$w_1=\frac{f_{1,1}+f_{5,5}}{f_{1,1}+f_{5,5}+2f_{1,5}},$$
$$w_2=\frac{f_{2,2}+f_{6,6}}{f_{2,2}+f_{6,6}+2f_{2,6}},$$
$$w_3=0.5,$$

where $f_{i,j}$ denote the elements of F.

For the estimation of the desired prediction matrix $C_{TTT}$ and the downmix preprocessing matrix G we define a prediction matrix $C_3$ of size 3×2, that leads to the target rendering $$C_3X\approx A_3S.$$

Such a matrix is derived by considering the normal equations $$C_3(DED^*)\approx A_3ED^*.$$

The solution to the normal equations yields the best possible waveform match for the target output given the object covariance model. G and $C_{TTT}$ are now obtained by solving the system of equations $$C_{TTT}G=C_3.$$

To avoid numerical problems when calculating the term $J=(DED^*)^{-1}$, J is modified. First the eigenvalues $\lambda_{1,2}$ of J are calculated, solving $\det(J-\lambda_{1,2}I)=0$.

Eigenvalues are sorted in descending ($\lambda_1\geq\lambda_2$) order and the eigenvector corresponding to the larger eigenvalue is calculated according to the equation above. It is assured to lie in the positive x-plane (first element has to be positive). The second eigenvector is obtained from the first by a −90 degrees rotation:

$$J=(v_1v_2)\begin{pmatrix}\lambda_1 & 0\\ 0 & \lambda_2\end{pmatrix}(v_1v_2)^*.$$

A weighting matrix is computed from the downmix matrix D and the prediction matrix $C_3$, $W=(D\ \mathrm{diag}(C_3))$.

Since $C_{TTT}$ is a function of the MPS prediction parameters $c_1$ and $c_2$ (as defined in ISO/IEC 23003-1:2007), $C_{TTT}G=C_3$ is rewritten in the following way, to find the stationary point or points of the function, $$\Gamma\begin{pmatrix}\tilde{c}_1\\ \tilde{c}_2\end{pmatrix}=b,$$

with $\Gamma=(D_{TTT}C_3)w(D_{TTT}C_3)^*$ and $b=GWC_3v$, where $$D_{TTT}=\begin{pmatrix}1 & 0 & 1\\ 0 & 1 & 1\end{pmatrix}$$

and v=(1 1 −1).

If $\Gamma$ does not provide a unique solution ($\det(\Gamma)<10^{-3}$), the point is chosen that lies closest to the point resulting in a TTT pass through. As a first step, the row i of $\Gamma$ is chosen $\gamma=[\gamma_{i,1}\ \gamma_{i,2}]$ where the elements contain most energy, thus $\gamma_{i,1}^2+\gamma_{i,2}^2\geq\gamma_{j,1}^2+\gamma_{j,2}^2$, j=1, 2. Then a solution is determined such that $$\begin{pmatrix}\tilde{c}_1\\ \tilde{c}_2\end{pmatrix}=\begin{pmatrix}1\\ 1\end{pmatrix}-3y \text{ with } y=\frac{b_{i,3}}{\left(\sum_{j=1,2}(\gamma_{i,j})^2\right)+\varepsilon}\gamma^T.$$

If the obtained solution for $\tilde{c}_1$ and $\tilde{c}_2$ is outside the allowed range for prediction coefficients that is defined as $-2\leq\tilde{c}_j\leq 3$ (as defined in ISO/IEC 23003-1:2007), $\tilde{c}_j$ shall be calculated according to below.

First define the set of points, $x_p$ as:

$$x_p\in\begin{bmatrix}\begin{pmatrix}\min\left(3,\max\left(-2,-\frac{-2\gamma_{1,2}-b_1}{\gamma_{1,1}+\varepsilon}\right)\right)\\ -2\end{pmatrix}, & \begin{pmatrix}\min\left(3,\max\left(-2,-\frac{3\gamma_{1,2}-b_1}{\gamma_{1,1}+\varepsilon}\right)\right)\\ 3\end{pmatrix}\\ \begin{pmatrix}-2\\ \min\left(3,\max\left(-2,-\frac{-2\gamma_{2,2}-b_2}{\gamma_{2,2}+\varepsilon}\right)\right)\end{pmatrix}, & \begin{pmatrix}3\\ \min\left(3,\max\left(-2,-\frac{3\gamma_{2,1}-b_2}{\gamma_{2,2}+\varepsilon}\right)\right)\end{pmatrix}\end{bmatrix},$$

and the distance function, $$\text{distFunc}(x_p)=x^*_p\Gamma x_{p1}-2bx_p.$$

Then the prediction parameters are defined according to:

$$\begin{pmatrix}\tilde{c}_1\\ \tilde{c}_2\end{pmatrix}=\underset{x\in x_p}{\operatorname{argmin}}\,(distFunc(x)).$$

The prediction parameters are constrained according to:

$$c_1=(1-\lambda)\tilde{c}_1+\lambda\gamma_1,\ c_2=(1-\lambda)\tilde{c}_2+\lambda\gamma_2,$$

where $\lambda$, $\gamma_1$ and $\gamma_2$ are defined as $$\gamma_1=\frac{2f_{1,1}+2f_{5,5}-f_{3,3}+f_{1,3}+f_{5,3}}{2f_{1,1}+2f_{5,5}+2f_{3,3}+4f_{1,3}+4f_{5,3}},$$

$$\gamma_2=\frac{2f_{2,2}+2f_{6,6}-f_{3,3}+f_{2,3}+f_{6,3}}{2f_{2,2}+2f_{6,6}+2f_{3,3}+4f_{2,3}+4f_{6,3}},$$

$$\lambda=\left(\frac{(f_{1,2}+f_{1,6}+f_{5,2}+f_{5,6}+f_{1,3}+f_{5,3}+f_{2,3}+f_{6,3}+f_{3,3})^2}{\begin{matrix}(f_{1,1}+f_{5,5}+f_{3,3}+2f_{1,3}+2f_{5,3})\\ (f_{2,2}+f_{6,6}+f_{3,3}+2f_{2,3}+2f_{6,3})\end{matrix}}\right)^8.$$

For the MPS decoder, the CPCs and corresponding $ICC_{TTT}$ are provided as follows $$D_{CPC_1}=c_1(l,m),\ D_{CPC_2}=c_2(l,m) \text{ and } D_{ICC_{TTT}}=1.$$

4.2.2.2.2 Rendering Between Front and Surround Channels

The parameters that determine the rendering between front and surround channels can be estimated directly from the target covariance matrix F $$CLD_{a,b}=10\log_{10}\left(\frac{\max(f_{a,a},\varepsilon^2)}{\max(f_{b,b},\varepsilon^2)}\right),$$

-continued $$ICC_{a,b}=\frac{\max(f_{a,b},\varepsilon^2)}{\sqrt{\max(f_{a,a},\varepsilon^2)\max(f_{b,b},\varepsilon^2)}},$$

with (a,b)=(1,2) and (3,4).

The MPS parameters are provided in the form $$CLD_h^{l,m}=D_{CLD}(h,l,m) \text{ and } ICC_h^{l,m}=D_{ICC}(h,l,m),$$

for every OTT box h.

4.2.2.3 Stereo Processing

In the following, a stereo processing of the regular audio object signal 134 to 64, 322 will be described. The stereo processing is used to derive a process to general representation 142, 272 on the basis of a two-channel representation of the regular audio objects.

The stereo downmix X, which is represented by the regular audio object signals 134, 264, 492*a* is processed into the modified downmix signal $\hat{X}$, which is represented by the processed regular audio object signals 142, 272:

$$\hat{X}=GX,$$

where $$G=D_{TTT}C_3=D_{TTT}M_{ren}ED^*J.$$

The final stereo output from the SAOC transcoder $\hat{X}$ is produced by mixing X with a decorrelated signal component according to:

$$\hat{X}=G_{Mod}X+P_2X_d,$$

where the decorrelated signal $X_d$ is calculated as described above, and the mix matrices $G_{Mod}$ and $P_2$ according to below.

First, define the render upmix error matrix as $$R=A_{diff}EA^*_{diff},$$

where $$A_{diff}=D_{TTT}A_3-GD,$$

and moreover define the covariance matrix of the predicted signal $\hat{R}$ as $$\hat{R}=\begin{pmatrix}\hat{r}_{1,1} & \hat{r}_{1,2}\\ \hat{r}_{2,1} & \hat{r}_{2,2}\end{pmatrix}=GDED^*G^*.$$

The gain vector $g_{vec}$ can subsequently be calculated as:

$$g_{vec}=\left(\min\left(\sqrt{\max\left(\frac{\hat{r}_{1,1}+r_{1,1}+\varepsilon^2}{r_{1,1}+\varepsilon^2},0\right)},1.5\right)\right.$$

-continued $$\min\left(\sqrt{\max\left(\frac{\hat{r}_{2,2}+r_{2,2}+\varepsilon^2}{r_{2,2}+\varepsilon^2},0\right)},1.5\right)\Bigg),$$

and the mix matrix $G_{Mod}$ is given as:

$$G_{Mod}=\begin{cases}\mathrm{diag}(g_{vec})G, & r_{1,2}>0,\\ G, & \text{otherwise.}\end{cases}$$

Similarly, the mix matrix $P_2$ is given as:

$$P_2=\begin{cases}\begin{pmatrix}0&0\\0&0\end{pmatrix}, & r_{1,2}>0,\\ v_R\,\mathrm{diag}(W_d), & \text{otherwise.}\end{cases}$$

To derive $v_R$ and $W_d$, the characteristic equation of R needs to be solved:

$\det(R-\lambda_{1,2}I)=0$, giving the eigenvalues, $\lambda_1$ and $\lambda_2$.

The corresponding eigenvectors $v_{R1}$ and $v_{R2}$ of R can be calculated solving the equation system:

$(R-\lambda_{1,2}I)v_{R1,R2}=0$.

Eigenvalues are sorted in descending ($\lambda_1\geq\lambda_2$) order and the eigenvector corresponding to the larger eigenvalue is calculated according to the equation above. It is assured to lie in the positive x-plane (first element has to be positive). The second eigenvector is obtained from the first by a −90 degrees rotation:

$$R=(v_{R1}v_{R2})\begin{pmatrix}\lambda_1&0\\0&\lambda_2\end{pmatrix}(v_{R1}v_{R2})^*.$$

Incorporating $P_1=(1\ 1)G$, $R_d$ can be calculated according to:

$$R_d=\begin{pmatrix}r_{d11}&r_{d12}\\r_{d21}&r_{d22}\end{pmatrix}=\mathrm{diag}(P_1(DED^*)P_1^*),$$

which gives $$w_{d1}=\min\left(\sqrt{\frac{\lambda_1}{r_{d1}+\varepsilon}},2\right),$$

$$w_{d2}=\min\left(\sqrt{\frac{\lambda_2}{r_{d2}+\varepsilon}},2\right),$$

and finally the mix matrix, $$P_2=(v_{R1}\quad v_{R2})\begin{pmatrix}w_{d1}&0\\0&w_{d2}\end{pmatrix}.$$

4.2.2.4 Dual Mode

The SAOC transcoder can let the mix matrices $P_1$, $P_2$ and the prediction matrix $C_3$ be calculated according to an alternative scheme for the upper frequency range. This alternative scheme is particularly useful for downmix signals where the upper frequency range is coded by a non-waveform preserving coding algorithm e.g. SBR in High Efficiency AAC.

For the upper parameter bands, defined by bsTttBandsLow≤pb<numBands, $P_1$, $P_2$ and $C_3$ should be calculated according to the alternative scheme described below:

$$\begin{cases}P_1=\begin{pmatrix}0&0\\0&0\end{pmatrix},\\ P_2=G.\end{cases}$$

Define the energy downmix and energy target vectors, respectively:

$$\begin{cases}e_{dmx}=\begin{pmatrix}e_{dmx1}\\e_{dmx2}\end{pmatrix}=\mathrm{diag}(DED^*)+\varepsilon I,\\ e_{tar}=\begin{pmatrix}e_{tar1}\\e_{tar2}\\e_{tar3}\end{pmatrix}=\mathrm{diag}(A_3EA_3^*),\end{cases}$$

and the help matrix $$T=\begin{pmatrix}t_{1,1}&t_{1,2}\\t_{2,1}&t_{2,2}\\t_{3,1}&t_{3,2}\end{pmatrix}=A_3D^*+\varepsilon I.$$

Then calculate the gain vector $$g=\begin{pmatrix}g_1\\g_2\\g_3\end{pmatrix}=\begin{pmatrix}\sqrt{\dfrac{e_{tar1}}{t_{1,1}^2e_{dmx1}+t_{1,2}^2e_{dmx2}}}\\ \sqrt{\dfrac{e_{tar2}}{t_{2,1}^2e_{dmx1}+t_{2,2}^2e_{dmx2}}}\\ \sqrt{\dfrac{e_{tar3}}{t_{3,1}^2e_{dmx1}+t_{3,2}^2e_{dmx2}}}\end{pmatrix},$$

which finally gives the new prediction matrix $$C_3=\begin{pmatrix}g_1t_{1,1}&g_1t_{1,2}\\g_2t_{2,1}&g_2t_{2,2}\\g_3t_{3,1}&g_3t_{3,2}\end{pmatrix}.$$

5. Combined EKS SAOC Decoding/Transcoding Mode, Encoder According to FIG. 10 and Systems According to FIGS. 5*a*, 5*b*

In the following, a brief description of the combined EKS SAOC processing scheme will be given. A "combined EKS SAOC" processing scheme is proposed, where the EKS processing is integrated into the regular SAOC decoding/transcoding chain by a cascaded scheme.

5.1. Audio Signal Encoder According to FIG. 5

In a first step, objects dedicated to EKS processing (enhanced Karaoke/solo processing) are identified as foreground objects (FGO) and their number $N_{FGO}$ (also designated as $N_{EAO}$) is determined by a bitstream variable "bsNumGroupsFGO". Said bitstream variable may, for example, be included in an SAOC bitstream, as described above.

For the generation of the bitstream (in an audio signal encoder), the parameters of all input objects $N_{obj}$ are reordered such that the foreground objects FGO comprise the last $N_{FGO}$ (or alternatively, $N_{EAO}$) parameters in each case, for example, $OLD_i$ for $[N_{obj}-N_{FGO} \leq i \leq N_{obj}-1]$.

From the remaining objects which are, for example, background objects BGO or non-enhanced audio objects, a downmix signal in the "regular SAOC style" is generated which at the same time serves as a background object BGO. Next, the background object and the foreground objects are downmixed in the "EKS processing style" and residual information is extracted from each foreground object. This way, no extra processing steps need to be introduced. Thus, no change of the bitstream syntax is necessitated.

In other words, at the encoder side, non-enhanced audio objects are distinguished from enhanced audio objects. A one-channel or two-channels regular audio objects downmix signal is provided which represents the regular audio objects (non-enhanced audio objects), wherein there may be one, two or even more regular audio objects (non-enhanced audio objects). The one-channel or two-channel regular audio object downmix signal is then combined with one or more enhanced audio object signals (which may, for example, be one-channel signals or two-channel signals), to obtain a common downmix signal (which may, for example, be a one-channel downmix signal or a two-channel downmix signal) combining the audio signals of the enhanced audio objects and the regular audio object downmix signal.

Figure 10:
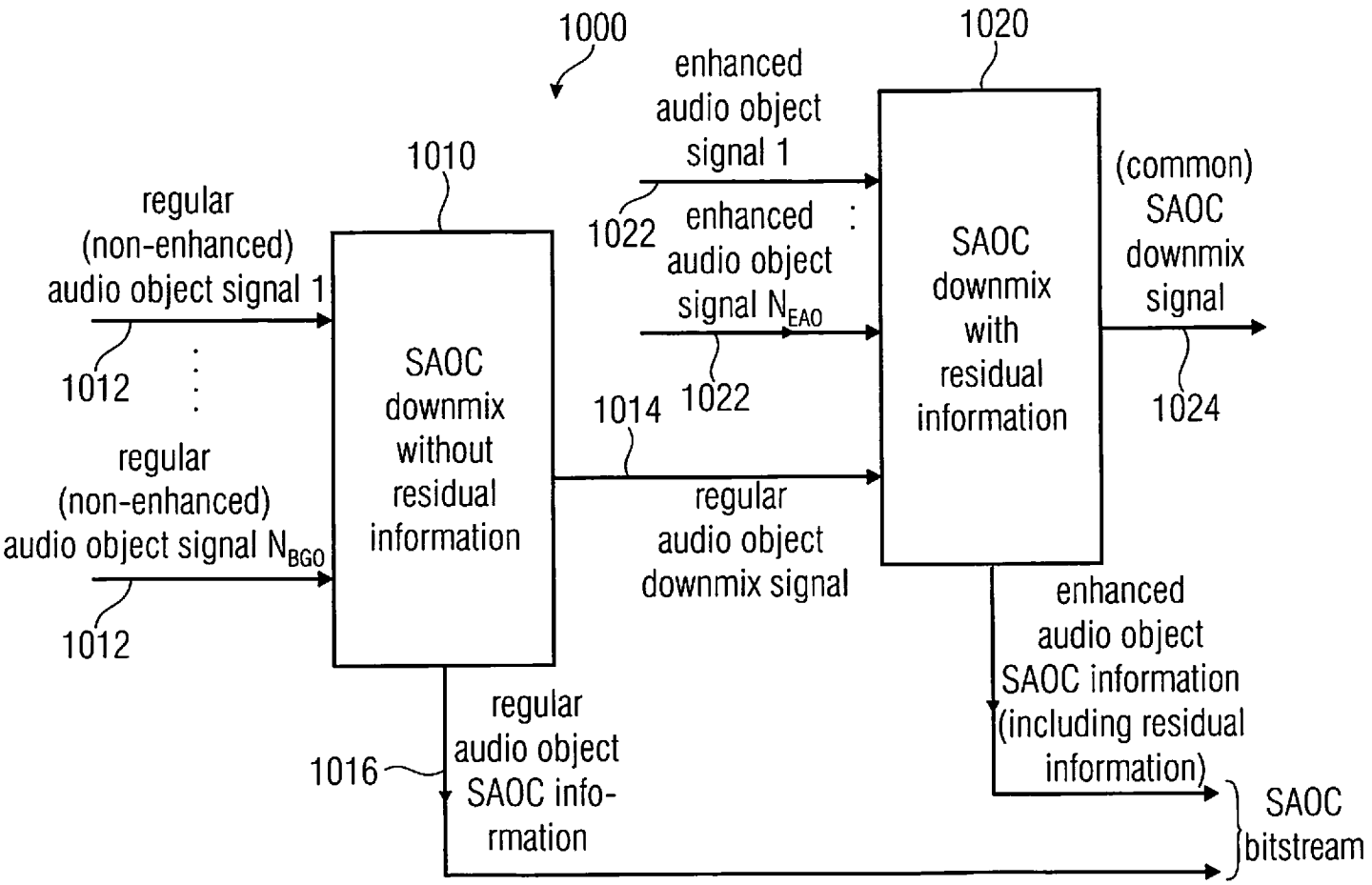
FIG. 10 shows a block schematic representation of an SAOC encoder.

In the following, the basic structure of such a cascaded encoder will be briefly described taking reference to FIG. 10, which shows a block schematic representation of an SAOC encoder 1000, according to an embodiment of the invention. The SAOC encoder 1000 comprises a first SAOC downmixer 1010, which is typically an SAOC downmixer which does not provide a residual information. The SAOC downmixer 1010 is configured to receive a plurality of $N_{BGO}$ audio object signals 1012 from regular (non-enhanced) audio objects. Also, the SAOC downmixer 1010 is configured to provide a regular audio object downmix signal 1014 on the basis of the regular audio objects 1012, such that the regular audio object downmix signal 1014 combines the regular audio objects signals 1012 in accordance with downmix parameters. The SAOC downmixer 1010 also provides a regular audio object SAOC information 1016, which describes the regular audio object signals and the downmix. For example, the regular audio object SAOC information 1016 may comprise a downmix gain information DMG and a downmix channel level difference information DCLD describing the downmix performed by the SAOC downmixer 1010. In addition, the regular audio object SAOC information 1016 may comprise an object level difference information and an inter-object correlation information describing a relationship between the regular audio objects described by the regular audio object signal 1012.

The encoder 1000 also comprises a second SAOC downmixer 1020, which is typically configured to provide a residual information. The second SAOC downmixer 1020 is configured to receive one or more enhanced audio object signals 1022 and also to receive the regular audio object downmix signal 1014.

The second SAOC downmixer 1020 is also configured to provide a common SAOC downmix signal 1024 on the basis of the enhanced audio object signals 1022 and the regular audio object downmix signal 1014. When providing the common SAOC downmix signal, the second SAOC downmixer 1020 typically treats the regular audio object downmix signal 1014 as a single one-channel or two-channel object signal.

The second SAOC downmixer 1020 is also configured to provide an enhanced audio object SAOC information which describes, for example, downmix channel level difference values DCLD associated with the enhanced audio objects, object level difference values OLD associated with the enhanced audio objects and inter-object correlation values IOC associated with the enhanced audio objects. In addition, the second SAOC 1020 is configured to provide residual information associated with each of the enhanced audio objects, such that the residual information associated with the enhanced audio objects describes the difference between an original individual enhanced audio object signal and an expected individual enhanced audio object signal which can be extracted from the downmix signal using the downmix information DMG, DCLD and the object information OLD, IOC.

The audio encoder 1000 is well-suited for cooperation with the audio decoder described herein.

5.2. Audio Signal Decoder According to FIG. 5*a*

Figure 5A:
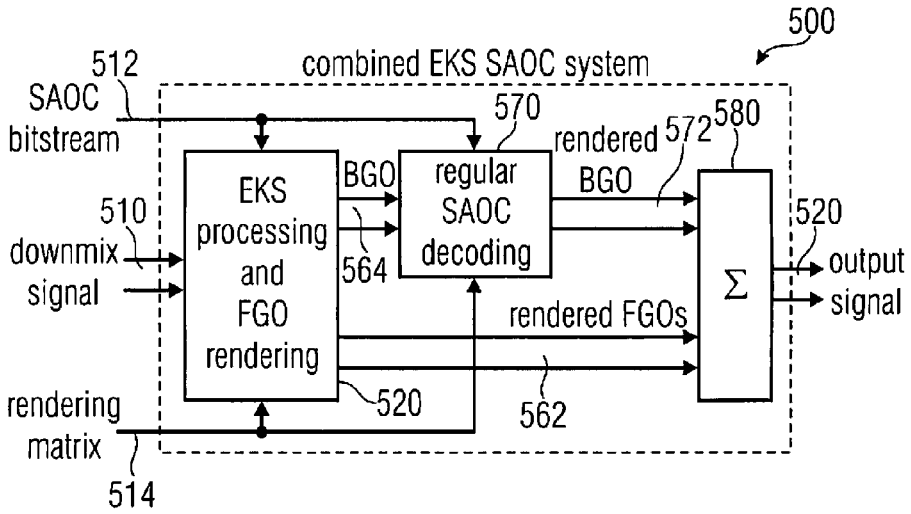
FIG. 5*a* shows a block schematic diagram of an audio signal decoder, according to an embodiment of the invention.

In the following, the basic structure of a combined EKS SAOC decoder 500, a block schematic diagram of which is shown in FIG. 5*a* will be described.

The audio decoder 500 according to FIG. 5*a* is configured to receive a downmix signal 510, an SAOC bitstream information 512 and a rendering matrix information 514. The audio decoder 500 comprises an enhanced Karaoke/Solo processing and a foreground object rendering 520, which is configured to provide a first audio object signal 562, which describes rendered foreground objects, and a second audio object signal 564, which describes the background objects. The foreground objects may, for example, be so-called "enhanced audio objects" and the background objects may, for example, be so-called "regular audio objects" or "non-enhanced audio objects". The audio decoder 500 also comprises regular SAOC decoding 570, which is configured to receive the second audio object signal 562 and to provide, on the basis thereof, a processed version 572 of the second audio object signal 564. The audio decoder 500 also comprises a combiner 580, which is configured to combine the first audio object signal 562 and the processed version 572 of the second audio object signal 564, to obtain an output signal 520.

In the following, the functionality of the audio decoder 500 will be discussed in some more detail. At the SAOC decoding/transcoding side, the upmix process results in a cascaded scheme comprising firstly an enhanced Karaoke-Solo processing (EKS processing) to decompose the downmix signal into the background object (BOO) and foreground objects (FGOs). The necessitated object level differences (OLDs) and inter-object correlations (IOCs) for the background object are derived from the object and downmix information (which is both object-related parametric information, and which is both typically included in the SAOC bitstream):

$$OLD_L = \sum_{i=0}^{N-N_{FGO}-1} d_{0,i}^2 OLD_i$$

$$OLD_R = \sum_{i=0}^{N-N_{FGO}-1} d_{1,i}^2 OLD_i,$$

$$IOC_{LR} = \begin{cases} IOC_{0,1}, & N - N_{FGO} = 2, \\ 0, & \text{otherwise.} \end{cases}$$

In addition, this step (which is typically executed by the EKS processing and foreground object rendering 520)

includes mapping the foreground objects to the final output channels (such that, for example, the first audio object signal 562 is a multi-channel signal in which the foreground objects are mapped to one or more channels each). The background object (which typically comprises a plurality of so-called "regular audio objects") is rendered to the corresponding output channels by a regular SAOC decoding process (or, alternatively, in some cases by an SAOC transcoding process). This process may, for example, be performed by the regular SAOC decoding 570. The final mixing stage (for example, the combiner 580) provides a desired combination of rendered foreground objects and background object signals at the output.

This combined EKS SAOC system represents a combination of all beneficial properties of the regular SAOC system and its EKS mode. This approach allows to achieve the corresponding performance using the proposed system with the same bitstream for both classic (moderate rendering) and Karaoke/Solo-similar (extreme rendering) playback scenarios.

5.3. Generalized Structure According to FIG. 5*b*

In the following, a generalized structure of a combined EKS SAOC system 590 will be described taking reference to FIG. 5*b*, which shows a block schematic diagram of such a generalized combined EKS SAOC system. The combined EKS SAOC system 590 of FIG. 5*b* may also be considered as an audio decoder.

The combined EKS SAOC system 590 is configured to receive a downmix signal 510*a*, an SAOC bitstream information 512*a* and the rendering matrix information 514*a*. Also, the combined EKS SAOC system 590 is configured to provide an output signal 520*a* on the basis thereof.

The combined EKS SAOC system 590 comprises an SAOC type processing stage i 520*a*, which receives the downmix signal 510*a*, the SAOC bitstream information 512*a* (or at least a part thereof) and the rendering matrix information 514*a* (or at least a part thereof). In particular, the SAOC type processing stage I 520*a* receives first stage object level difference values ($OLD_s$). The SAOC type processing stage I 520*a* provides one or more signals 562*a* describing a first set of objects (for example, audio objects of a first audio object type). The SAOC type processing stage I 520*a* also provides one or more signal 564*a* describing a second set of objects.

The combined EKS SAOC system also comprises an SAOC type processing stage II 570*a*, which is configured to receive the one or more signals 564*a* describing the second set of objects and to provide, on the basis thereof, one or more signals 572*a* describing a third set of objects using second stage object level differences, which are included in the SAOC bitstream information 512*a*, and also at least a part of the rendering matrix information 514. The combined EKS SAOC system also comprises a combiner 580*a*, which may, for example, be a summer, to provide the output signals 520*a* by combining the one or more signals 562*a* describing the first set of objects and the one or more signals 570*a* describing the third set of objects (wherein the third set of objects may be a processed version of the second set of objects).

Figure 5B:
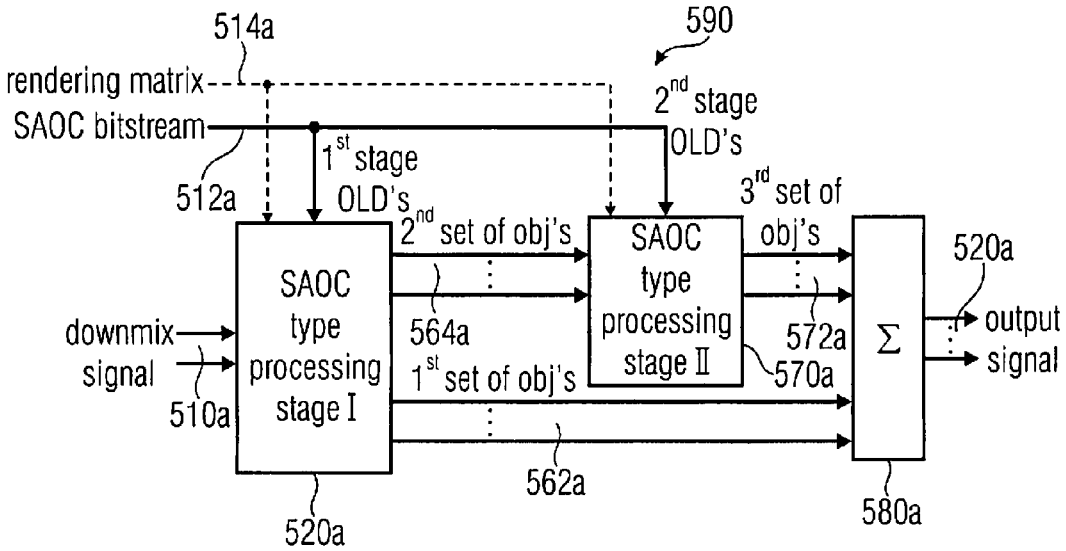
FIG. 5*b* shows a block schematic diagram of another audio signal decoder, according to an embodiment of the invention.

To summarize the above, FIG. 5*b* shows a generalized form of the basic structure described with reference to FIG. 5*a* above in a further embodiment of the invention.

6. Perceptual Evaluation of the Combined EKS SAOC Processing Scheme 6.1 Test Methodology, Design and Items This subjective listening tests were conducted in an acoustically isolated listening room that is designed to permit high-quality listening. The playback was done using headphones (STAX SR Lambda Pro with Lake-People D/A-Converter and STAX SRM-Monitor). The test method followed the standard procedures used in the spatial audio verification tests, based on the "multiple stimulus with hidden reference and anchors" (MUSHRA) method for the subjective assessment of intermediate quality audio (see reference [7]).

A total of eight listeners participated in the performed test. All subjects can be considered experienced listeners. In accordance with the MUSHRA methodology, the listeners were instructed to compare all test conditions against the reference. The test conditions were randomized automatically for each test item and for each listener. The subjective responses were recorded by a computer-based MUSHRA program on a scale ranging from 0 to 100. An instantaneous switching between the items under test was allowed. The MUSHRA test has been conducted in order to assess the perceptual performance of the considered SAOC modes and the proposed system described in the table of FIG. 6*a*, which provides a listening test design description.

The corresponding downmix signals were coded using an AAC core-coder with a bitrate of 128 kbps. In order to assess the perceptual quality of the proposed combined EKS SAOC system, it is compared against the regular SAOC RM system (SAOC reference model system) and the current EKS mode (enhanced-Karaoke-Solo mode) for two different rendering test scenarios described in the table of FIG. 6*b*, which describes the systems under test.

Residual coding with a bit rate of 20 kbps was applied for the current EKS mode and a proposed combined EKS SAOC system. It should be noted that for the current EKS mode it is necessitated to generate a stereo background object (BGO) prior to the actual encoding/decoding procedure, since this mode has limitations on the number and type of input objects.

The listening test material and the corresponding downmix and rendering parameters used in the performed tests have been selected from the set of the call-for-proposals (CfP) audio items described in the document [2]. The corresponding data for "Karaoke" and "Classic" rendering application scenarios can be found in the table of FIG. 6*c*, which describes listening test items and rendering matrices.

6.2 Listening Test Results

Figure 6D:
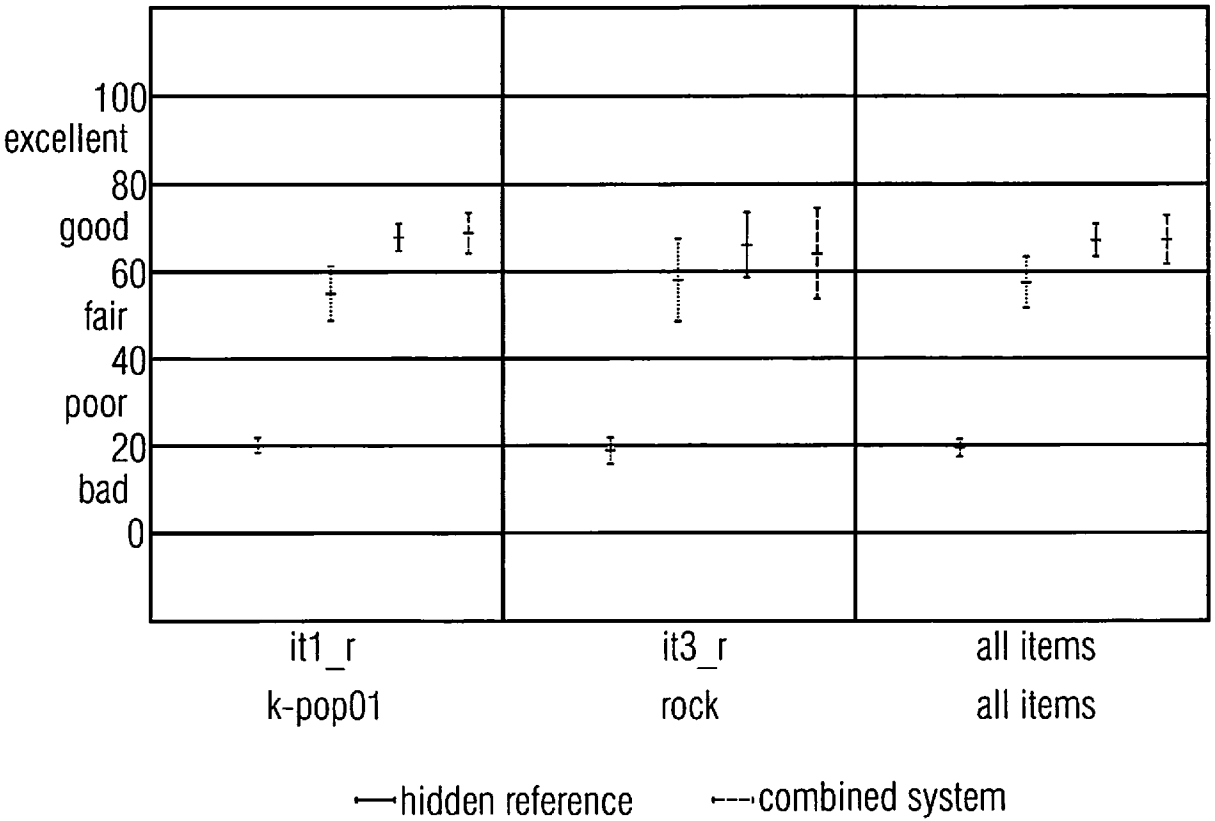
FIG. 6*d* shows a graphical representation of average MUSHRA scores for a Karaoke/Solo type rendering listening test.
Figure 6E:
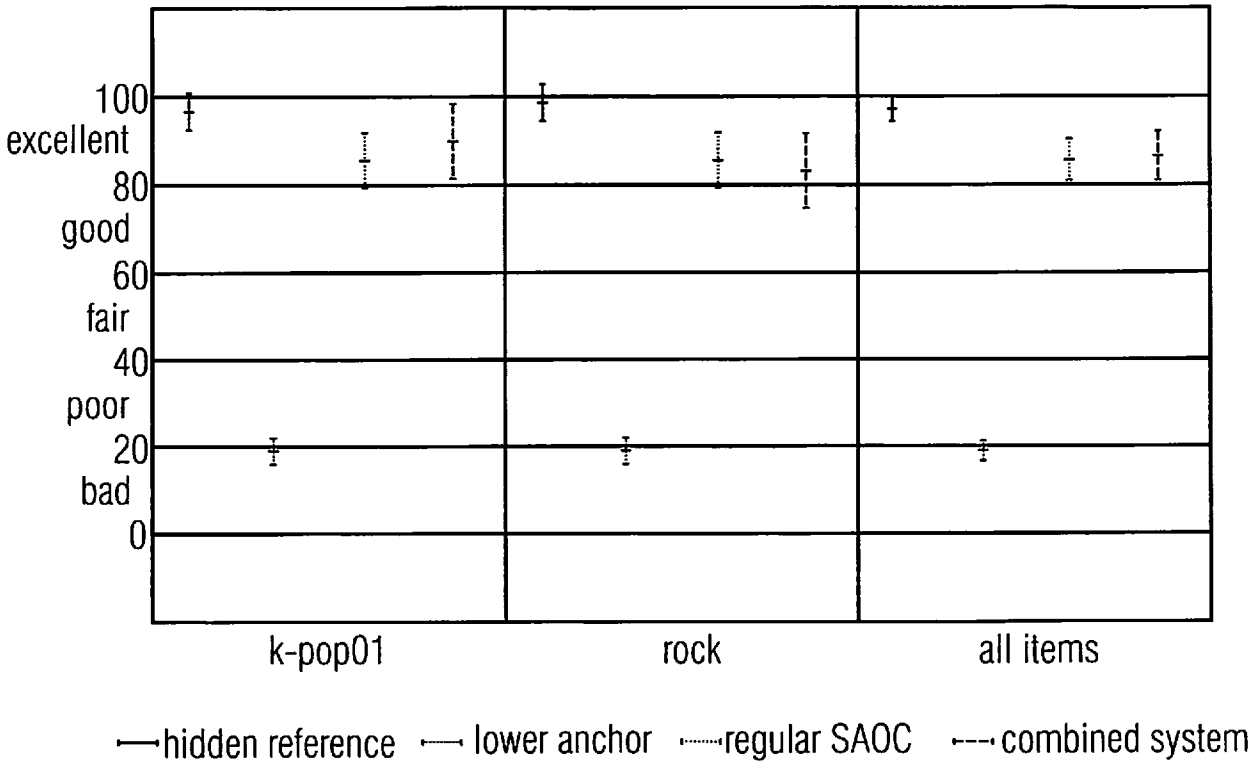
FIG. 6*e* shows a graphical representation of average MUSHRA scores for a classic rendering listening test.

A short overview in terms of the diagrams demonstrating the obtained listening test results can be found in FIGS. 6*d* and 6*e*, wherein FIG. 6*d* shows average MUSHRA scores for the Karaoke/Solo type rendering listening test, and FIG. 6*e* shows average MUSHRA scores for the classic rendering listening test. The plots show the average MUSHRA grading per item over all listeners and the statistical mean value over all evaluated items together with the associated 95% confidence intervals.

The following conclusions can be drawn based upon the results of the conducted listening tests:

- FIG. 6*d* represents the comparison for the current EKS mode with the combined EKS SAOC system for Karaoke-type of applications. For all tested items no significant difference (in the statistical sense) in performance between these two systems can be observed. From this observation it can be concluded that the combined EKS SAOC system is able to efficiently exploit the residual information reaching the performance of the EKS mode. One can also note that the performance of the regular SAOC system (without residual) is below both other systems.
- FIG. 6*e* represents the comparison of the current regular SAOC with the combined EKS SAOC system for classic rendering scenarios. For all tested items the performance of these two systems is statistically the same. This demonstrates the proper functionality of the combined EKS SAOC system for a classic rendering scenario.

Therefore, it can be concluded that the proposed unified system combining the EKS mode with the regular SAOC preserves the advantages in subjective audio quality for the corresponding types of a rendering.

Taking into account the fact that the proposed combined EKS SAOC system has no longer restrictions on the BGO object, but has entirely flexible rendering capability of the regular SAOC mode and can use the same bitstream for all types of rendering, it appears to be advantageous to incorporate it into the MPEG SAOC standard.

7. Method According to FIG. 7

In the following, a method for providing an upmix signal representation in dependence on a downmix signal representation and an object-related parametric information will be described with reference to FIG. 7, which shows a flowchart of such a method.

The method 700 comprises a step 710 of decomposing a downmix signal representation, to provide a first audio information describing a first set of one or more audio objects of a first audio object type and a second audio information describing a second set of one or more audio objects of a second audio object type in dependence on the downmix signal representation and at least a part of the object-related parametric information. The method 700 also comprises a step 720 of processing the second audio information in dependence on the object-related parametric information, to obtain a processed version of the second audio information.

The method 700 also comprises a step 730 of combining the first audio information with the processed version of the second audio information, to obtain the upmix signal representation.

Figure 7:
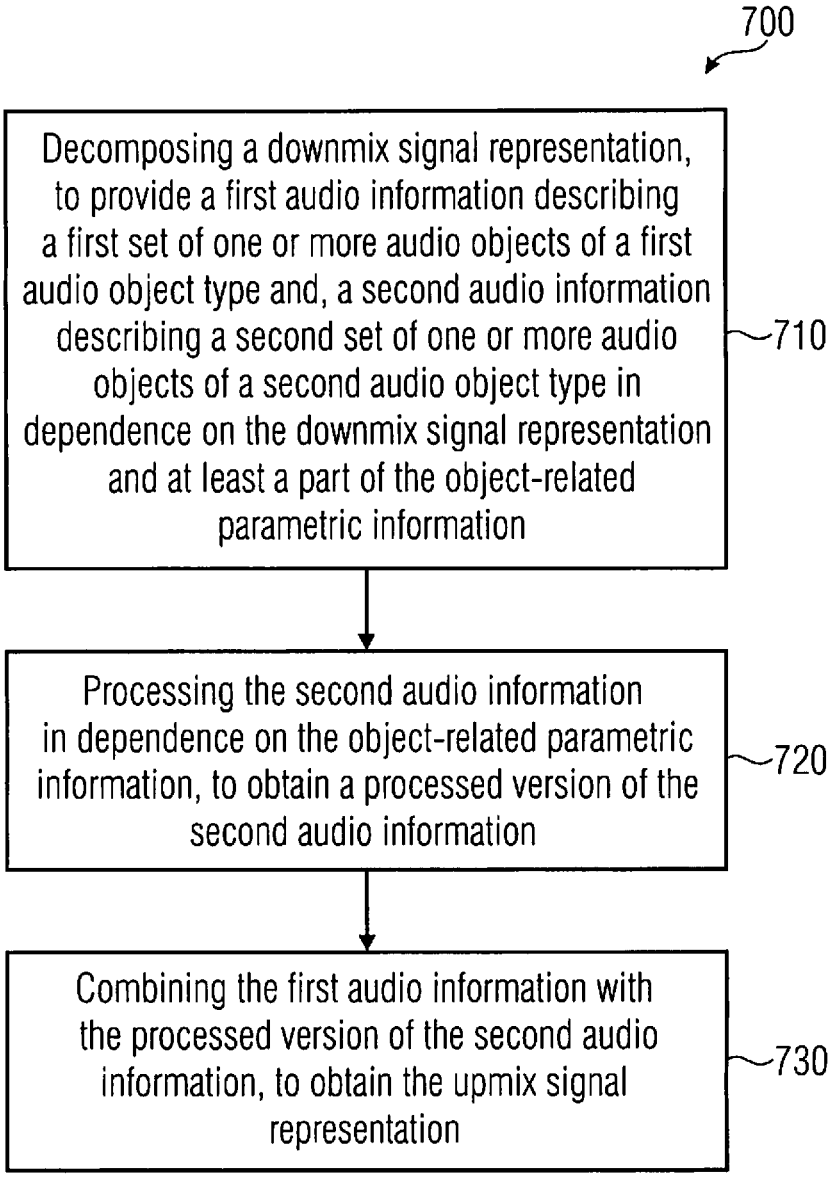
FIG. 7 shows a flow chart of a method for providing an upmix signal representation, according to an embodiment of the invention.
Figure 8:
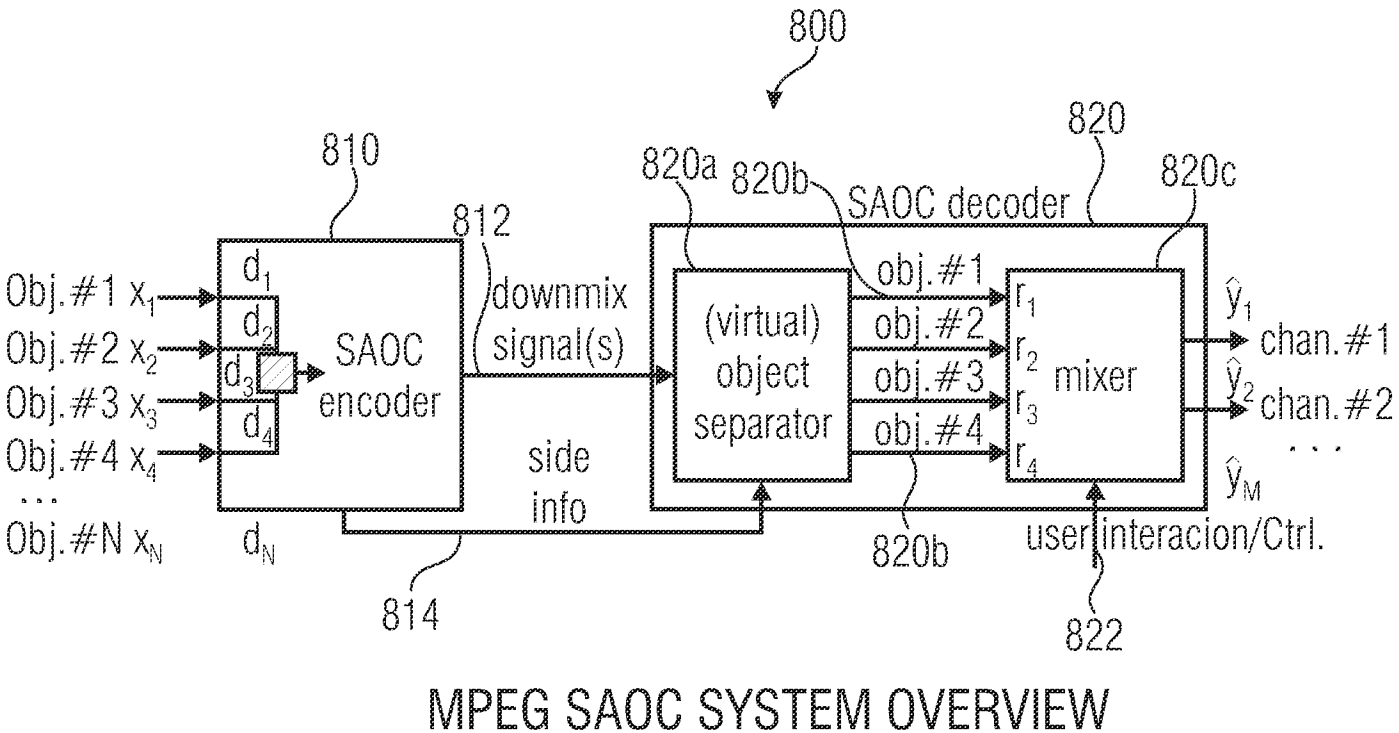
FIG 8 (PRIOR ART)
FIG. 8 shows a block schematic diagram of a reference MPEG SAOC system.
Figure 9A:
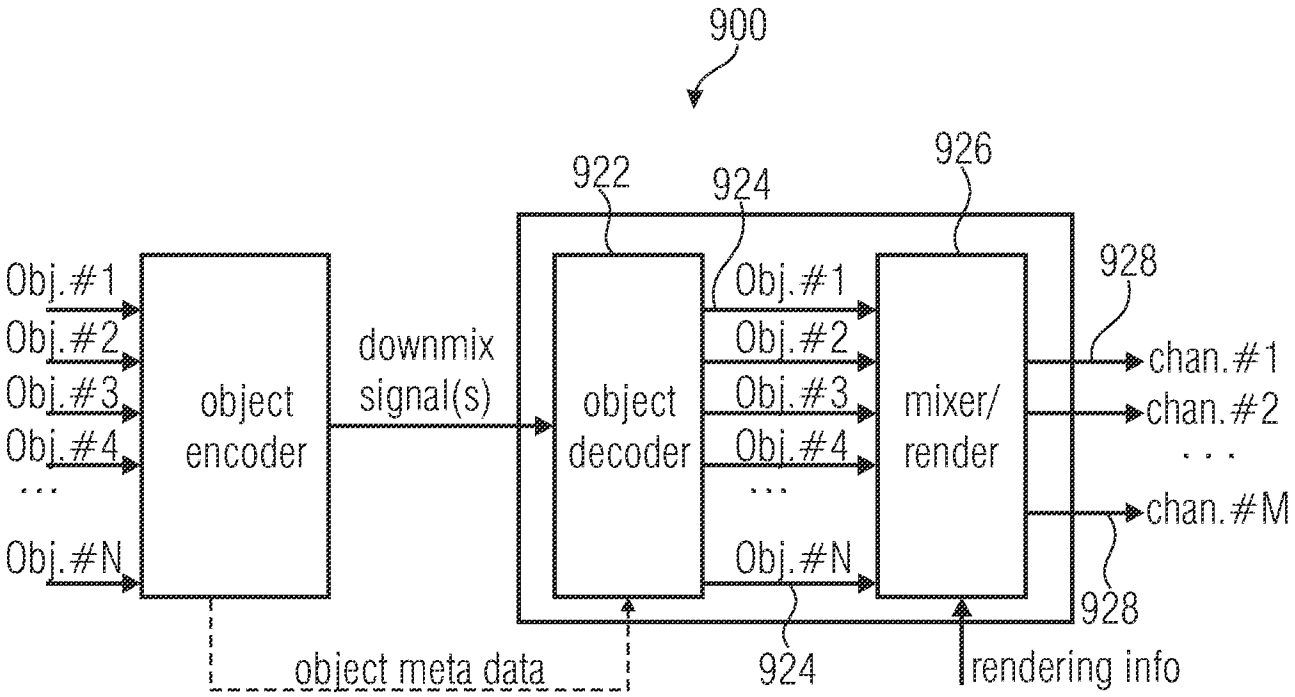
FIG 9A (PRIOR ART)
FIG. 9*a* shows a block schematic diagram of a reference SAOC system using a separate decoder and mixer.
Figure 9B:
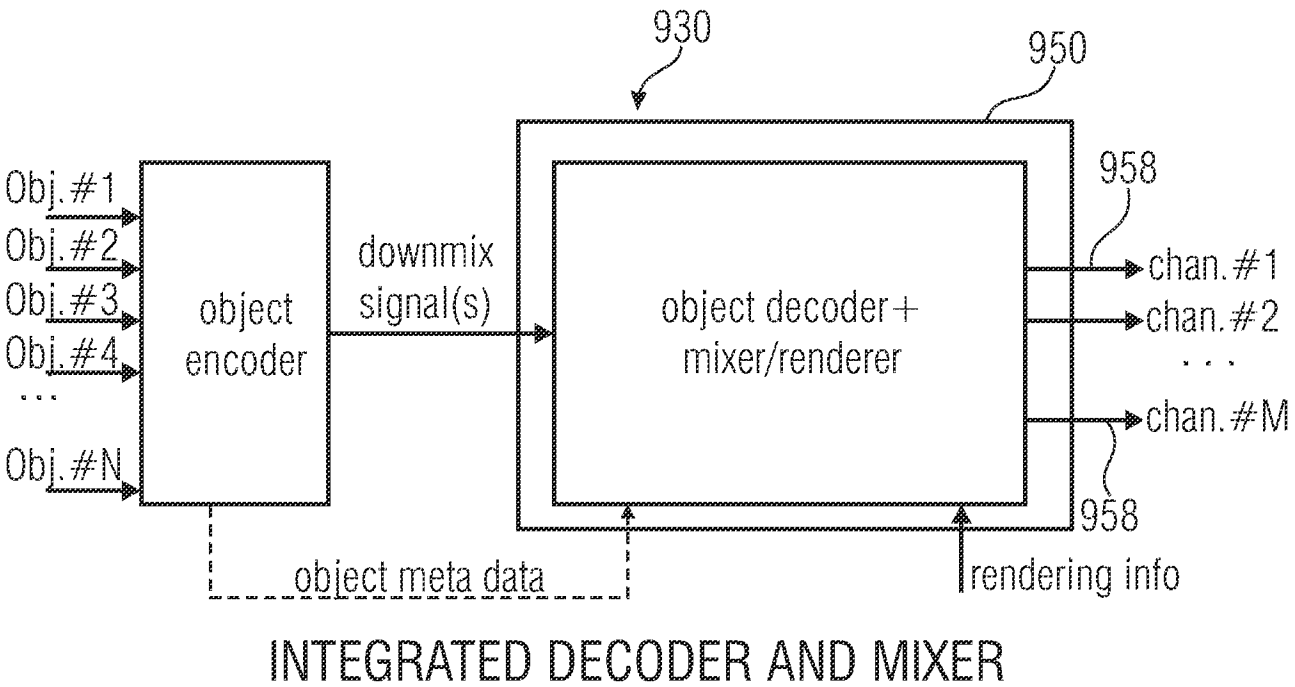
FIG 9B (PRIOR ART)
FIG. 9*b* shows a block schematic diagram of a reference SAOC system using an integrated decoder and mixer.
Figure 9C:
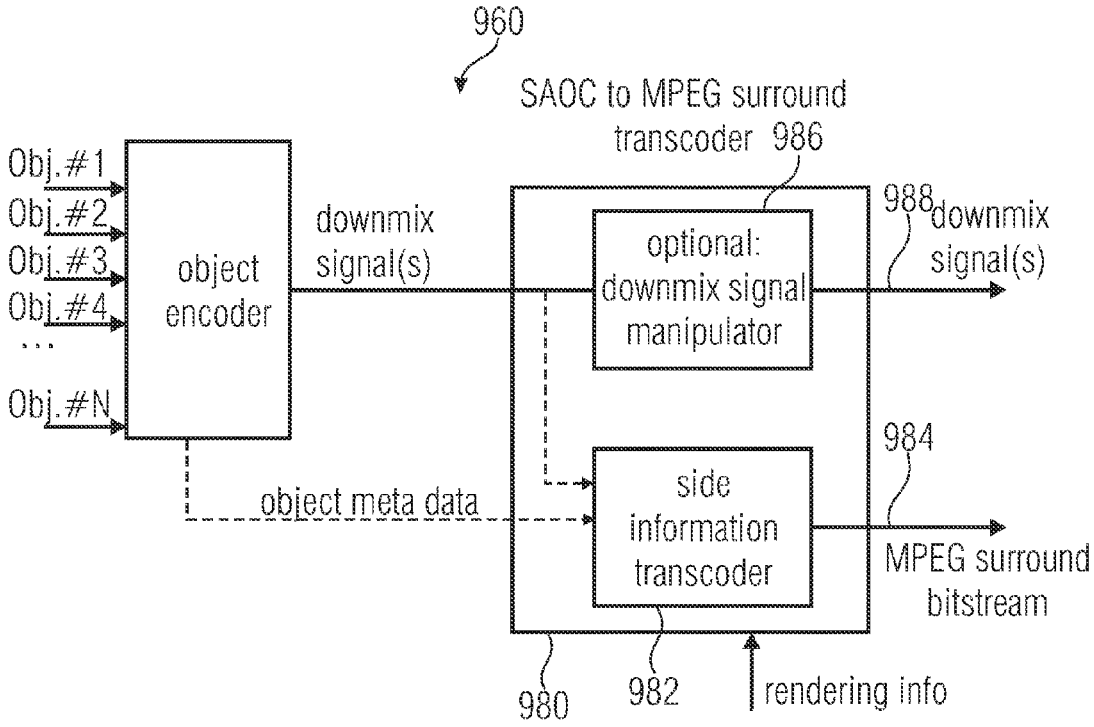
FIG 9C (PRIOR ART)
FIG. 9*c* shows a block schematic diagram of a reference SAOC system using an SAOC-to-MPEG transcoder.

The method 700 according to FIG. 7 may be supplemented by any of the features and functionalities which are discussed herein with respect to the inventive apparatus. Also, the method 700 brings along the advantages discussed with respect to the inventive apparatus.

8. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transmitting.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

9. Conclusions

In the following, some aspects and advantages of the combined EKS SAOC system according to the present invention will be briefly summarized. For Karaoke and Solo playback scenarios, the SAOC EKS processing mode supports both reproduction of the background objects/foreground objects exclusively and an arbitrary mixture (defined by the rendering matrix) of these object groups.

Also, the first mode is considered to be the main objective of EKS processing, the latter provides additional flexibility.

It has been found that a generalization of the EKS functionality consequently involves the effort of combining EKS with the regular SAOC processing mode to obtain one unified system. The potentials of such a unified system are:

One single clear SAOC decoding/transcoding structure;

One bitstream for both EKS and regular SAOC mode;

No limitation to the number of input objects comprising the background object (BOO), such that there is no need to generate the background object prior to the SAOC encoding stage; and Support of a residual coding for foreground objects yielding enhanced perceptual quality in demanding Karaoke/Solo playback situations.

These advantages can be obtained by the unified system described herein.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] ISO/IEC JTC1/SC29/WG11 (MPEG), Document N8853, "Call for Proposals on Spatial Audio Object Coding", 79th MPEG Meeting, Marrakech, January 2007.

[2] ISO/IEC JTC1/SC29/WG11 (MPEG), Document N9099, "Final Spatial Audio Object Coding Evaluation Procedures and Criterion", 80th MPEG Meeting, San Jose, April 2007.

[3] ISO/IEC JTC1/SC29/WG11 (MPEG), Document N9250, "Report on Spatial Audio Object Coding RM0 Selection", 81st MPEG Meeting, Lausanne, July 2007.

[4] ISO/IEC JTC1/SC29/WG11 (MPEG), Document M15123, "Information and Verification Results for CE on Karaoke/Solo system improving the performance of MPEG SAOC RM0", 83rd MPEG Meeting, Antalya, Turkey, January 2008.

[5] ISO/IEC JTC1/SC29/WG11 (MPEG), Document N10659, "Study on ISO/IEC 23003-2:200x Spatial Audio Object Coding (SAOC)", 88th MPEG Meeting, Maui, USA, April 2009.

[6] ISO/IEC JTC1/SC29/WG11 (MPEG), Document M10660, "Status and Workplan on SAOC Core Experiments", 88th MPEG Meeting, Maui, USA, April 2009.

[7] EBU Technical recommendation: "MUSHRA-EBU Method for Subjective Listening Tests of Intermediate Audio Quality", Doc. B/AIMO22, October 1999.

[8] ISO/IEC 23003-1:2007, Information technology—MPEG audio technologies—Part 1: MPEG Surround.

The invention claimed is:

1. An audio signal decoder for providing an upmix signal representation in dependence on a downmix signal representation and an object-related parametric information, the audio signal decoder comprising:

an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information, wherein the second audio information is an audio information describing the audio objects of the second audio object type in a combined manner;

an audio signal processor configured to receive the second audio information and to process the second audio information in dependence on the object-related parametric information, to acquire a processed version of the second audio information; and an audio signal combiner configured to combine the first audio information with the processed version of the second audio information, to acquire the upmix signal representation;

wherein the audio signal decoder is configured to provide the upmix signal representation in dependence on a residual information associated to a subset of audio objects represented by the downmix signal representation, wherein the object separator is configured to decompose the downmix signal representation to provide the first audio information describing the first set of one or more audio objects of the first audio object type to which residual information is associated, and the second audio information describing the second set of one or more audio objects of the second audio object type, to which no residual information is associated, in dependence on the downmix signal representation and using the residual information; and wherein the audio signal processor is configured to process the second audio information, to perform an object-individual processing of the audio objects of the second audio object type, taking into consideration object-related parametric information associated with more than two audio objects of the second audio object type; and wherein the residual information describes a residual distortion, which is expected to remain if an audio object of the first audio object type is isolated merely using the object-related parametric information, wherein the audio signal decoder is implemented using a hardware apparatus, or using a computer, or using a combination of a hardware apparatus and a computer.

2. The audio signal decoder according to claim 1, wherein the object separator is configured to provide the first audio information such that one or more audio objects of the first audio object type are emphasized over audio objects of the second audio object type in the first audio information, and wherein the object separator is configured to provide the second audio information such that audio objects of the second audio object type are emphasized over audio objects of the first audio object type in the second audio information.

3. The audio signal decoder according to claim 1, wherein the audio signal processor is configured to process the second audio information in dependence on the object-related parametric information associated with the audio objects of the second audio object type and independent from the object-related parametric information associated with the audio objects of the first audio object type.

4. The audio signal decoder according to claim 1, wherein the object separator is configured to acquire the first audio information and the second audio information using a linear combination of one or more downmix signal channels of the downmix signal representation and one or more residual channels, wherein the object separator is configured to acquire combination parameters for performing the linear combination in dependence on downmix parameters associated with the audio objects of the first audio object type and in dependence on channel prediction coefficients of the audio objects of the first audio object type.

5. The audio signal decoder according to claim 1, wherein the object separator is configured to acquire the first audio information and the second audio information according to $$X_{OBJ} = M_{OBJ}^{Prediction}\begin{pmatrix} l_0 \\ r_0 \\ \hline res_0 \\ \vdots \\ res_{N_{EAO}-1} \end{pmatrix}$$

$$X_{EAO} = A^{EAO} M_{EAO}^{Prediction}\begin{pmatrix} l_0 \\ r_0 \\ \hline res_0 \\ \vdots \\ res_{N_{EAO}-1} \end{pmatrix}$$

wherein $$M^{Prediction} = \tilde{D}^{-1}C,$$

wherein $$M^{Prediction} = \begin{pmatrix} M_{OBJ}^{Prediction} \\ \hline M_{EAO}^{Prediction} \end{pmatrix}$$

wherein $X_{OBJ}$ represent channels of the second audio information;

wherein $X_{EAO}$ represent object signals of the first audio information;

wherein $\tilde{D}^{-1}$ represents a matrix which is an inverse of an extended downmix matrix;

wherein C describes a matrix representing a plurality of channel prediction coefficients, $\tilde{c}_{j,0}$, $\tilde{c}_{j,1}$;

wherein $l_0$ and $r_0$ represent channels of the downmix signal representation;

wherein $res_0$ to $res_{N_{EAO}-1}$ represent residual channels; and wherein $A^{EAO}$ is a EAO pre-rendering matrix, entries of which describe a mapping of enhanced audio objects to channels of an enhanced audio object signal $X_{EAO}$;

wherein the object separator is configured to acquire the inverse downmix matrix $\tilde{D}^{-1}$ as an inverse of an extended downmix matrix $\tilde{D}$ which is defined as $$\tilde{D} = \left(\begin{array}{cc|ccc} 1 & 0 & m_0 & \dots & m_{N_{EAO}-1} \\ 0 & 1 & n_0 & \dots & n_{N_{EAO}-1} \\ \hline m_0 & n_0 & -1 & \dots & 0 \\ \vdots & \vdots & 0 & \ddots & \vdots \\ m_{N_{EAO}-1} & n_{N_{EAO}-1} & 0 & \dots & -1 \end{array}\right)$$

wherein the object separator is configured to acquire the matrix C as $$C = \left(\begin{array}{cc|ccc} 1 & 0 & 0 & \dots & 0 \\ 0 & 1 & 0 & \dots & 0 \\ \hline c_{0,0} & c_{0,1} & 1 & \dots & 0 \\ \vdots & \vdots & \vdots & \ddots & \vdots \\ c_{N_{EAO}-1,0} & c_{N_{EAO}-1,1} & 0 & \dots & 1 \end{array}\right)$$

wherein $m_0$ to $m_{N_{EAO}-1}$ are downmix values associated with the audio objects of the first audio object type;

wherein $n_0$ to $n_{N_{EAO}-1}$ are downmix values associated with the audio objects of the first audio object type;

wherein the object separator is configured to compute the prediction coefficients $\tilde{c}_{j,0}$ and $\tilde{c}_{j,1}$ as $$\tilde{c}_{j,0} = \frac{P_{LoCo,j}P_{Ro} - P_{RoCo,j}P_{LoRo}}{P_{Lo}P_{Ro} - P_{LoRo}^2}$$

$$\tilde{c}_{j,1} = \frac{P_{LoCo,j}P_{Lo} - P_{LoCo,j}P_{LoRo}}{P_{Lo}P_{Ro} - P_{LoRo}^2};$$

and wherein the object separator is configured to derive constrained prediction coefficients $c_{j,0}$ and $c_{j,1}$ from the prediction coefficients $\tilde{c}_{j,0}$ and $\tilde{c}_{j,1}$ using a constraining algorithm, or to use the prediction coefficients $\tilde{c}_{j,0}$ and $\tilde{c}_{j,1}$ as the prediction coefficients $c_{j,0}$ and $c_{j,1}$;

wherein energy quantities $P_{Lo}$, $P_{Ro}$, $P_{LoRo}$, $P_{LoCo,j}$ and $P_{RoCo,j}$ are defined as $$P_{Lo} = OLD_L + \sum_{j=0}^{N_{EAO}-1}\sum_{k=0}^{N_{EAO}-1} m_j m_k e_{j,k}$$

$$P_{Ro} = OLD_R + \sum_{j=0}^{N_{EAO}-1}\sum_{k=0}^{N_{EAO}-1} n_j n_k e_{j,k}$$

$$P_{LoRo} = e_{L,R} + \sum_{j=0}^{N_{EAO}-1}\sum_{k=0}^{N_{EAO}-1} m_j n_k e_{j,k}$$

$$P_{LoCo,j} = m_j OLD_L + n_j e_{L,R} - m_j OLD_j - \sum_{\substack{i=0 \\ i\neq j}}^{N_{EAO}-1} m_i e_{i,j}$$

$$P_{RoCo,j} = n_j OLD_R + m_j e_{L,R} - n_j OLD_j - \sum_{\substack{i=0 \\ i\neq j}}^{N_{EAO}-1} n_i e_{i,j}$$

wherein parameters $OLD_L$, $OLD_R$ and $IOC_{L,R}$ correspond to audio objects of the second audio object type and are defined according to $$OLD_L + \sum_{i=0}^{N-N_{EAO}-1} d_{0,i}^2 OLD_i,$$

$$OLD_R + \sum_{i=0}^{N-N_{EAO}-1} d_{1,i}^2 OLD_i,$$

$$IOC_{L,R} = \begin{cases} IOC_{0,1}, & N - N_{EAO} = 2, \\ 0, & \text{otherwise}, \end{cases}$$

wherein $d_{0,i}$ and $d_{1,i}$ are downmix values associated with the audio objects of the second audio object type;

wherein $OLD_i$ are object level difference values associated with the audio objects of the second audio object type;

wherein N is a total number of audio objects;

wherein $N_{EAO}$ is a number of audio objects of the first audio object type;

wherein $IOC_{0,1}$ is an inter-object-correlation value associated with a pair of audio objects of the second audio object type;

wherein $e_{i,j}$ and $e_{L,R}$ are covariance values derived from object-level-difference parameters and inter-object-correlation parameters; and wherein $e_{i,j}$ are associated with a pair of audio objects of the 1st audio object type and $e_{L,R}$ is associated with a pair of audio objects of the second audio object type.

6. The audio signal decoder according to claim 1, wherein the object separator is configured to acquire the first audio information and the second audio information according to $$X_{OBJ} = M_{OBJ}^{Prediction}\begin{pmatrix} d_0 \\ \hline res_0 \\ \vdots \\ res_{N_{EAO}-1} \end{pmatrix}$$

$$X_{EAO} = A^{EAO} M_{EAO}^{Prediction}\begin{pmatrix} d_0 \\ \hline res_0 \\ \vdots \\ res_{N_{EAO}-1} \end{pmatrix}$$

wherein $$M_{Prediction} = \tilde{D}^{-1}C$$

wherein $X_{OBJ}$ represents a channel of the second audio information;

wherein $X_{EAO}$ represent object signals of the first audio information;

wherein $\tilde{D}^{-1}$ represents a matrix which is an inverse of an extended downmix matrix;

wherein C describes a matrix representing a plurality of channel prediction coefficients, $\tilde{c}_{j,0}$, $\tilde{c}_{j,1}$;

wherein $d_0$ represents a channel of the downmix signal representation; and wherein $res_o$ to $res_{N_{EAO}-1}$ represent residual channels; and wherein $A^{EAO}$ is a EAO pre-rendering matrix.

7. The audio signal decoder according to claim 6, wherein the object separator is configured to acquire the inverse downmix matrix $\tilde{D}^{-1}$ is an inverse of an extended downmix matrix $\tilde{D}$ which is defined as $$\tilde{D} = \left(\begin{array}{c|ccc} 1 & m_0 & \dots & m_{N_{EAO}-1} \\ \hline m_0 & -1 & \dots & 0 \\ \vdots & 0 & \ddots & \vdots \\ m_{N_{EAO}-1} & 0 & \dots & -1 \end{array}\right)$$

wherein the object separator is configured to acquire the matrix C as $$C = \left(\begin{array}{c|ccc} 1 & 0 & \dots & 0 \\ \hline c_0 & 1 & \dots & 0 \\ \vdots & 0 & \ddots & \vdots \\ c_{N_{EAO}-1} & 0 & \dots & 1 \end{array}\right);$$

wherein $m_0$ to $m_{N_{EAO}-1}$ are downmix values associated with the audio objects of the first audio object type.

8. The audio signal decoder according to claim 1, wherein the object separator is configured to acquire the first audio information and the second audio information according to $$X_{OBJ} = M_{OBJ}^{Energy}\begin{pmatrix} l_0 \\ r_0 \end{pmatrix}$$

$$X_{EAO} = A^{EAO} M_{EAO}^{Energy}\begin{pmatrix} l_0 \\ r_0 \end{pmatrix}$$

wherein $X_{OBJ}$ represent channels of the second audio information;

wherein $X_{EAO}$ represent object signals of the first audio information;

wherein $$M_{OBJ}^{Energy} = \begin{pmatrix} \sqrt{\dfrac{OLD_L}{OLD_L + \sum_{i=0}^{N_{EAO}-1} m_i^2 OLD_i}} & 0 \\ 0 & \sqrt{\dfrac{OLD_R}{OLD_R + \sum_{i=0}^{N_{EAO}-1} n_i^2 OLD_i}} \end{pmatrix}$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} & \sqrt{\dfrac{n_0^2 OLD_0}{OLD_R + \sum_{i=0}^{N_{EAO}-1} n_i^2 OLD_i}} \\ \vdots & \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} & \sqrt{\dfrac{n_{N_{EAO}-1}^2 OLD_{N_{EAO}-1}}{OLD_R + \sum_{i=0}^{N_{EAO}-1} n_i^2 OLD_i}} \end{pmatrix}$$

wherein $m_0$ to $m_{NEAO-1}$ are downmix values associated with the audio objects of the first audio object type;

wherein $n_0$ to $n_{N_{EAO}-1}$ are downmix values associated with the audio objects of the first audio object type;

wherein $OLD_i$ are object level difference values associated with the audio objects of the first audio object type;

wherein $OLD_L$ and $OLD_R$ are common object level difference values associated with the audio objects of the second audio object type; and wherein $A^{EAO}$ is a EAO pre-rendering matrix.

9. The audio signal decoder according to claim 1, wherein the object separator is configured to acquire the first audio information and the second audio information according to $$X_{OBJ} = M_{OBJ}^{Energy}(d_0)$$

$$X_{EAO} = A^{EAO} M_{EAO}^{Energy}(d_0)$$

wherein $X_{OBJ}$ represents a channel of the second audio information;

wherein $X_{EAO}$ represent object signals of the first audio information;

wherein $$M_{OBJ}^{Energy} = \left( \sqrt{\frac{OLD_L}{OLD_L + \sum_{i=0}^{N_{EAO}-1} m_i^2 OLD_i}} \right)$$

$$M_{EAO}^{Energy} = \begin{pmatrix} \sqrt{\frac{m_0^2 OLD_0}{OLD_L + \sum_{i=0}^{N_{EAO}-1} m_i^2 OLD_i}} \\ \vdots \\ \sqrt{\frac{m_{N_{EAO}-1}^2 OLD_{N_{EAO}-1}}{OLD_L + \sum_{i=0}^{N_{EAO}-1} m_i^2 OLD_i}} \end{pmatrix}$$

wherein $m_0$ to $m_{NEAO-1}$ are downmix values associated with the audio objects of the first audio object type;

wherein $OLD_i$ are object level difference values associated with the audio objects of the first audio object type;

wherein $OLD_L$ is a common object level difference value associated with the audio objects of the second audio object type; and wherein $A^{EAO}$ is a EAO pre-rendering matrix;

wherein the matrices $M_{OBJ}^{Energy}$ and $M_{EAO}^{Energy}$ are applied to a representation $d_0$ of a single SAOC downmix signal.

10. The audio signal decoder according to claim 1, wherein the object separator is configured to apply a rendering matrix to the first audio information to map object signals of the first audio information onto audio channels of the upmix audio signal representation.

11. The audio signal decoder according to claim 1, wherein the audio signal processor is configured to perform a stereo preprocessing of the second audio information in dependence on a rendering information, an object-related covariance information, a downmix information, to acquire audio channels of the processed version of the second audio information.

12. The audio signal decoder according to claim 11, wherein the audio signal processor is configured to perform the stereo processing to map an estimated audio object contribution of the second audio information onto a plurality of channels of the upmix audio signal representation in dependence on a rendering information and a covariance information.

13. The audio signal decoder according to claim 11, wherein the audio signal processor is configured to add a decorrelated audio signal contribution, acquired on the basis of one or more audio channels of the second audio information, to the second audio information, or an information derived from the second audio information, in dependence on a render upmix error information and one or more decorrelated-signal-intensity scaling values.

14. The audio signal decoder according to claim 1, wherein the audio signal processor is configured to perform a postprocessing of the second audio information in dependence on a rendering information, an object-related covariance information and a downmix information.

15. The audio signal decoder according to claim 14, wherein the audio signal processor is configured to perform a mono-to-binaural processing of the second audio information, to map a single channel of the second audio information onto two channels of the upmix signal representation, taking into consideration a head-related transfer function.

16. The audio signal decoder according to claim 14, wherein the audio signal processor is configured to perform a mono-to-stereo processing of the second audio information, to map a single channel of the second audio information onto two channels of the upmix signal representation.

17. The audio signal decoder according to claim 14, wherein the audio signal processor is configured to perform a stereo-to-binaural processing of the second audio information, to map two channels of the second audio information onto two channels of the upmix signal representation, taking into consideration a head-related transfer function.

18. The audio signal decoder according to claim 14, wherein the audio signal processor is configured to perform a stereo-to-stereo processing of the second audio information, to map two channels of the second audio information onto two channels of the upmix signal representation.

19. The audio signal decoder according to claim 1, wherein the object separator is configured to treat audio objects of the second audio object type, to which no residual information is associated, as a single audio object, and wherein the audio signal processor is configured to consider object-specific rendering parameters associated to the audio objects of the second audio object type to adjust contributions of the audio objects of the second audio object type to the upmix signal representation.

20. The audio signal decoder according to claim 1, wherein the object separator is configured to acquire one or two common object level difference values for a plurality of audio objects of the second audio object type; and wherein the object separator is configured to use the common object level difference value for a computation of channel prediction coefficients; and wherein the object separator is configured to use the channel prediction coefficients to acquire one or two audio channels representing the second audio information.

21. The audio signal decoder according to claim 1, wherein the object separator is configured to acquire one or two common object level difference values for a plurality of audio objects of the second audio object type, and wherein the object separator is configured to use the common object level difference value for a computation of entries of an matrix; and wherein the object separator is configured to use the matrix to acquire one or more audio channels representing the second audio information.

22. The audio signal decoder according to claim 1, wherein the object separator is configured to selectively acquire a common inter-object correlation value associated to the audio object of the second audio object type in dependence on the object-related parametric information if it is found that there are two audio objects of the second audio object type, and to set the inter-object correlation value associated to the audio objects of the second audio object type to zero if it is found that there are more or less than two audio objects of the second audio object type; and wherein the object separator is configured to use the common inter-object correlation value for a computation of entries of an matrix; and wherein the object separator is configured to use the common inter-object correlation value associated to the audio objects of the second audio object type to acquire the one or more audio channels representing the second audio information.

23. The audio signal decoder according to claim 1, wherein the audio signal processor is configured to render the second audio information in dependence on the object-related parametric information, to acquire a rendered representation of the audio objects of the second audio object type as the processed version of the second audio information.

24. The audio signal decoder according to claim 1, wherein the object separator is configured to provide the second audio information such that the second audio information describes more than two audio objects of the second audio object type.

25. The audio signal decoder according to claim 24, wherein the object separator is configured to acquire, as the second audio information, a one-channel audio signal representation or a two-channel audio signal representation representing more than two audio objects of the second audio object type.

26. The audio signal decoder according to claim 1, wherein the audio signal processor is configured to receive the second audio information and to process the second audio information in dependence of the object-related parametric information, taking into consideration object-related parametric information associated with more than two audio objects of the second audio object type.

27. The audio signal decoder according to claim 1, wherein the audio signal decoder is configured to extract a total object number information and a foreground object number information from a configuration information of the object-related parametric information, and to determine the number of audio objects of the second audio object type by forming a difference between the total object number information and the foreground object number information.

28. The audio signal decoder according to claim 1, wherein the object separator is configured to use object-related parametric information associated with $N_{EAO}$ audio objects of the first audio object type to acquire, as the first audio information, $N_{EAO}$ audio signals representing the $N_{EAO}$ audio objects of the first audio object type and to acquire, as the second audio information, one or two audio signals representing the $N-N_{EAO}$ audio objects of the second audio object type, treating the $N-N_{EAO}$ audio objects of the second audio object type as a single one-channel or a two-channel audio object; and wherein the audio signal processor is configured to individually render the $N-N_{EAO}$ audio objects represented by the one or two audio signals of the second audio information using the object-related parametric information associated with the $N-N_{EAO}$ audio objects of the second audio object type.

29. A method for providing an upmix signal representation in dependence on a downmix signal representation and an object-related parametric information, the method comprising:

decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information, wherein the second audio information is an audio information describing the audio objects of the second audio object type in a combined manner; and processing the second audio information in dependence on the object-related parametric information, to acquire a processed version of the second audio information; and combining the first audio information with the processed version of the second audio information, to acquire the upmix signal representation;

wherein the upmix signal representation is provided in dependence on a residual information associated to a subset of audio objects represented by the downmix signal representation, wherein the downmix signal representation is decomposed, to provide the first audio information describing the first set of one or more audio objects of the first audio object type to which residual information is associated, and the second audio information describing the second set of one or more audio objects of the second audio object type, to which no residual information is associated, in dependence on the downmix signal representation and using the residual information;

wherein an object-individual processing of the audio objects of the second audio object type is performed, taking into consideration object-related parametric information associated with more than two audio objects of the second audio object type; and wherein the residual information describes a residual distortion, which is expected to remain if an audio object of the first audio object type is isolated merely using the object-related parametric information;

wherein the method is performed using a hardware apparatus, or using a computer, or using a combination of a hardware apparatus and a computer.

30. An audio signal decoder for providing an upmix signal representation in dependence on a downmix signal representation, an object-related parametric information the audio signal decoder comprising:

an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information;

an audio signal processor configured to receive the second audio information and to process the second audio information in dependence on the object-related parametric information, to acquire a processed version of the second audio information; and an audio signal combiner configured to combine the first audio information with the processed version of the second audio information, to acquire the upmix signal representation;

wherein the object separator is configured to acquire the first audio information and the second audio information according to $$X_{OBJ} = M_{OBJ}^{Prediction}\begin{pmatrix} l_0 \\ r_0 \\ \hline res_0 \\ \vdots \\ res_{N_{EAO}-1} \end{pmatrix}$$

$$X_{OBJ} = A^{EAO} M_{OBJ}^{Prediction}\begin{pmatrix} l_0 \\ r_0 \\ \hline res_0 \\ \vdots \\ res_{N_{EAO}-1} \end{pmatrix}$$

wherein $$M^{Prediction} = \tilde{D}^{-1}C,$$

wherein $$M^{Prediction} = \begin{pmatrix} M_{OBJ}^{Prediction} \\ \hline M_{EAO}^{Prediction} \end{pmatrix}$$

wherein $X_{OBJ}$ represent channels of the second audio information;

wherein $X_{EAO}$ represent object signals of the first audio information;

wherein $\tilde{D}^{-1}$ represents a matrix which is an inverse of an extended downmix matrix;

wherein C describes a matrix representing a plurality of channel prediction coefficients, $\tilde{c}_{j,0}$, $\tilde{c}_{j,1}$;

wherein $l_0$ and $r_0$ represent channels of the downmix signal representation;

wherein $res_0$ to $res_{N_{EAO}-1}$ represent residual channels; and wherein $A^{EAO}$ is a EAO pre-rendering matrix, entries of which describe a mapping of enhanced audio objects to channels of an enhanced audio object signal $X_{EAO}$;

wherein the object separator is configured to acquire the inverse downmix matrix $\tilde{D}^{-1}$ as an inverse of an extended downmix matrix $\tilde{D}$ which is defined as $$\tilde{D} = \left(\begin{array}{cc|ccc} 1 & 0 & m_0 & \dots & m_{N_{EAO}-1} \\ 0 & 1 & n_0 & \dots & n_{N_{EAO}-1} \\ \hline m_0 & n_0 & -1 & \dots & 0 \\ \vdots & \vdots & 0 & \ddots & \vdots \\ m_{N_{EAO}-1} & n_{N_{EAO}-1} & 0 & \dots & -1 \end{array}\right)$$

wherein the object separator is configured to acquire the matrix C as $$C = \left(\begin{array}{cc|ccc} 1 & 0 & 0 & \dots & 0 \\ 0 & 1 & 0 & \dots & 0 \\ \hline c_{0,0} & c_{0,1} & 1 & \dots & 0 \\ \vdots & \vdots & \vdots & \ddots & \vdots \\ c_{N_{EAO}-1,0} & c_{N_{EAO}-1,1} & 0 & \dots & 1 \end{array}\right)$$

wherein $m_0$ to $m_{N_{EAO}-1}$ are downmix values associated with the audio objects of the first audio object type;

wherein $n_0$ to $n_{N_{EAO}-1}$ are downmix values associated with the audio objects of the first audio object type;

wherein the object separator is configured to compute the prediction coefficients $\tilde{c}_{j,0}$ and $\tilde{c}_{j,1}$ as $$\tilde{c}_{j,0} = \frac{P_{LoCo,j}P_{Ro} - P_{RoCo,j}P_{LoRo}}{P_{Lo}P_{Ro} - P_{LoRo}^2}$$

$$\tilde{c}_{j,1} = \frac{P_{RoCo,j}P_{Lo} - P_{LoCo,j}P_{LoRo}}{P_{Lo}P_{Ro} - P_{LoRo}^2}; \text{ and}$$

wherein the object separator is configured to derive constrained prediction coefficients $c_{j,0}$ and $c_{j,1}$ from the prediction coefficients $\tilde{c}_{j,0}$ and $\tilde{c}_{j,1}$ using a constraining algorithm, or to use the prediction coefficients $\tilde{c}_{j,0}$ and $\tilde{c}_{j,1}$ as the prediction coefficients $c_{j,0}$ and wherein energy quantities $P_{Lo}$, $P_{Ro}$, $P_{LoRo}$, $P_{LoCo,j}$ and $P_{RoCo,j}$ are defined as $$P_{Lo} = OLD_L + \sum_{j=0}^{N_{EAO}-1}\sum_{k=0}^{N_{EAO}-1} m_j m_k e_{j,k}$$

$$P_{Ro} = OLD_R + \sum_{j=0}^{N_{EAO}-1}\sum_{k=0}^{N_{EAO}-1} n_j n_k e_{j,k}$$

-continued $$P_{LoRo} = e_{L,R} + \sum_{j=0}^{N_{EAO}-1}\sum_{k=0}^{N_{EAO}-1} m_j n_k e_{j,k}$$

$$P_{LoCo,j} = m_j OLD_L + n_j e_{L,R} - m_j OLD_j - \sum_{\substack{i=0 \\ i\neq j}}^{N_{EAO}-1} m_i e_{i,j}$$

$$P_{RoCo,j} = n_j OLD_R + m_j e_{L,R} - n_j OLD_j - \sum_{\substack{i=0 \\ i\neq j}}^{N_{EAO}-1} n_i e_{i,j}$$

wherein parameters $OLD_L$, $OLD_R$ and $IOC_{L,R}$ correspond to audio objects of the second audio object type and are defined according to $$OLD_L = \sum_{i=0}^{N-N_{EAO}-1} d_{0,i}^2 OLD_i,$$

$$OLD_R = \sum_{i=0}^{N-N_{EAO}-1} d_{1,i}^2 OLD_i,$$

$$IOC_{L,R} = \begin{cases} IOC_{0,1}, & N - N_{EAO} = 2, \\ 0, & \text{otherwise}, \end{cases}$$

wherein $d_{0,i}$ and $d_{1,i}$ are downmix values associated with the audio objects of the second audio object type;

wherein $OLD_i$ are object level difference values associated with the audio objects of the second audio object type;

wherein N is a total number of audio objects;

wherein $N_{EAO}$ is a number of audio objects of the first audio object type;

wherein $IOC_{0,1}$ is an inter-object-correlation value associated with a pair of audio objects of the second audio object type;

wherein $e_{i,j}$ and $e_{L,R}$ are covariance values derived from object-level-difference parameters and inter-object-correlation parameters; and wherein $e_{i,j}$ are associated with a pair of audio objects of the 1st audio object type and $e_{L,R}$ is associated with a pair of audio objects of the second audio object type;

wherein the audio signal decoder is implemented using a hardware apparatus, or using a computer, or using a combination of a hardware apparatus and a computer.

31. An audio signal decoder for providing an upmix signal representation in dependence on a downmix signal representation, an object-related parametric information the audio signal decoder comprising:

an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information;

an audio signal processor configured to receive the second audio information and to process the second audio information in dependence on the object-related parametric information, to acquire a processed version of the second audio information; and an audio signal combiner configured to combine the first audio information with the processed version of the second audio information, to acquire the upmix signal representation;

wherein the object separator is configured to acquire the first audio information and the second audio information according to $$X_{OBJ} = M_{OBJ}^{Energy}\begin{pmatrix} l_0 \\ r_0 \end{pmatrix}$$

$$X_{EAO} = A^{EAO} M_{EAO}^{Energy}\begin{pmatrix} l_0 \\ r_0 \end{pmatrix}$$

wherein $X_{OBJ}$ represent channels of the second audio information;

wherein $X_{EAO}$ represent object signals of the first audio information;

wherein $$M_{OBJ}^{Energy} = \begin{pmatrix} \sqrt{\frac{OLD_L}{OLD_L + \sum_{i=0}^{N_{EAO}-1} m_i^2 OLD_i}} & 0 \\ 0 & \sqrt{\frac{OLD_R}{OLD_R + \sum_{i=0}^{N_{EAO}-1} n_i^2 OLD_i}} \end{pmatrix}$$

$$M_{EAO}^{Energy} = \begin{pmatrix} \sqrt{\frac{m_0^2 OLD_0}{OLD_L + \sum_{i=0}^{N_{EAO}-1} m_i^2 OLD_i}} & \sqrt{\frac{n_0^2 OLD_0}{OLD_R + \sum_{i=0}^{N_{EAO}-1} n_i^2 OLD_i}} \\ \vdots & \vdots \\ \sqrt{\frac{m_{N_{EAO}-1}^2 OLD_{N_{EAO}-1}}{OLD_L + \sum_{i=0}^{N_{EAO}-1} m_i^2 OLD_i}} & \sqrt{\frac{n_{N_{EAO}-1}^2 OLD_{N_{EAO}-1}}{OLD_R + \sum_{i=0}^{N_{EAO}-1} n_i^2 OLD_i}} \end{pmatrix}$$

wherein $m_0$ to $m_{NEAO-1}$ are downmix values associated with the audio objects of the first audio object type;

wherein $n_0$ to $n_{N_{EAO}-1}$ are downmix values associated with the audio objects of the first audio object type;

wherein $OLD_i$ are object level difference values associated with the audio objects of the first audio object type;

wherein $OLD_L$ and $OLD_R$ are common object level difference values associated with the audio objects of the second audio object type; and wherein $A^{EAO}$ is a EAO pre-rendering matrix;

wherein the audio signal decoder is implemented using a hardware apparatus, or using a computer, or using a combination of a hardware apparatus and a computer.

32. An audio signal decoder for providing an upmix signal representation in dependence on a downmix signal representation, an object-related parametric information the audio signal decoder comprising:

an object separator configured to decompose the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information;

an audio signal processor configured to receive the second audio information and to process the second audio information in dependence on the object-related parametric information, to acquire a processed version of the second audio information; and an audio signal combiner configured to combine the first audio information with the processed version of the second audio information, to acquire the upmix signal representation;

wherein the object separator is configured to acquire the first audio information and the second audio information according to $$X_{OBJ} = M_{OBJ}^{Energy}(d_0)$$

$$X_{EAO} = A^{EAO} M_{EAO}^{Energy}(d_0)$$

wherein $X_{OBJ}$ represents a channel of the second audio information;

wherein $X_{EAO}$ represent object signals of the first audio information;

wherein $$M_{OBJ}^{Energy} = \left(\sqrt{\frac{OLD_L}{OLD_L + \sum_{i=0}^{N_{EAO}-1} m_i^2 OLD_i}}\right)$$

$$M_{EAO}^{Energy} = \begin{pmatrix} \sqrt{\frac{m_0^2 OLD_0}{OLD_L + \sum_{i=0}^{N_{EAO}-1} m_i^2 OLD_i}} \\ \vdots \\ \sqrt{\frac{m_{N_{EAO}-1}^2 OLD_{N_{EAO}-1}}{OLD_L + \sum_{i=0}^{N_{EAO}-1} m_i^2 OLD_i}} \end{pmatrix}$$

wherein $m_0$ to $m_{NEAO-1}$ are downmix values associated with the audio objects of the first audio object type;

wherein $OLD_i$ are object level difference values associated with the audio objects of the first audio object type;

wherein $OLD_L$ is a common object level difference value associated with the audio objects of the second audio object type; and wherein $A^{EAO}$ is a EAO pre-rendering matrix;

wherein the matrices $M_{OBJ}^{Energy}$ and $M_{EAO}^{Energy}$ are applied to a representation $d_0$ of a single SAOC downmix signal;

wherein the audio signal decoder is implemented using a hardware apparatus, or using a computer, or using a combination of a hardware apparatus and a computer.

33. A method for providing an upmix signal representation in dependence on a downmix signal representation and an object-related parametric information, the method comprising:

decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; and processing the second audio information in dependence on the object-related parametric information, to acquire a processed version of the second audio information; and combining the first audio information with the processed version of the second audio information, to acquire the upmix signal representation;

wherein the first audio information and the second audio information are acquired according to $$X_{OBJ} = M_{OBJ}^{Prediction}\begin{pmatrix} l_0 \\ r_0 \\ \hline res_0 \\ \vdots \\ res_{N_{EAO}-1} \end{pmatrix}$$

$$X_{EAO} = A^{EAO} M_{EAO}^{Prediction}\begin{pmatrix} l_0 \\ r_0 \\ \hline res_0 \\ \vdots \\ res_{N_{EAO}-1} \end{pmatrix}$$

wherein $$M^{Prediction} = \tilde{D}^{-1}C,$$

wherein $$M^{Prediction} = \begin{pmatrix} M_{OBJ}^{Prediction} \\ \hline M_{EAO}^{Prediction} \end{pmatrix}$$

wherein $X_{OBJ}$ represent channels of the second audio information;

wherein $X_{EAO}$ represent object signals of the first audio information;

wherein $\tilde{D}^{-1}$ represents a matrix which is an inverse of an extended downmix matrix;

wherein C describes a matrix representing a plurality of channel prediction coefficients, $\tilde{c}_{j,0}$, $\tilde{c}_{j,1}$;

wherein $l_0$ and $r_0$ represent channels of the downmix signal representation;

wherein $res_0$ to $res_{N_{EAO}-1}$ represent residual channels; and wherein $A^{EAO}$ is a EAO pre-rendering matrix, entries of which describe a mapping of enhanced audio objects to channels of an enhanced audio object signal $X_{EAO}$;

wherein the inverse downmix matrix $\tilde{D}^{-1}$ is acquired as an inverse of an extended downmix matrix $\tilde{D}$ which is defined as $$\tilde{D} = \left(\begin{array}{cc|ccc} 1 & 0 & m_0 & \dots & m_{N_{EAO}-1} \\ 0 & 1 & n_0 & \dots & n_{N_{EAO}-1} \\ \hline m_0 & n_0 & -1 & \dots & 0 \\ \vdots & \vdots & 0 & \ddots & \vdots \\ m_{N_{EAO}-1} & n_{N_{EAO}-1} & 0 & \dots & -1 \end{array}\right)$$

wherein the matrix C is acquired as $$C = \left(\begin{array}{cc|ccc} 1 & 0 & 0 & \dots & 0 \\ 0 & 1 & 0 & \dots & 0 \\ \hline c_{0,0} & c_{0,1} & 1 & \dots & 0 \\ \vdots & \vdots & \vdots & \ddots & \vdots \\ c_{N_{EAO}-1,0} & c_{N_{EAO}-1,1} & 0 & \dots & 1 \end{array}\right)$$

wherein $m_0$ to $m_{N_{EAO}-1}$ are downmix values associated with the audio objects of the first audio object type;

wherein $n_0$ to $n_{N_{EAO}-1}$ are downmix values associated with the audio objects of the first audio object type;

wherein the prediction coefficients $\tilde{c}_{j,0}$ and $\tilde{c}_{j,1}$ are computed as $$\tilde{c}_{j,0} = \frac{P_{LoCo,j}P_{Ro} - P_{RoCo,j}P_{LoRo}}{P_{Lo}P_{Ro} - P_{LoRo}^2}$$

$$\tilde{c}_{j,1} = \frac{P_{RoCo,j}P_{Lo} - P_{LoCo,j}P_{LoRo}}{P_{Lo}P_{Ro} - P_{LoRo}^2}; \text{ and}$$

wherein constrained prediction coefficients $c_{j,0}$ and $c_{j,1}$ are derived from the prediction coefficients $\tilde{c}_{j,0}$ and $\tilde{c}_{j,1}$ using a constraining algorithm, or wherein the prediction coefficients $\tilde{c}_{j,0}$ and $\tilde{c}_{j,1}$ are used as the prediction coefficients $c_{j,0}$ and $c_{j,1}$;

wherein energy quantities $P_{Lo}$, $P_{Ro}$, $P_{LoRo}$, $P_{LoCo,j}$ and $P_{RoCo,j}$ are defined as $$P_{Lo} = OLD_L + \sum_{j=0}^{N_{EAO}-1}\sum_{k=0}^{N_{EAO}-1} m_j m_k e_{j,k}$$

$$P_{Ro} = OLD_R + \sum_{j=0}^{N_{EAO}-1}\sum_{k=0}^{N_{EAO}-1} n_j n_k e_{j,k}$$

$$P_{LoRo} = e_{L,R} + \sum_{j=0}^{N_{EAO}-1}\sum_{k=0}^{N_{EAO}-1} m_j n_k e_{j,k}$$

$$P_{LoCo,j} = m_j OLD_L + n_j e_{L,R} - m_j OLD_j - \sum_{\substack{i=0 \\ i\neq j}}^{N_{EAO}-1} m_i e_{i,j}$$

$$P_{RoCo,j} = n_j OLD_R + m_j e_{L,R} - n_j OLD_j - \sum_{\substack{i=0 \\ i\neq j}}^{N_{EAO}-1} n_i e_{i,j}$$

wherein parameters $OLD_L$, $OLD_R$ and $IOC_{L,R}$ correspond to audio objects of the second audio object type and are defined according to $$OLD_L = \sum_{i=0}^{N-N_{EAO}-1} d_{0,i}^2 OLD_i,$$

$$OLD_R = \sum_{i=0}^{N-N_{EAO}-1} d_{1,i}^2 OLD_i,$$

$$IOC_{L,R} = \begin{cases} IOC_{0,1}, & N - N_{EAO} = 2, \\ 0, & \text{otherwise}, \end{cases}$$

wherein $d_{0,i}$ and $d_{1,i}$ are downmix values associated with the audio objects of the second audio object type;

wherein $OLD_i$ are object level difference values associated with the audio objects of the second audio object type;

wherein N is a total number of audio objects;

wherein $N_{EAO}$ is a number of audio objects of the first audio object type;

wherein $IOC_{0,1}$ is an inter-object-correlation value associated with a pair of audio objects of the second audio object type;

wherein $e_{i,j}$ and $e_{L,R}$ are covariance values derived from object-level-difference parameters and inter-object-correlation parameters; and wherein $e_{i,j}$ are associated with a pair of audio objects of the 1st audio object type and $e_{L,R}$ is associated with a pair of audio objects of the second audio object type;

wherein the method is performed using a hardware apparatus, or using a computer, or using a combination of a hardware apparatus and a computer.

34. A method for providing an upmix signal representation in dependence on a downmix signal representation and an object-related parametric information, the method comprising:

decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; and processing the second audio information in dependence on the object-related parametric information, to acquire a processed version of the second audio information; and combining the first audio information with the processed version of the second audio information, to acquire the upmix signal representation;

wherein the first audio information and the second audio information are acquired according to $$X_{OBJ} = M_{OBJ}^{Energy}\begin{pmatrix} l_0 \\ r_0 \end{pmatrix}$$

$$X_{EAO} = A^{EAO} M_{EAO}^{Energy}\begin{pmatrix} l_0 \\ r_0 \end{pmatrix}$$

wherein $X_{OBJ}$ represent channels of the second audio information;

wherein $X_{EAO}$ represent object signals of the first audio information;

wherein $$M_{OBJ}^{Energy} = \begin{pmatrix} \sqrt{\dfrac{OLD_L}{OLD_L + \sum_{i=0}^{N_{EAO}-1} m_i^2 OLD_i}} & 0 \\ 0 & \sqrt{\dfrac{OLD_R}{OLD_R + \sum_{i=0}^{N_{EAO}-1} n_i^2 OLD_i}} \end{pmatrix}$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} & \sqrt{\dfrac{n_0^2 OLD_0}{OLD_R + \sum_{i=0}^{N_{EAO}-1} n_i^2 OLD_i}} \\ \vdots & \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} & \sqrt{\dfrac{n_{N_{EAO}-1}^2 OLD_{N_{EAO}-1}}{OLD_R + \sum_{i=0}^{N_{EAO}-1} n_i^2 OLD_i}} \end{pmatrix}$$

wherein $m_0$ to $m_{NEAO-1}$ are downmix values associated with the audio objects of the first audio object type;

wherein $n_0$ to $n_{N_{EAO}-1}$ are downmix values associated with the audio objects of the first audio object type;

wherein $OLD_i$ are object level difference values associated with the audio objects of the first audio object type;

wherein $OLD_L$ and $OLD_R$ are common object level difference values associated with the audio objects of the second audio object type; and wherein $A^{EAO}$ is a EAO pre-rendering matrix;

wherein the method is performed using a hardware apparatus, or using a computer, a using a combination of a hardware apparatus and a computer.

35. A method for providing an upmix signal representation it dependence on a downmix signal representation and an object-related parametric information, the method comprising:

decomposing the downmix signal representation, to provide a first audio information describing a first set of one or more audio objects of a first audio object type, and a second audio information describing a second set of one or more audio objects of a second audio object type in dependence on the downmix signal representation and using at least a part of the object-related parametric information; and processing the second audio information in dependence on the object-related parametric information, to acquire a processed version of the second audio information; and combining the first audio information with the processed version of the second audio information, to acquire the upmix signal representation;

wherein the first audio information and the second audio information are acquired according to $$X_{OBJ}=M_{OBJ}^{Energy}(d_0)$$

$$X_{EAO}=A^{EAO}M_{EAO}^{Energy}(d_0)$$

wherein $X_{OBJ}$ represents a channel of the second audio information;

wherein $X_{EAO}$ represent object signals of the first audio information;

wherein $$M_{OBJ}^{Energy} = \left(\sqrt{\frac{OLD_L}{OLD_L + \sum_{i=0}^{N_{EAO}-1} m_i^2 OLD_i}}\right)$$

$$M_{EAO}^{Energy} = \begin{pmatrix} \sqrt{\dfrac{m_0^2 OLD_0}{OLD_L + \sum_{i=0}^{N_{EAO}-1} m_i^2 OLD_i}} \\ \vdots \\ \sqrt{\dfrac{m_{N_{EAO}-1}^2 OLD_{N_{EAO}-1}}{OLD_L + \sum_{i=0}^{N_{EAO}-1} m_i^2 OLD_i}} \end{pmatrix}$$

wherein $m_0$ to $m_{NEAO-1}$ are downmix values associated with the audio objects of the first audio object type;

wherein $OLD_i$ are object level difference values associated with the audio objects of the first audio object type;

wherein $OLD_L$ is a common object level difference value associated with the audio objects of the second audio object type; and wherein $A^{EAO}$ is a EAO pre-rendering matrix;

wherein the matrices $M_{OBJ}^{Energy}$ and $M_{EAO}^{Energy}$ are applied to a representation $d_0$ of a single SAOC downmix signal;

wherein the method is performed using a hardware apparatus, or using a computer, or using a combination of a hardware apparatus and a computer.

36. A computer program for performing the method according to one of claims 29 and 33 to 35 when the computer program runs on a computer.

* * * * *